US005639077A

United States Patent [19]

Hirano et al.

[11] Patent Number: 5,639,077

[45] Date of Patent: Jun. 17, 1997

[54] FINISHER WITH A SHEET STAPLING FUNCTION AND SHEET ALIGNING/ STAPLING METHOD

[75] Inventors: Yoshihito Hirano; Akio Kato, both of Toyokawa, Japan

[73] Assignee: Minolta Co., Ltd., Osaka, Japan

[21] Appl. No.: 382,754

[22] Filed: Feb. 1, 1995

[30] Foreign Application Priority Data

Feb. 3, 1994 [JP] Japan ..... 6-011647

[51] Int. Cl.[6] ..... B65H 39/02

[52] U.S. Cl. ..... 270/58.12; 270/58.16

[58] Field of Search ..... 355/324; 270/58.07, 270/58.08, 58.11, 58.12, 58.13, 58.14, 58.16, 58.17, 58.18

[56] References Cited

U.S. PATENT DOCUMENTS

| | | | |
|---|---|---|---|
| 4,361,393 | 11/1982 | Noto | 355/324 X |
| 4,763,167 | 8/1988 | Watanabe et al. . | |
| 4,965,629 | 10/1990 | Hiroi et al. . | |
| 4,986,520 | 1/1991 | Shido et al. | 270/53 |
| 5,044,625 | 9/1991 | Reid . | |
| 5,092,509 | 3/1992 | Naito et al. | 270/53 X |
| 5,180,152 | 1/1993 | Irie | 270/53 |
| 5,229,812 | 7/1993 | Toyama et al. . | |
| 5,255,902 | 10/1993 | Coombs | 270/53 |
| 5,255,908 | 10/1993 | Hiroi et al. | 270/53 X |

FOREIGN PATENT DOCUMENTS

| | | | |
|---|---|---|---|
| 4-82793 | 3/1992 | Japan | 270/53 |
| 4-161388 | 6/1992 | Japan | 270/53 |

*Primary Examiner*—Hoang Nguyen
*Attorney, Agent, or Firm*—Sidley & Austin

[57] ABSTRACT

A finisher for delivering sheets ejected from a copying machine to a plurality of bins and thereafter stapling the sheets stored in the bin. The bins are wholly moved upward and downward step by step, and every time a group of sheets have been delivered to the bins, the movement of the bins is changed from an upward movement to a downward movement and vise versa. Stapling operation by use of a stapler is carried out on a level one step upper than a level where the bins receive sheets. Sheets of an odd page are delivered to the bins while the bins are moved upward step by step, and sheets of an even page are delivered to the bins while the bins are moved downward step by step. After a last sheet is received by a bin, the bins are moved upward by one step to start stapling operation with sheets stored in the bin which has received the last sheet.

6 Claims, 45 Drawing Sheets

USUAL CASE

RECEIVING CONSECUTIVE SHEETS IN A BIN

FINISHER WITH A SHEET STAPLING FUNCTION AND SHEET ALIGNING/ STAPLING METHOD

BACKGROUND OF THE INVENTION

1. Field of the Invention

The present invention relates to a finisher and a sheet aligning/stapling method, and more particularly, to a finisher for delivering sheets ejected from an image forming machine to bins and stapling the sheets in the bins, and an aligning/stapling method in the finisher.

2. Description of Related Art

Recently, various types of sorters (finishers) for delivering image-formed sheets to bins have been developed as optional attachments for image forming machines, such as copying machines and printers. Further, in order to comply with a demand for automation of sheet handling, sorters with a stapling function as well as a sorting function have been developed.

The present inventors invented a stapler-sorter wherein while a plurality of bins which are arranged one upon another at intervals of a specified distance are wholly moved upward and downward step by step, each sheet is handed into each bin on a specified level. In the stapler-sorter, for space-saving, it is preferred to set a stapler immediately above the sheet hand-out level. Further, in order to shorten the time for sorting operation, reciprocating distribution is adopted. Every time a group of sheets have been distributed to the bins, the movement of the bins is changed from an upward movement to a downward movement and vise versa. For example, copy sheets of an odd page are distributed to the bins while the bins are moved upward, and copy sheets of an even page are distributed to the bins while the bins are moved downward.

In the stapler-sorter, the order of bins of being subjected to stapling operation after sorting operation is related to the time for stapling operation. For example, if the stapler-sorter is so structured that sorting operation is carried out in the reciprocating distribution as the above example and that stapling operation starts with the uppermost bin in any case, in a case wherein sorting operation finishes with copy sheets of an odd page, stapling operation thereafter takes a long time. When the sorting operation finishes, the uppermost bin is above the stapler, and the bins must be moved downward before starting stapling operation.

Also, sheets distributed to the bins must be aligned in the respective bins for stapling operation, and sheet aligning in each bin must be carried out promptly so as not to intervene sheet transporting/distributing operation.

SUMMARY OF THE INVENTION

An object of the present invention is to provide a finisher wherein the time for movement of the bins to start stapling operation can be shortened as much as possible.

Another object of the present invention is to provide a sheet aligning/stapling method wherein sheets can be aligned in a specified position of each bin promptly.

In order to attain the objects, a finisher according to the present invention comprises: a plurality of bins which are arranged on upon another at intervals of a specified distance; bin moving means for moving the bins wholly upward and downward step by step; sheet transporting means which hands out each sheet into each bin on a specified sheet hand-out level; stapling means which is disposed on a level near the sheet hand-out level to staple sheets stored in the bins; and control means for, after a last sheet is handed out from the transporting means into a bin, starting the stapling operation with sheets stored in the bin which has received the last sheet; and the bin moving means makes reciprocating distribution, that is, changes the movement of the bins from an upward movement to a downward movement and vise versa every time a group of sheets have been distributed to the bins.

In the present invention, the sorting operation is carried out in a reciprocating distribution method. For example, copy sheets of an odd page are distributed to the bins while the bins are moved upward, and copy sheets of an even page are distributed to the bins while the bins are moved downward. When the sorting operation in such a reciprocating distribution method is completed, a bin which has received the last sheet is disposed near the stapling level. Then, the bin which has received the last sheet is first subjected to the stapling operation. In other words, what must be done before starting the stapling operation is only to move the uppermost or the lowermost of the bins used for the stapling operation, which is closest to the stapling level, to the stapling level. Thus, in the present invention, it takes only a very short time to move the bins to start the stapling operation.

In a sheet aligning/stapling method according to the present invention, sheets ejected from a copying machine are one by one transported to a plurality of bins which are arranged one upon another at intervals of a specified distance, and a side of each sheet transported to each of the bins is pushed toward a reference plate by an aligning rod. The pushing is carried out after a trailing edge of the sheet comes into the bin before a leading edge of a next sheet comes into a next bin. Then, sheets stored and aligned in the bins are stapled by a stapler.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An embodiment of the present invention is described with reference to the accompanying drawings.

The embodiment is a sorter (finisher) for handling sheets ejected from an electrophotographic copying machine.

Figure 1:
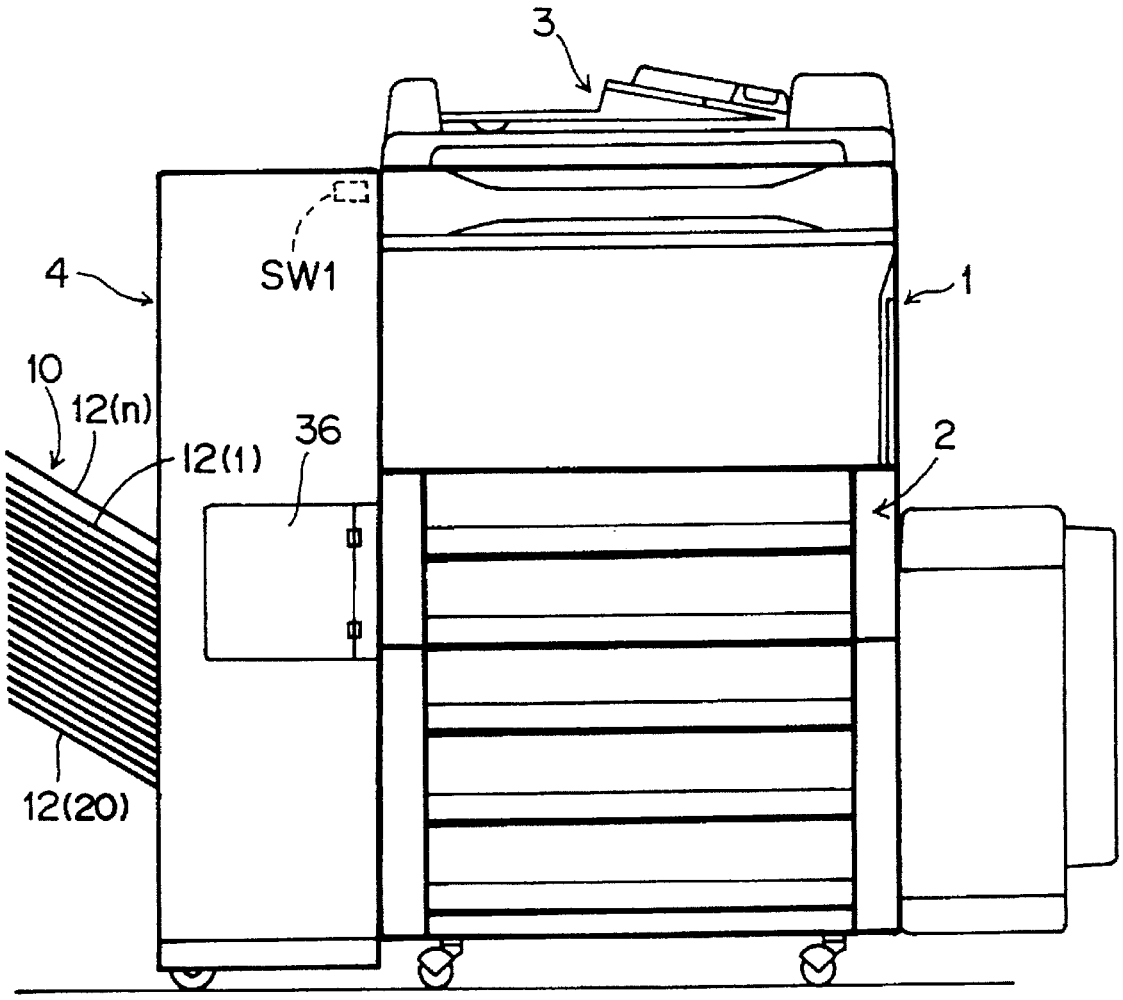
FIG. 1 is a front view of an electrophotographic copying system provided with a sorter which is an embodiment of the present invention.

Referring to FIG. 1, a copying system provided with the embodiment is generally described. In a copying machine 1, an original image is copied on a sheet by a conventional electrophotographic method. A five-story automatic sheet feeder 2 is provided below the machine 1, and an automatic document feeder 3 which feeds originals onto a platen glass one by one is provided above the machine 1.

A sorter 4 is provided in the left side of the machine 1. The sorter 4 not only distributes sheets ejected from the machine 1 to bins 12 but also punches the sheets and staples the sheets. The sorter 4 is detachable from the machine 1 for maintenance and management of sheet jamming. The attachment and detachment of the sorter 4 is detected by a set switch SW1. Only while the set switch SW1 detects the sorter 4 being attached to the machine 1, the sorter 4 is operational.

Figure 2:
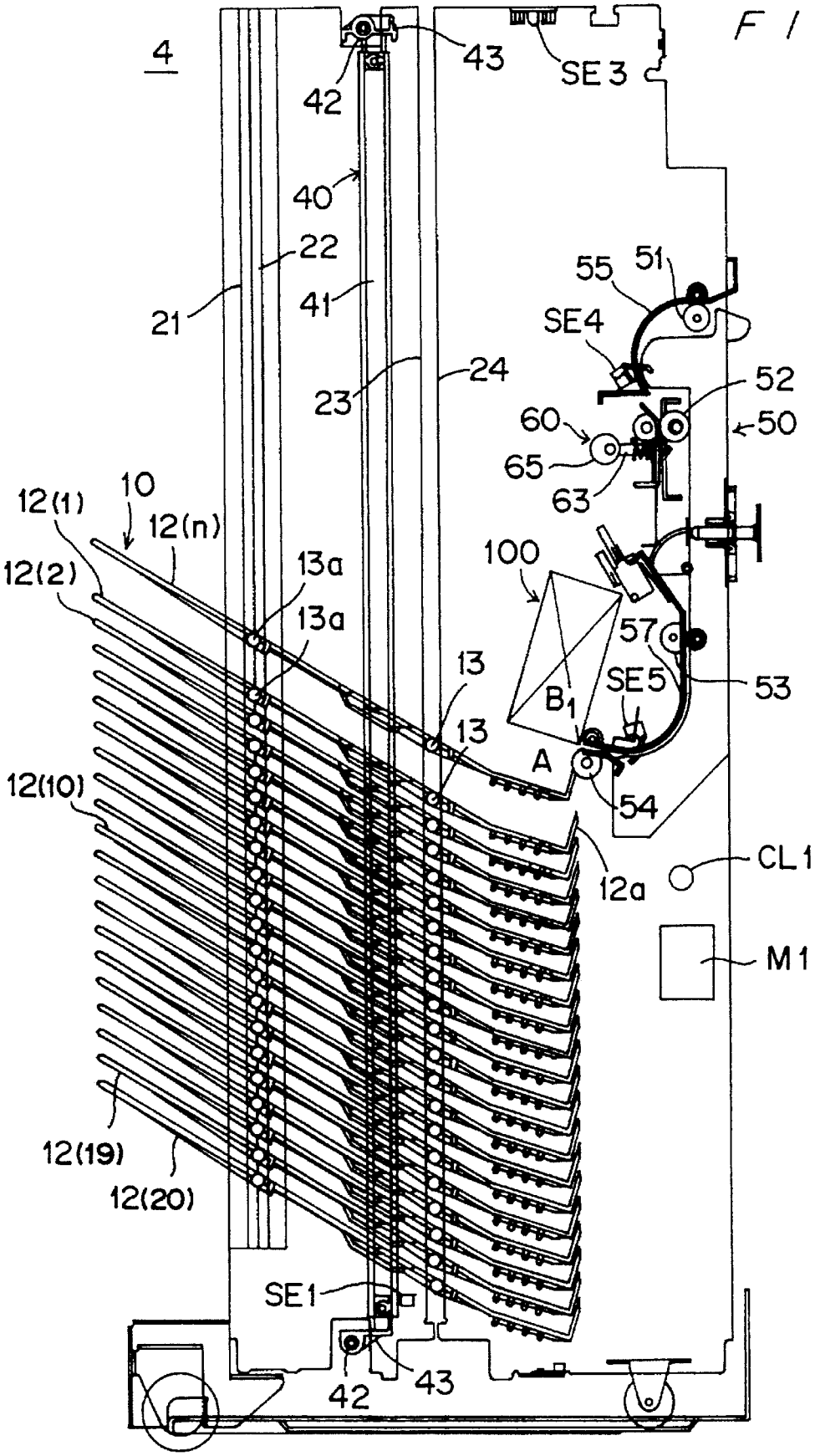
FIG. 2 is an elevational view of the sorter, showing the internal composition thereof.
Figure 3:
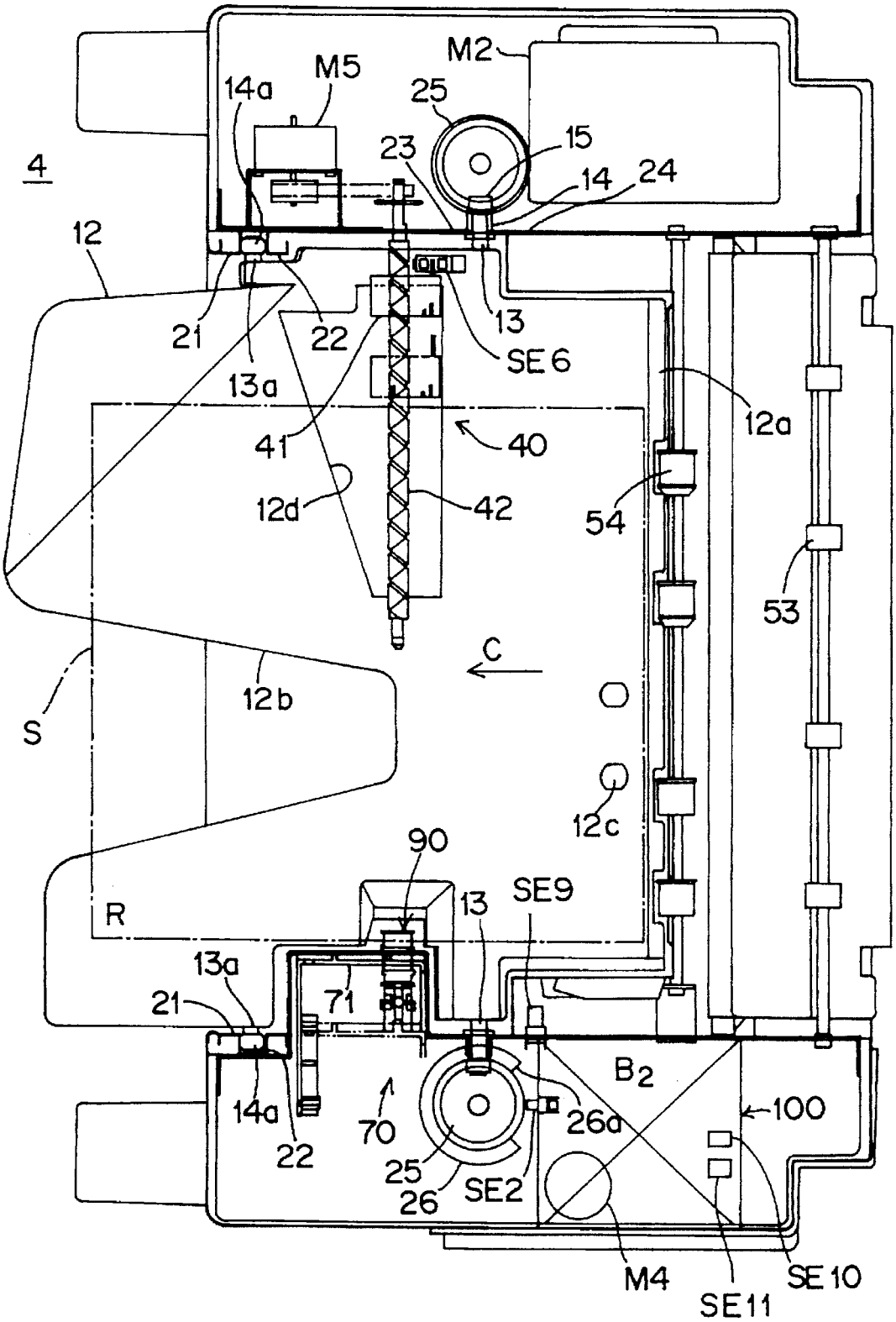
FIG. 3 is a plan view of the sorter, showing the internal composition thereof.

FIGS. 2 and 3 show the general structure of the sorter 4. The sorter 4 comprises a bin assembly 10, a sheet transporting mechanism 50, a punching mechanism 60, a sheet aligning mechanism 40, a sheet chucking mechanism 70 and a stapler 100.

Bin Assembly

In the bin assembly 10, bins 12 are arranged one upon another at uniform intervals. The bins 12 include a top bin $\mathbf{12}_{(n)}$ used as a non-sort tray, and twenty bins $\mathbf{12}_{(1)}$ through $\mathbf{12}_{(20)}$ used as sort trays. Sheets are handed into the bins 12 at a position A in FIG. 2. The bins 12 are movable up and down to receive sheets at the hand-out position A. Stapling operation is carried out at a level $B_1$ in FIG. 2 (horizontally, at a position $B_2$ in a plan view of FIG. 3) by a stapler 100. For the stapling operation, each bin 12 moves one step up to the stapling level $B_1$ from the sheet hand-out position A.

Sheet Transporting Mechanism

Figure 4:
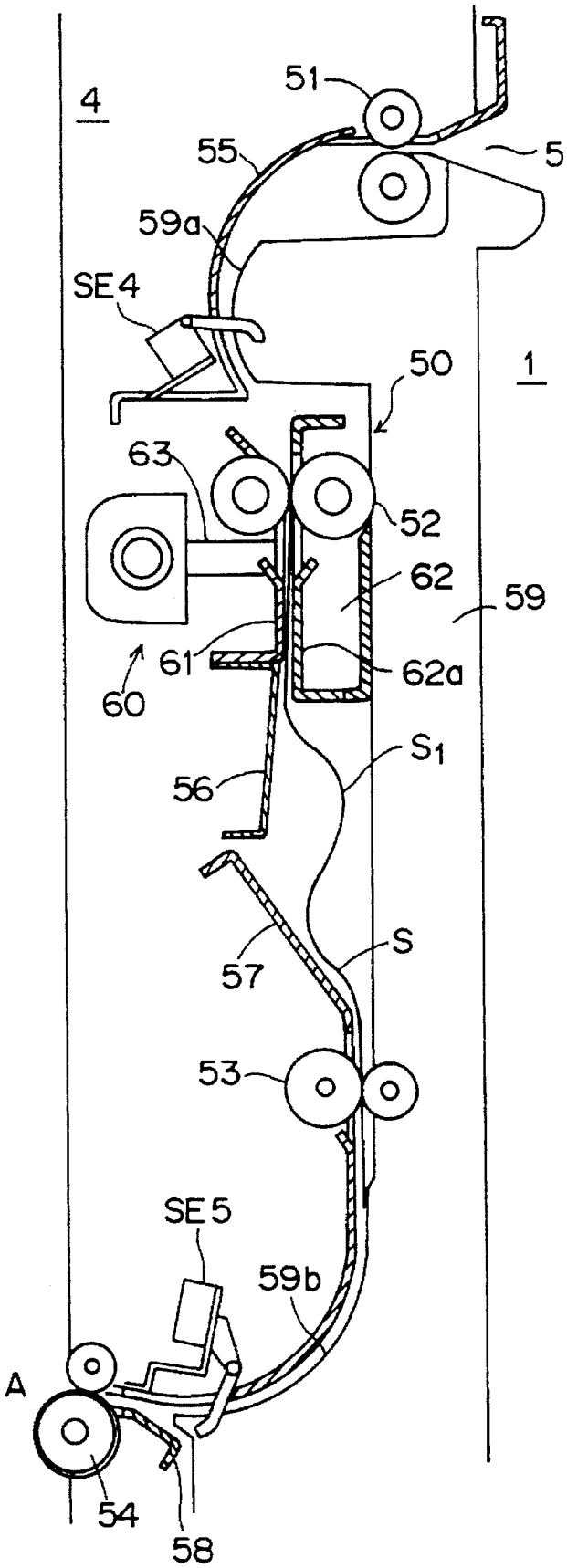
FIG. 4 is a sectional view of a sheet transporting mechanism.

The sheet transporting mechanism 50 is a sheet path from the machine 1 to the bins 12. As shown in FIG. 4, the punching mechanism 60, and sheet sensors SE4 and SE5 are disposed in the sheet path. The sheet transporting mechanism 50 has a receiving roller pair 51, a register roller pair 52, a clutch roller pair 53 and a hand-out roller pair 54. These roller pairs are driven by a transport motor M1 (see FIG. 2) through a conventional transmission mechanism. The receiving roller pair 51 and the register roller pair 52 are connected to the transport motor M1 such that the power of the motor M1 is transmitted to these pairs 51 and 52 at all times. The power transmission to the clutch roller pair 53 and the hand-out roller pair 54 can be connected and disconnected by an electromagnetic clutch CL1.

A copied sheet which is ejected from the machine 1 through an outlet 5 is received by the receiving roller pair 51. Next, the sheet is guided downward by a guide plate 55 and a guide surface 59*a* of a frame 59 and comes between a guide plate 61 and a guide portion 62*a* of a punch trash can 62 of the punching mechanism 60. Further, the sheet is guided downward by guide plates 56 and 57 and received by the clutch roller pair 53. Then, the sheet is guided to the left by a guide surface 59*b* of a frame 59 and a guide plate 58 to the hand-out roller pair 54 and is handed into a bin 12 which is in the hand-out position A.

Punching sticks 63 are driven to punch a sheet at the trailing portion. In order to punch every sheet at the same point, accurate positioning of a sheet is necessary. In the present embodiment, the accurate positioning of a sheet is intended to be achieved by temporarily making the speed of the register roller pair 52 different from the speed of the clutch roller pair 53 and the hand-out roller pair 54. More specifically, when a specified time has passed since the sensor SE4 detected the trailing edge of a sheet S (when the trailing edge of the sheet reaches a point about 10 mm up-stream of the register roller pair 52), the electromagnetic clutch CL1 is turned on such that the power transmission from the motor M1 to the roller pairs 53 and 54 is disconnected. Thereby, the leading portion of the sheet S stops, while the trailing portion continues to be fed by the register rollers 52. Then, the sheet S curves between the roller pairs 52 and 53 as indicated by $S_1$ in FIG. 4. After the trailing edge of the sheet S passes through the nipping portion of the register roller pair 52, the trailing edge is pushed against the nipping portion of the roller pair 52 by the firmness of the sheet S and the elasticity generated by the curved portion $S_1$ of the sheet S. Thereby, a punching point of the sheet S is accurately settled, and the punching sticks 63 are driven to punch the sheet S. After the punching operation, the electromagnetic clutch CL1 is turned off, and the roller pairs 53 and 54 start to be driven again.

With the above-described structure and control, the trailing edge of a sheet is regulated by the register roller pair 52, and the punching point is accurately settled. Thus, the punching operation is completed simply and promptly without giving so heavy a burden to the sheet transporting mechanism 50 and without reducing the copying speed of the machine 1.

Further, for the positioning of the trailing edge of a sheet, it is effective to decrease the speed of the roller pairs 53 and 54 or to increase the speed of the roller pair 52, as well as to disconnect the power transmission from the motor M1 to the roller pairs 53 and 54.

It is possible to drive the roller pairs 51 and 52 with a motor and drive the roller pairs 53 and 54 with another motor. In this case, the trailing edge of a sheet can be regulated by the register roller pair 52 by controlling the number of rotations of the motors separately.

Now, conditions which must be fulfilled in order to carry out the punching operation without reducing the efficiency of sheet transportation are described.

First, characteristics of the sheet transporting mechanism 50 are denoted as follows:

a: distance between the receiving roller pair 51 and the detection point of the sensor SE4 (mm)

b: distance between the detection point of the sensor SE4 and the register roller pair 52 (mm)

c: distance between the register roller pair 52 and the clutch roller pair 53 (mm)

d: distance between the clutch roller pair 53 and the hand-out roller pair 54 (mm)

e: length of the curved portion of a sheet (mm)

f: punching time (msec)

S: system speed of the sorter 4 (mm/sec)

L: length of a sheet in the traveling direction (mm)

n: intervals among sheets (mm)

The distance between the register roller pair 52 and the hand-out roller pair 54 (c+d) should meet the condition:

$$L-e<c+d<L+n-[\{(1000e/S)+f\}/1000]S$$

Under the condition, when a sheet is punched, the leading edge of the sheet is before the hand-out roller pair 54, and the trailing edge of the previous sheet is beyond the hand-out roller pair 54. In the expression, [{(1000e/S)+f}/1000] indicates a period (msec) of disconnection of the clutch roller pair 53 from the motor M1 (a period of stop of the clutch roller pair 53).

If the sheet length L and the intervals n among sheets are so small that the above condition cannot be fulfilled, before the positioning of the trailing edge of a sheet, the trailing edge of the previous sheet has not passed through the hand-out roller pair 54. In order to comply with this case, the power transmission mechanism of the motor M1 shall be so structured as to drive the register roller pair 52 and the hand-out roller pair 54 continuously by using a conventional torque limiter and to drive only the clutch roller pair 53 intermittently. In the structure, while the clutch roller pair 53 is stopped for the positioning of the trailing edge of a sheet, the previous sheet is fed out of the hand-out roller pair 54 into a bin 12 by rotation of the hand-out roller pair 54. On the other hand, if the sheet length L is too long, when the clutch roller pair 53 is stopped for positioning of the trailing edge of a sheet, the leading edge of the sheet is nipped by the hand-out roller pair 54. Providing a torque limiter in the power transmission mechanism is also effective to comply with this case. The torque limiter prevents the hand-out roller pair 54 from idling. Thereby, there is no fear that the hand-out roller pair 54 may erase part of the image on the sheet, stain the sheet and/or apply a stress to the sheet which causes sheet jamming.

Punching Mechanism

Figure 5A:
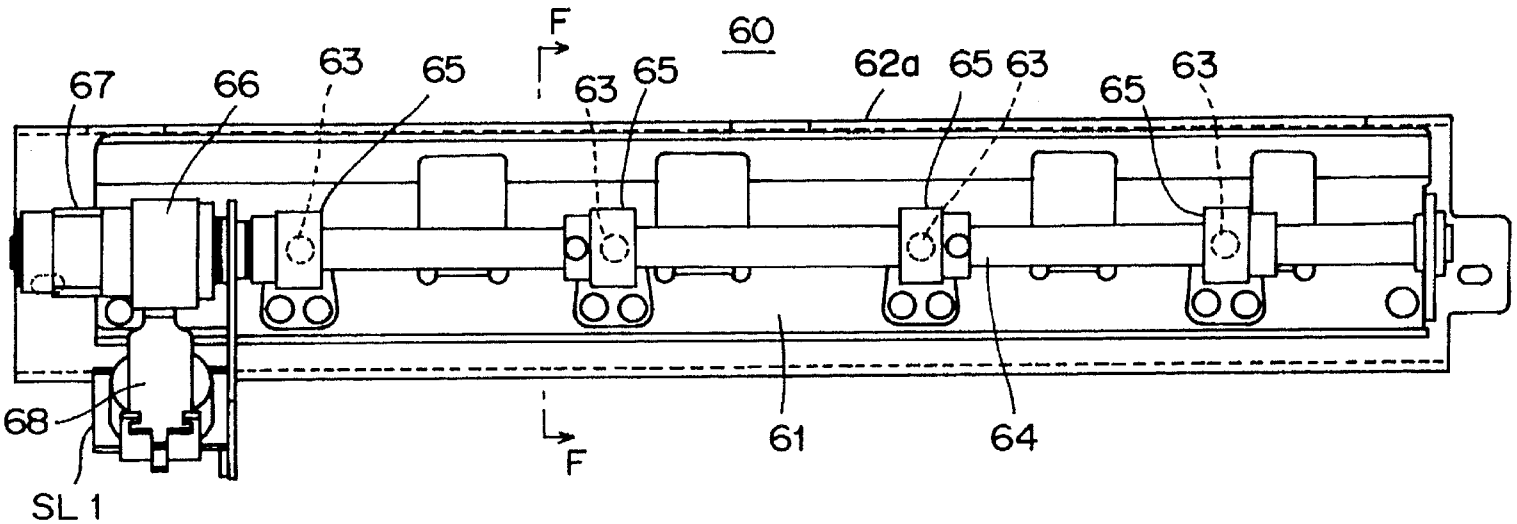
FIGS. 5*a*, 5*b* and 5*c* show a punching mechanism, FIG. 5*a* being a front view, FIG. 5*b* being a left side view and FIG. 5*c* being a sectional view taken along the line F—F in FIG. 5*a;*
Figure 5C:
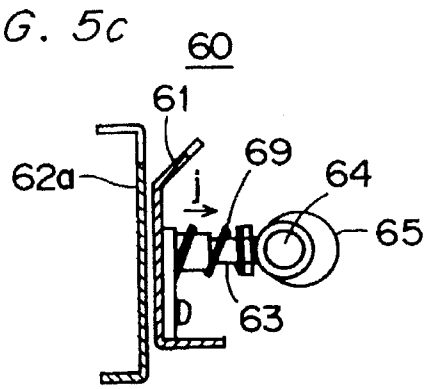
Figure 5B:
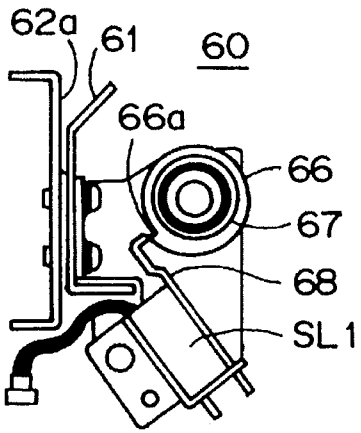

As shown in FIGS. 5*a*, 5*b* and 5*c*, the punching mechanism 60 comprises the guide plate 61, the punch trash can 62, the four punching sticks 63, a driving shaft 64, eccentric cams 65, a one-rotation clutch 66 and a flapper solenoid SL1. The punching sticks 63 are urged by coil springs 69 in a direction retreating from the guide plate 61 (in a direction indicated by arrow j in FIG. 5*c*), and the rear ends thereof are pressed against the circumferences of the eccentric cams 65 which are fixed on the driving shaft 64.

The one-rotation clutch 66 is to connect and disconnect the power transmission from the motor M1 to the driving shaft 64 via a gear 67. The clutch 66 has a kick spring (not shown) inside and has a step 66*a* on the circumference so as to engage with a pawl 68 of the flapper solenoid SL1. While the flapper solenoid SL1 is off, the pawl 68 keeps engaging with the step 66*a*, which keeps the clutch 66 off. In this state, clockwise (in the view of FIG. 5*b*) rotation of the gear 67 is not transmitted to the driving shaft 64, and the rear ends of the punching sticks 63 are in contact with small radial portion of the eccentric cam 65. Accordingly, the punching sticks 63 are in retreat from the surface of the guide plate 61. The flapper solenoid SL1 is turned on for an instance, and thereby, the clutch 66 and the driving shaft 64 rotate. Then, when the step 66*a* of the clutch 66 comes in engagement with the pawl 68, that is, when the clutch 66 and the driving shaft 64 have made one rotation, the rotation is stopped. With the rotation of the driving shaft 64, the eccentric cam 65 makes one rotation and reciprocates (protrudes from the guide plate 61 and returns) the punching sticks 63. Thus, a sheet stuck between the guide plate 61 and the guide portion 62*a* of the punch trash can 62 are punched.

Bin Moving Mechanism

As shown in FIG. 12, each bin 12 is shaped like a plate. Each bin 12 has a sheet reflow prevention wall 12*a* in its supported end and has a large cut-out 12*b* in its free end. The cut-out 12*b* helps an operator take sheets out of the bin 12. Two couples of pins 13 and 13*a* stand on both sides of each bin 12. Rollers 14 and 15 (see FIG. 7) are rotatably fitted to each of the pins 13, and a roller 14*a* is rotatably fitted to each of the pins 13*a*. Each roller 14*a* is disposed between guide plates 21 and 22 which extend vertically, and is movable up and down. Each roller 14 is disposed between guide plates 23 and 24 which extend vertically, and is movable up and down.

Figure 6:
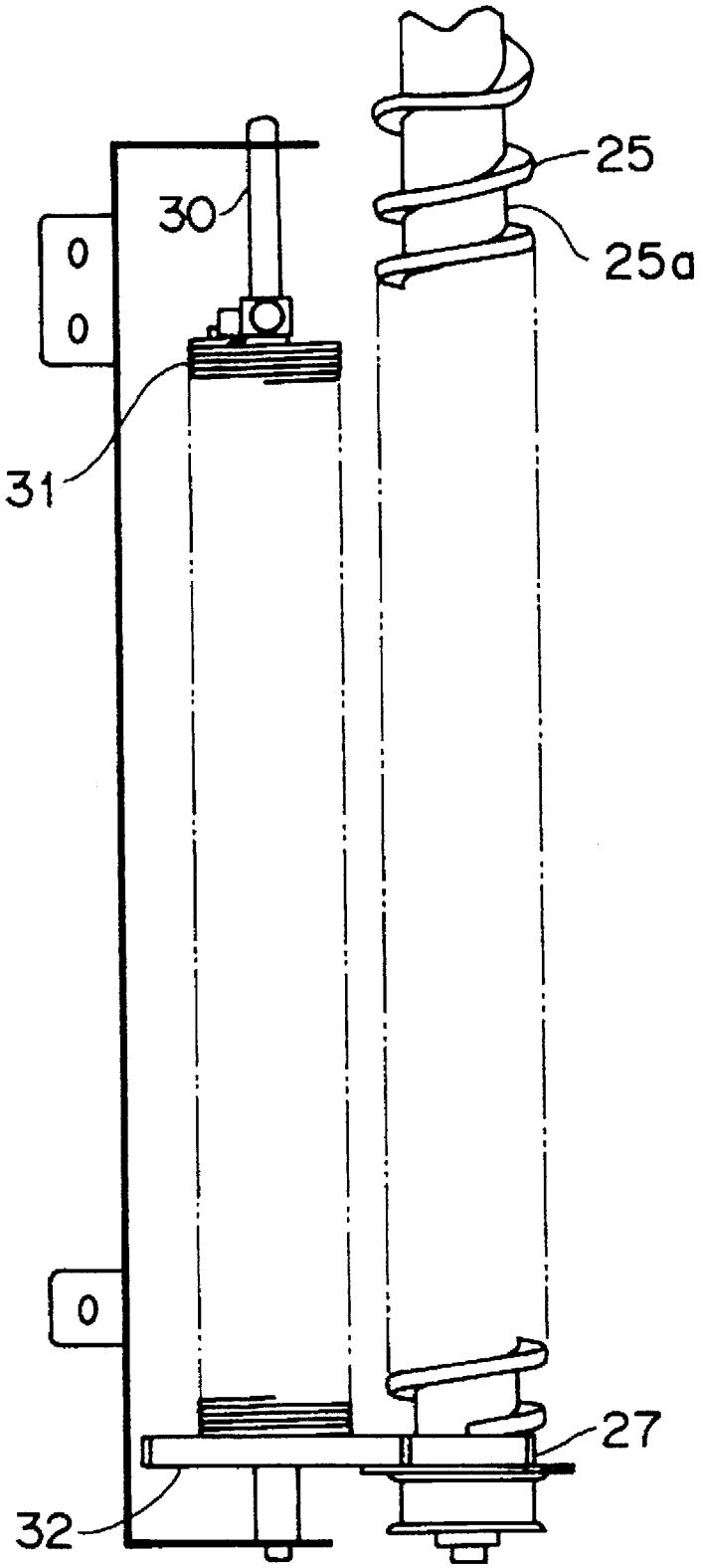
FIG. 6 is an elevational view of a bin moving mechanism.
Figure 7:
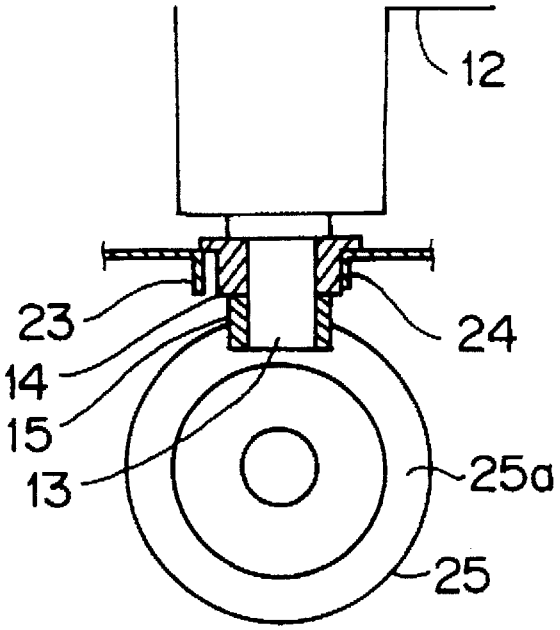
FIG. 7 is a horizontal sectional view of the bin moving mechanism, showing the engagement between a bin driving shaft and rollers.
Figure 8:
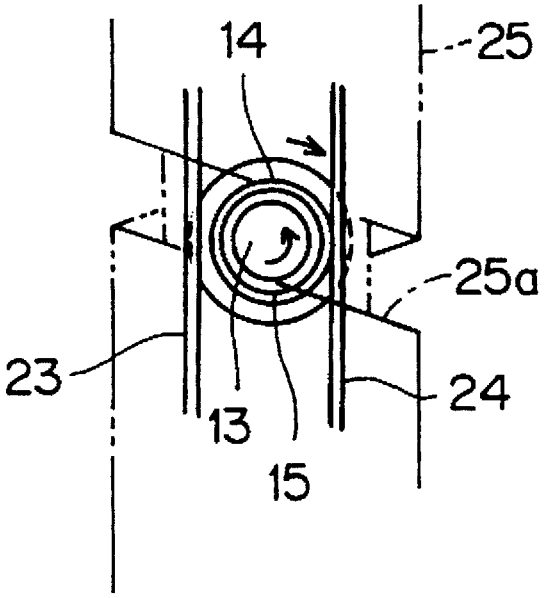
FIG. 8 is an elevational view of the bin moving mechanism, showing the engagement between the bin driving shaft and the rollers.

Driving shafts 25, which are to move the bins 12 wholly up and down, extend vertically at both sides of the bin assembly 10. As shown in FIGS. 6, 7 and 8, each of the driving shafts 25 has a spiral cam groove 25*a* on the circumference, and the roller 15 fitted to the corresponding pin 13 engages with the cam groove 25*a*. A reversible bin motor M2 is disposed in a rear side (upper side of FIG. 3) of the sorter 4, and the motor M2 is connected to the driving shaft 25 in the rear side. The other driving shaft 25 in a front side is connected to the rear side driving shaft 25 by a chain (not shown), and thereby, both the driving shafts 25 rotate synchronously. The driving shafts 25 hold the bins $12_{(1)}$ through $12_{(20)}$ and the non-sort bin $12_{(n)}$ by engagement of the respective rollers 15 with the cam grooves 25*a*. The intervals among the bins depends on the pitch of the cam grooves 25*a*. As is apparent from FIG. 2, the interval between a bin by the side of the hand-out roller pair 54 (in the hand-out position A) and the next bin is increased because the cam grooves 25*a*, in the position A, has a pitch double the other portions. FIG. 2 shows a state wherein the non-sort bin $12_{(n)}$ is in the hand-out position A. Then, when the driving shafts 25 make one rotation in a normal direction or in a reverse direction, the bin assembly 10 wholly moves up or down by one pitch. In sorting operation, the bins $12_{(1)}$ through $12_{(20)}$ are positioned in the hand-out position A one by one in this way.

FIG. 2 shows the lowest position of the bin assembly 10, and this position is detected by a sensor SE1. A disk 26 with a cutout 26*a* is fitted to the front side driving shaft 25 (see FIG. 3), and positioning of each bin in the hand-out position A (hereinafter referred to as regular bin position) is detected by monitoring the rotation of the disk 26 with a sensor SE2. Further, a sensor SE3 which detects whether any bin 12 contains any sheet is provided in the sorter 4 (see FIG. 2). The sensor SE3 comprises a light emitting element and a light receiving element, and the optical axis thereof pierces vertically through holes 12*c* made in the bins 12.

In the present embodiment, two ideas are adopted to decrease the driving torque of the driving shafts 25.

One is the rollers 14 and 15 fitted to each pin 13 of each bin 12. The rollers 14 and 15 rotate independently of each other. The roller 14 engages with the guide plates 23 and 24, and the roller 15 engages with the cam groove 25*a*. While the bins 12 are moving up, the rollers 15, which are in contact with the cam grooves 25*a*, are provided with a counterclockwise rotating force in FIG. 8, and the rollers 14, which are in contact with the guide plates 24, are provided with a clockwise rotating force. The rollers 14 and 15 rotate in the opposite directions to each other, which helps the bins 12 move up smoothly. In a conventional structure, each pin 13 is fitted with a single roller, and the roller engages with the guide plates 23 and 24 and the cam groove 25*a*. In the conventional structure, while the bins 12 are moving up, the rollers fitted to the respective pins 13 rotate counterclockwise and slip on the guide plate 24. The slip becomes a resistance, which increases the driving torque of the driving shafts 25. In the present embodiment, the driving torque in a case of moving up the bins 12 can be decreased by fitting two rollers, not a single roller, to each pin 13.

The other is a shaft 30 which is provided next to each of the driving shafts 25 and is wound with a coil spring 31 (see FIG. 6). An upper end of the coil spring 31 is fixed on the shaft 30, and a lower end thereof is fixed on a gear 32 which is rotatably fitted to the shaft 30. The gear 32 engages with a gear 27 which is fitted to the driving shaft 25. While the driving shafts 25 are rotating in the reverse direction, that is, while the bins 12 are moving down, the rotation of the driving shafts 25 is transmitted to the gears 32 via the gears 27, and the coil springs 31 are tightened. In other words, the coil springs 31 save a spring force. Then, while the driving shafts 25 are rotating in the normal direction, that is, while the bins 12 are moving up, the spring force of the coil springs 31 is transmitted to the driving shafts 25 via the gears 32 and 27. Thereby, the driving torque in a case of moving up the bins 12 can be decreased.

Sheet Aligning Mechanism

Every time a sheet is received by a bin 12, the sheet aligning mechanism 40 aligns sheets in a regular position R in the bin 12 by using an aligning reference plate 71. Also, after stapling operation, the sheet aligning mechanism 40 puts the stapled sheets in the regular position R. Each bin 12 has an opening 12*d*, and an aligning rod 41 stands vertically so as to pierce through these openings 12*d* of all the bins 12. In the upper and lower portions of the sorter 4, spiral shafts 42 are provided so as to extend in a direction perpendicular to the direction C in which a sheet S is handed into the bin 12. The spiral shafts 42 are connected to an aligning motor M5 and is rotatable in the normal and reverse directions. Upper and lower ends of the aligning rod 41 are fixed on brackets 43 screwed to the respective spiral shafts 42 (see FIG. 2), and the aligning rod 41 moves to the front and rear together with the brackets 43 as the spiral shafts 42 are moving. In FIG. 3, the position of the aligning rod 41 indicated by the solid line is the home position. A sensor SE6 detects whether the aligning rod 41 is in the home position. The aligning motor M5 is a pulse motor. When the motor M5 is driven by a specified number of pulses, the aligning rod 41 moves to the front by a distance according to the number of pulses, which depends on the width of a sheet S to be received by the bin 12. Thus, the aligning rod 41 pushes the sheet S until the other side of the sheet comes into contact with the reference plate 71.

Sheet Chucking Mechanism

The sheet chucking mechanism 70 grabs sheets stored in the bins $12_{(1)}$ through $12_{(20)}$ and moves them to the stapling position $B_2$ (see FIG. 3), and after stapling operation, the sheet chucking mechanism 70 returns the sheets to the regular position S in the respective bins $12_{(1)}$ through $12_{(20)}$. This operation is carried out on the same level as the stapling operation level $B_1$ (see FIG. 2).

Figure 9:
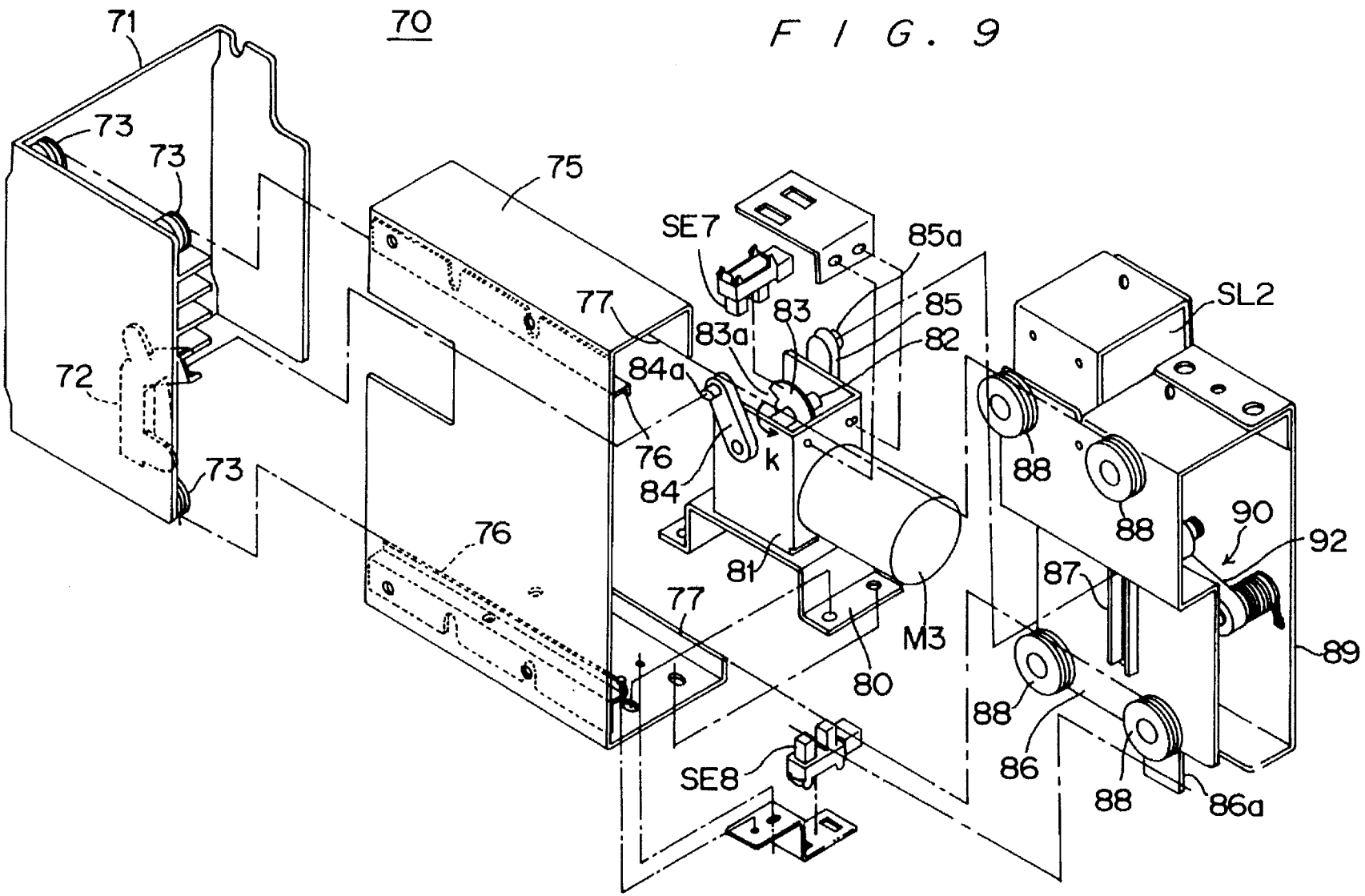
FIG. 9 is a perspective view of a sheet chucking mechanism.
Figure 10:
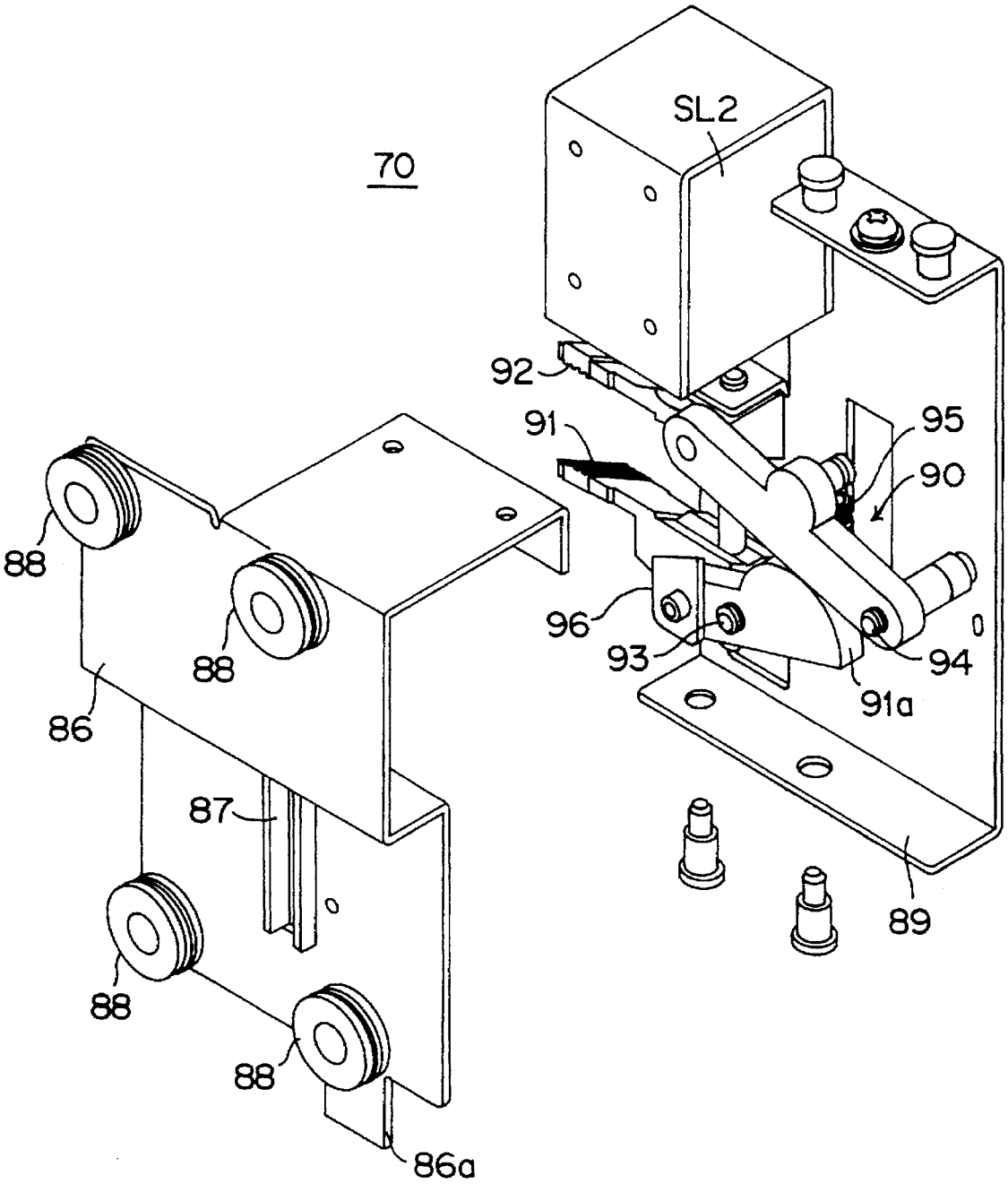
FIG. 10 is an exploded perspective view of a chucking.
Figure 11:
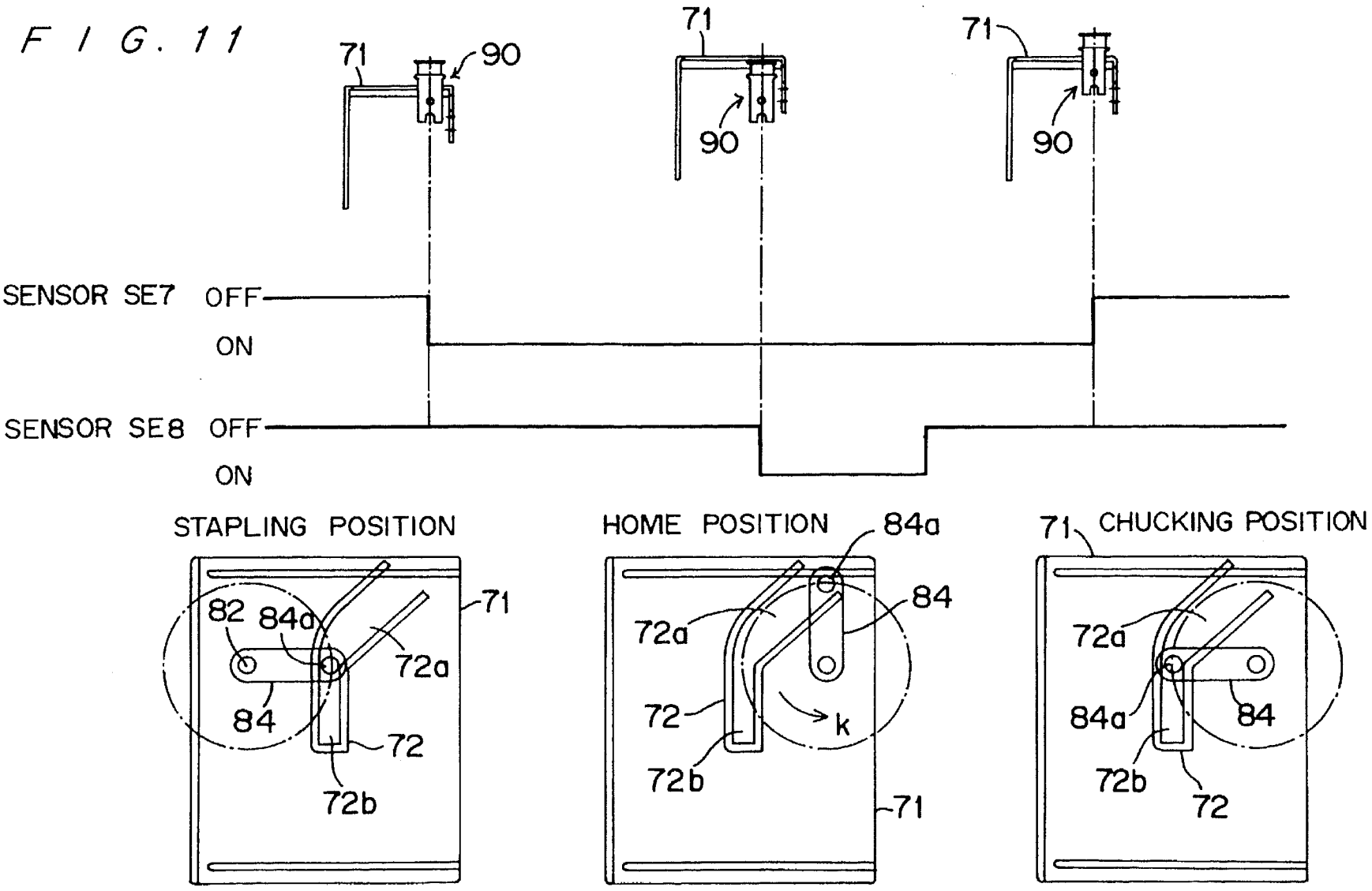
FIG. 11 is an illustration of action of the sheet chucking mechanism.

FIGS. 9 and 10 show the structure of the sheet chucking mechanism 70. The chucking mechanism 70 comprises the aligning reference plate 71, a fixed bracket 75, a chucking motor M3, a chucking 90, and movable brackets 86 and 89 which hold the chucking 90. The aligning reference plate 71 has guide rollers 73, and the guide rollers 73 engage with guide plates 76 of the fixed bracket 75. Therefore, the aligning reference plate 71 is slidable. The chucking motor M3 is fitted to the fixed bracket 75 via brackets 80 and 81. The bracket 81 holds a shaft 82, and the motor M3 rotates the shaft 82 in a direction indicated by the arrow k. A lever 84, which has a pin 84*a* at an end, is fitted to an end of the shaft 82, and the pin 84*a* engages with a guide member 72 fitted to the aligning reference plate 71. The guide member 72, as shown in FIG. 11, has an inclined guide groove 72*a* and a vertical guide groove 72*b*. While the lever 84 is turning, the pin 84*a* moves in the guide grooves 72*a* and 72*b*, and consequently, the reference plate 71 moves to the front and rear. The motion of the reference plate 71 is detected by a sensor SE7. The sensor SE7 actually monitors rotation of a disk 83 with a notch 83*a* which is fitted to the shaft 82.

The chucking 90, as shown in FIG. 10, comprises clippers 91 and 92 which are rotatably fitted to the movable bracket 89 via shafts 93 and 94. The lower clipper 91 is connected to an actuator 96 of a solenoid SL2. The clippers 91 and 92 are drawn to each other by a coil spring 95, and a cam surface 91*a* of the clipper 91 is in contact with a lower side of the clipper 92. While the solenoid SL2 is off, the actuator 96 is in a low position, and the ends of the clippers 91 and 92 are open. When the solenoid SL2 is turned on, the actuator 96 moves up, and thereby the lower clipper 91 turns upward on the shaft 93. Meanwhile, the lower side of the upper clipper 92 slides along the cam surface 91*a*, and the clipper 92 turns downward on the shaft 94. Thus, when the solenoid SL2 is turned on, the ends of the clippers 91 and 92 are closed to grab sheets.

The movable bracket 89 is integrated with the movable bracket 86 on which guide rollers 88 are fixed. The guide rollers 88 engage with a guide plate 77 of the fixed bracket 75, and the brackets 89 and 86 are slidable. A lever is fitted to the end of the shaft 82, which is driven by the motor M3, the end being opposite to the end provided with the lever 84. The lever 85 has a pin 85*a* at the end, and the pin 85*a* engages with a guide groove 87 provided on a side of the movable bracket 86. In this structure, the chucking 90 moves to the front and rear as the lever 85 is turning. The motion of the chucking 90 is detected by a sensor SE8. The sensor SE8 actually detects a tab 86*a* of the movable bracket 86.

In stapling one set of sheets, the motor M3 drives the levers 84 and 85 to make one rotation. At the start of drive of the motor M3, the levers 84 and 85 are in upright postures. In this state, the pin 84*a* faces the upper end of the guide groove 72*a*, and the pin 85*a* is in the upper end of the guide groove 87. In this state, the aligning reference plate 71 and the chucking 90 are in the home positions (see FIG. 11), and the aligning reference plate 71 in the position regulates a side of a sheet S shown in FIG. 3. When the motor M3 is turned on, the pin 84*a* moves into the guide groove 72*a*. The aligning reference plate 71 keeps in the home position and the sensor SE7 keeps on until the lever 84 turns in the direction of arrow k by 90 degrees. Meanwhile, by the engagement of the pin 85*a* with the guide groove 87, the chucking 90 moves to the rear toward the sheets in the regular position R. The sensor SE8 is turned on when the motor M3 is turned on. When the lever 85 turns by 90 degrees, the chucking 90 comes to the rear most. At that time, the sensor SE7 is turned off, and the solenoid SL2 is turned on to make the clippers 91 and 92 grab the sheets. The sensor SE8 is turned off while the chucking 90 is moving to the rear. While the levers 84 and 85 are turning from 90 degrees to 270 degrees, both the aligning reference plate 71 and the chucking 90 move to the front and draw the sheets to the stapling position $B_2$. When the rotation of the levers 84 and 85 becomes 270 degrees, the sensor SE7 is turned on, and the stapler 100 is driven to staple the sheets. After the stapling, the solenoid SL2 is turned off, and the sheets are relieved from the clippers 91 and 92.

Thereafter, while the levers 84 and 85 turning from 270 degrees to 360 degrees, the aligning reference plate 71 and the chucking 90 move to the rear to the home positions. Thereby, the stapled set of sheets are pushed back in the regular position S in the bin 12.

Further, a sensor SE9 (see FIG. 3) is provided to detect whether the chucking 90 brings the sheets to the stapling position $B_2$.

Stapler

The stapler 100 is a conventional electric type. A motor M4 drives a tap (not shown) to hit a staple in sheets. A lot of straight staples are stuck together by adhesive to be in the shape of a sheet, and a cartridge contains a number of such staple sheets. The staple cartridge is loaded in the stapler 100 through a small door 36 shown in FIG. 1.

The stapler 100 has a sensor SE10 which detects whether the tap is in the home position and a sensor SE11 which detects whether there are staples.

Next, operation modes of the sorter 4 are described.

Non-Sorting Mode

A non-sorting mode is a mode of transporting sheets ejected from the machine 1 to one or more bins 12.

The operator sets the non-sorting mode by use of a key on an operation panel (not shown). The non-sorting mode is an initial mode.

In response to the setting of the non-sorting mode, the bin assembly 10 is set in the lowest position, which is detected by the sensor SE1. Then, the sensor SE2 detects that the non-sort bin $12_{(n)}$ is in the hand-out position A.

A sheet which has received an image in the machine 1 passes through the transporting mechanism 50 and is received on the non-sort bin $12_{(n)}$ through the hand-out roller pair 54. Imaged sheets are transported to the non-sort bin $12_{(n)}$ in this way one after another and piled thereon. When the non-sort bin $12_{(n)}$ receives a specified number of sheets, the bin assembly 10 moves up by one step, and then, the first sort bin $12_{(1)}$ starts receiving sheets. In this way, each time a bin 12 is filled with sheets, the bin assembly 10 moves up by one step such that the next bin 12 can receive successive sheets.

Sorting Mode

A sorting mode is a mode of sorting sheets ejected from the machine 1 by use of the sort bins $12_{(1)}$ through $12_{(20)}$.

The operator sets the sorting mode by use of a key on the operation panel. In response to the setting of the sorting mode, the bin driving shafts 25 make one rotation in the normal direction so as to lift the bin assembly 10 by one step from the home position of FIG. 1. Thereby, the first sort bin $12_{(1)}$ comes to the hand-out position A, and this position of the bin assembly 10 is hereinafter referred to as sorting initial position.

Figure 12A:
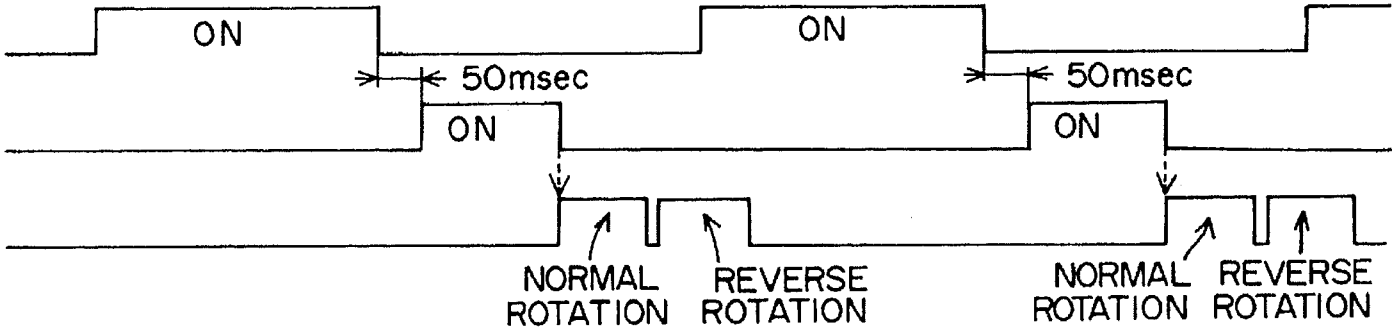
FIGS. 12*a* and 12*b* are time charts of bin moving and sheet aligning.

A sheet which has received an image in the machine 1 passes through the transporting mechanism 50 and is received on the sort bin $12_{(1)}$ through the hand-out roller pair 54. As shown in FIG. 12*a*, a specified time (for example, 50 milliseconds) after the trailing edge of the sheet is detected by the hand-out sensor SE5, the bin motor M2 is driven in the normal direction so as to lift the bin assembly 10 by one step. Subsequently, the aligning motor M5 is driven in the normal direction so as to move the aligning rod 41 to the front. Thereby, the received sheet is regulated between the aligning rod 41 and the aligning reference plate 71. The moving distance of the aligning rod 41 depends on the sheet size. The aligning motor M5 is driven in the normal direction by a number of pulses which is determined in accordance with sheet size data transmitted from a control section of the machine 1 to a control section of the sorter 4. The aligning motor M5 is driven in the reverse direction by the same number of pulses immediately after the normal rotation. Thereby, the aligning rod 41 is returned to the home position. In the meantime, the next sheet is received on the next bin $12_{(2)}$. Thereafter, sheets are received on the bins $12_{(3)}$ through $12_{(20)}$ one by one in the same manner.

Figure 12B:
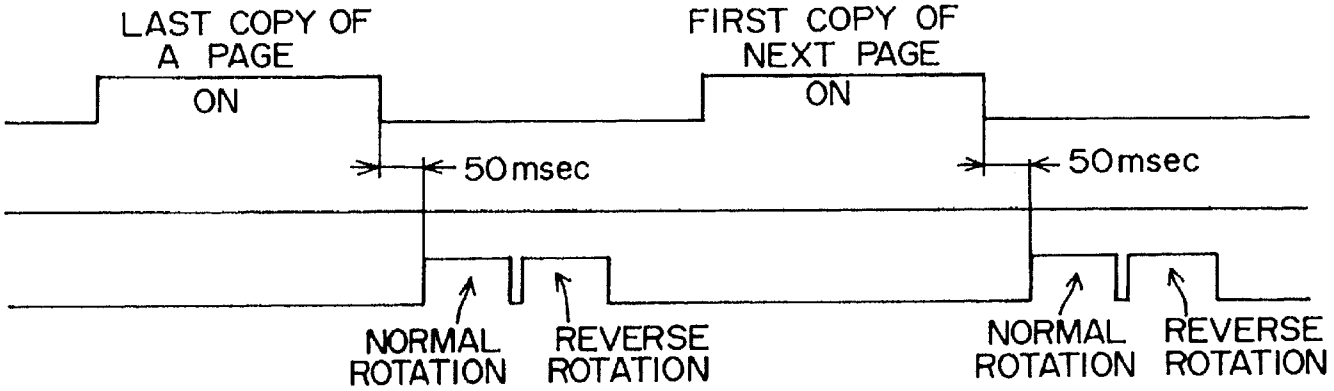

The sorter 4 makes reciprocating distribution. Sheets of an odd page are distributed among the bins while the bin assembly 10 is moving upward step by step, and sheets of an even page are distributed while the bin assembly 10 is moving downward step by step. When the bin assembly 10 changes from the upward motion to the downward motion or from the downward motion to the upward motion, the uppermost of the used bins or the lowermost of the used bins receives two consecutive sheets which are the last sheet of a page and the first sheet of the next page. While the uppermost or the lowermost of the used bins is receiving two consecutive sheets, the bin assembly 10 does not move, and the sheet aligning operation is carried out earlier than usual. The aligning operation in this case is shown by FIG. 12*b*. After the hand-out sensor SE5 detects the trailing edge of the last sheet of a page, the aligning motor M5 is driven at the timing of driving the bin motor M2 in a usual case. At that time, the sheet which has passed through the hand-out roller pair 54 is still In the air before falling into the bin 12.

Since the aligning motor M5 is started while the sheet is still in the air, the aligning operation is more effective. If the aligning operation is carried out after the newly-fed sheet falls into the bin 12 and completely sticks to sheets stored in the bin 12, there is a possibility that the friction between the newly-fed sheet and the sheets stored in the bin 12 is so large that the aligning operation is not effective. However, as described, the aligning operation is carried out effectively at an earlier timing.

Sorting/Stapling Mode

A sorting/stapling mode is a mode of sorting sheets ejected from the machine 1 and stapling the sheets stored the sort bins $\mathbf{12}_{(1)}$ through $\mathbf{12}_{(20)}$.

The operator sets the sorting mode and the stapling mode by use of keys on the operation panel.

First, sheets which have received images in the machine 1 are sorted while the sorter 4 is operating as described above.

The stapling operation is carried out after the sorting operation. In the stapling operation, bins stored with the sheets are moved to the stapling level $B_{(1)}$ one by one. The movement to the stapling level $B_{(1)}$ starts with a bin which has received the last sheet in the sorting operation. For example, when ten copy sets are made from an odd number of documents, the tenth sort bin $\mathbf{12}_{(10)}$ is in the hand-out position A at the time of completing the sorting operation. Then, the bin assembly 10 moves one step up to set the tenth sort bin $\mathbf{12}_{(10)}$ to the stapling level B. After stapling of sheets in the bin $\mathbf{12}_{(10)}$, the bin assembly 10 moves one step down to set the ninth sort bin $\mathbf{12}_{(9)}$ to the stapling level $B_1$. Thereafter, the bin assembly 10 moves downward step by step to subject the sort bins $\mathbf{12}_{(8)}$ through $\mathbf{12}_{(1)}$ to the stapling operation in order. On the other hand, when ten copy sets are made from an even number of documents, the first sort bin $\mathbf{12}_{(1)}$ is in the hand-out position A at the time of completing the sorting operation. Then, the bin assembly 10 moves one step up to set the first sort bin $\mathbf{12}_{(1)}$ to the stapling level $B_1$, and sheets in the bin $\mathbf{12}_{(1)}$ are stapled. Thereafter, the bin assembly 10 moves upward step by step to subject the sort bins $\mathbf{12}_{(2)}$ through $\mathbf{12}_{(10)}$ to the stapling operation in order.

When a sort bin is set to the stapling level $B_{(1)}$, the chucking motor M3 is turned on. While the shaft 82 is rotating by 90 degrees, the aligning reference plate 71 stays in the home position shown in FIG. 11, and the chucking 90 moves to the rear from the home position. When the rotation of the shaft 82 becomes 90 degrees, the sensor SE7 is turned off. Simultaneously, the solenoid SL2 is turned on to make the clippers 91 and 92 grab sheets in the bin.

Subsequently, while the rotation of the shaft 82 from 90 degrees to 270 degrees, the chucking 90 moves to the front holding the sheets. The aligning reference plate 71 moves to the front in synchronization with the chucking 90. When the rotation of the shaft 82 becomes 270 degrees, the sensor SE7 is turned on. In this moment, on confirmation that the sensor SE9 detects sheets, the stapler 100 is driven to staple the sheets.

After the stapling, the solenoid SL2 is turned off, whereby the stapled set of sheets are relieved from the clippers 91 and 92.

Then, while the shaft 82 continues rotating to 360 degrees, the aligning reference plate 71 returns to the home position pushing the stapled set of sheets back in the regular position R in the bin. Simultaneously, the chucking 90 returns to the home position.

After one cycle of stapling operation described above, the bin assembly 10 moves up or down by one step, so as to subject sheets stored in the next bin to the stapling operation.

When a stapled set of sheets is relieved from the chucking 90, there is a possibility that the stapled set of sheets may be hit and pushed far behind the regular position R. Since the operator stands at the front side of the machine 1, this makes it inconvenient for the operator to take the stapled set of sheets out of the bin 12. Therefore, in the present embodiment, after completion of the stapling operation toward all the sheets stored in the bins 12, the aligning motor M5 is driven to move the aligning rod 41 to the front. Thereby, the stapled sets of sheets are regulated between the aligning rod 41 and the aligning reference plate 71 and again put in the regular position R in the respective bins 12. Thus, the operator can take the stapled sets of sheets out of the bins 12 easily.

Punching Mode

A punching mode is a mode of punching sheets ejected from the machine 1. In most cases, the punching mode is combined with the sorting mode and/or the stapling mode. The sorting operation and the stapling operation are carried out as described above.

The operator sets the punching mode by use of a key on the operation panel. A sheet ejected from the machine 1 is transported into the transporting mechanism 50 of the sorter 4. Then, a specified time after the register sensor SE4 detects the trailing edge of the sheet, for example, when the trailing edge of the sheet reaches a point 10 mm upstream of the nipping portion of the register roller pair 52, the electromagnetic clutch CL1 is turned on, and thereby, the clutch roller pair 53 and the hand-out roller pair 54 are stopped. The register roller pair 52 still continues rotating, and only the trailing portion of the sheet is fed. Accordingly, the sheet curves between the roller pairs 52 and 53, and as soon as the trailing edge of the sheet has passed through the nipping portion of the register roller pair 52, the trailing edge is regulated by the nipping portion. In this moment, the flapper solenoid SL1 is turned on so as to move the punching sticks 63, and the sheet is punched at the trailing portion supported between the guide plate 61 and the guide portion **62*a* of the punch trash can 62. Then, the electromagnetic solenoid SL1 Is turned off so as to restart rotating the roller pairs 53 and 54**, and thereby, the sheet starts to be transported again.

Punching Point and Stapling Point

FIG. **13*a* shows punch holes P made in sheets by the punching mechanism 60 and a staple N hit into the sheets by the stapler 100**. The punch holes P are made in a sheet S such that the centers of the holes P are located at a distance $y_1$ from a reference side $S_2$ of the sheet S. The staple N is hit into the sheet such that the center of the staple N is located at a distance $y_2$ from the reference side $S_2$. The distance $y_1$ is 13 mm, and the distance $y_2$ is 12 mm. Further, the center of the staple N is at a distance x from another reference side $S_3$ of the sheet S, and the distance x is 5 mm. The punch holes P have a diameter of 8 mm, and the staple N has a length of 11 mm.

When sheets are handled in the punching/stapling mode, if the staple N is hit into the sheets inside (left side in FIG. **13*a***) of the punch holes P, there will occur inconveniences after filing of the stapled sheets. For example, it is inconvenient to turn pages while the sheets are filed, and if turning pages by force, there is a fear that the sheets will be torn at the stapling point N. In order to avoid such inconveniences, it is necessary to staple the sheets such that the end of the staple N near the reference side $S_2$ is located between an inside common tangential line $P_1$ of the punch holes P and the reference side $S_2$. Preferably, the staple N itself is located between the common tangential line $P_1$ and the reference side $S_2$.

Figure 13A:
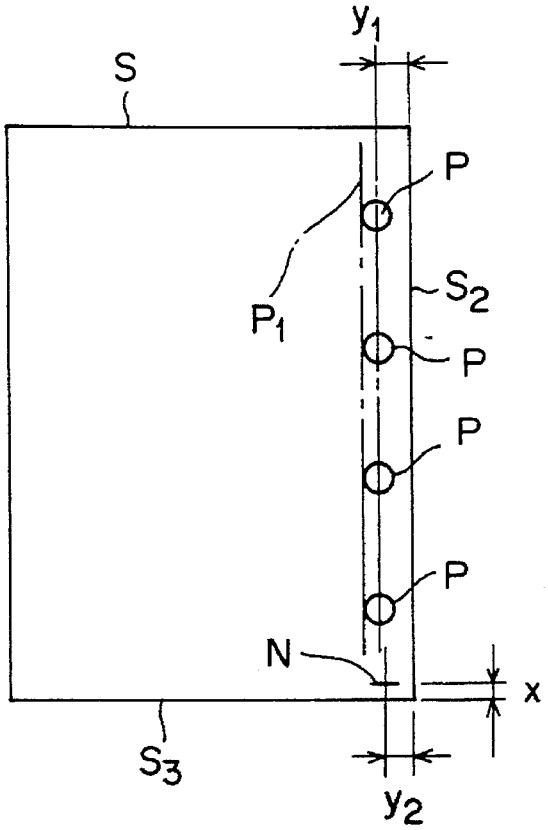
FIGS. 13*a*, 13*b* and 13*c* are plan views showing punching points and a stapling point on a sheet.
Figure 13B:
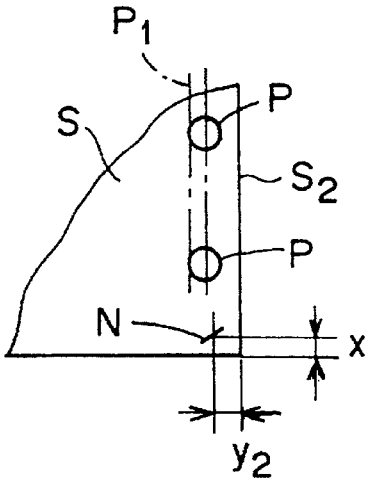
Figure 13C:
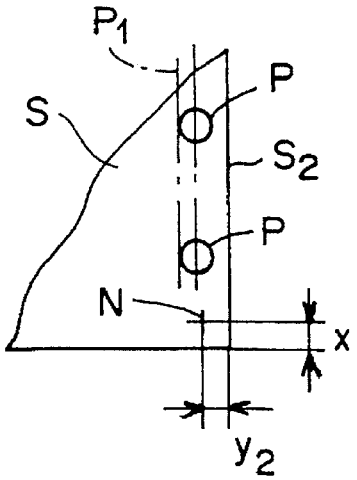

FIGS. 13*b* and 13*c* show modifications of the stapling point N. FIG. 13*b* shows a modification wherein the staple N is hit into the sheets at a slant, and FIG. 13*c* shows modification wherein the staple N is hit into the sheets parallel to the reference side $S_2$.

Control Section

Figure 14:
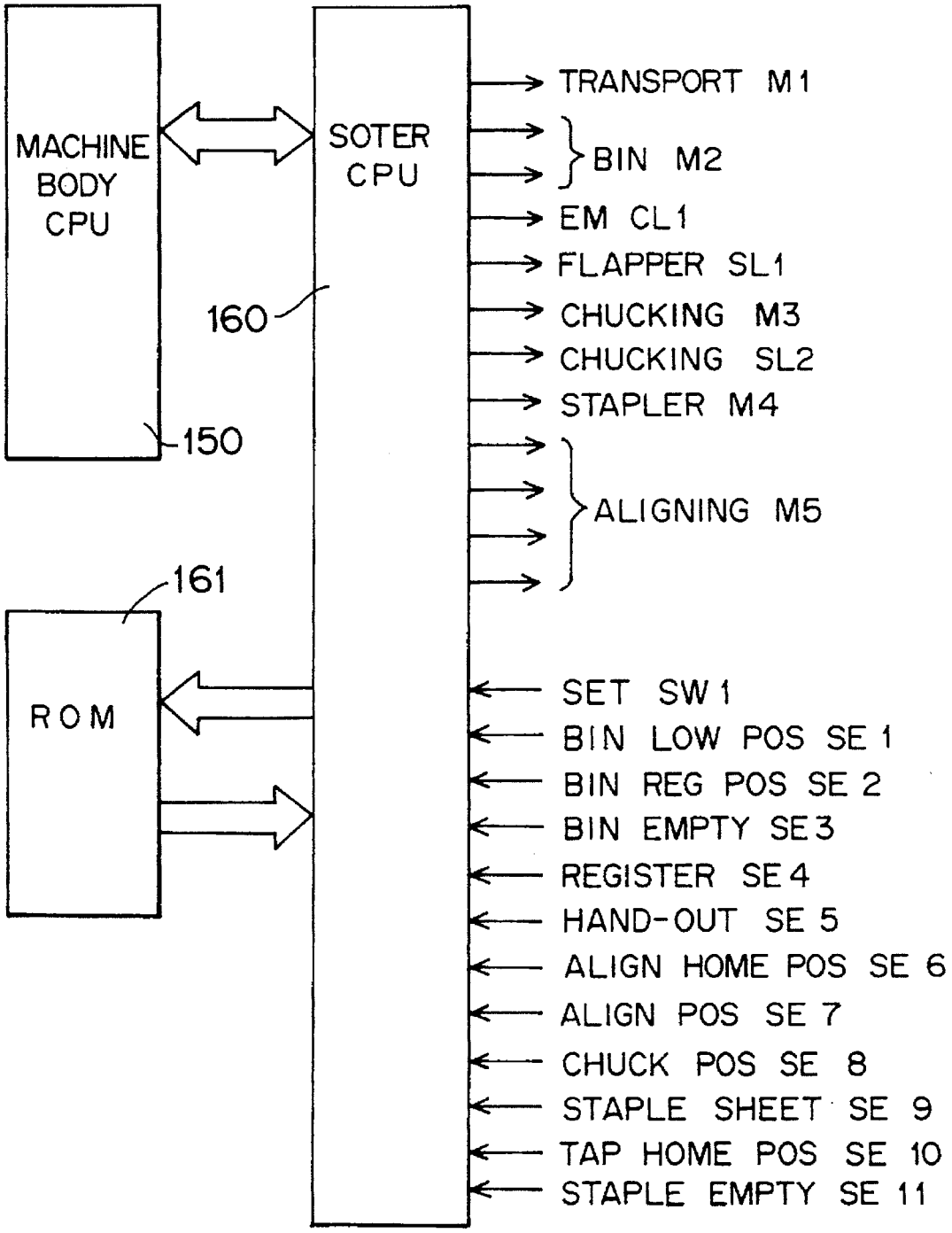
FIG. 14 is a block diagram showing a control circuitry of the sorter.

FIG. 14 shows the control section of the copying system. The main components of the control section are a CPU 150 which controls the machine 1 and a CPU 160 which controls the sorter 4. The CPU 150 is of a conventional type and controls processing for image formation. The CPU 160 has a ROM 161 which is stored with control data. The CPU 160 sends control signals to the motors M1 through M5, the clutch CL1 and the solenoids SL1 and SL2, and receives detection signals from the set switch SW1 and the sensors SE1 through SE11. Control procedures of the CPUs 150 and 160 will be described in detail later.

Input/Output Change of Ports

Figure 15:
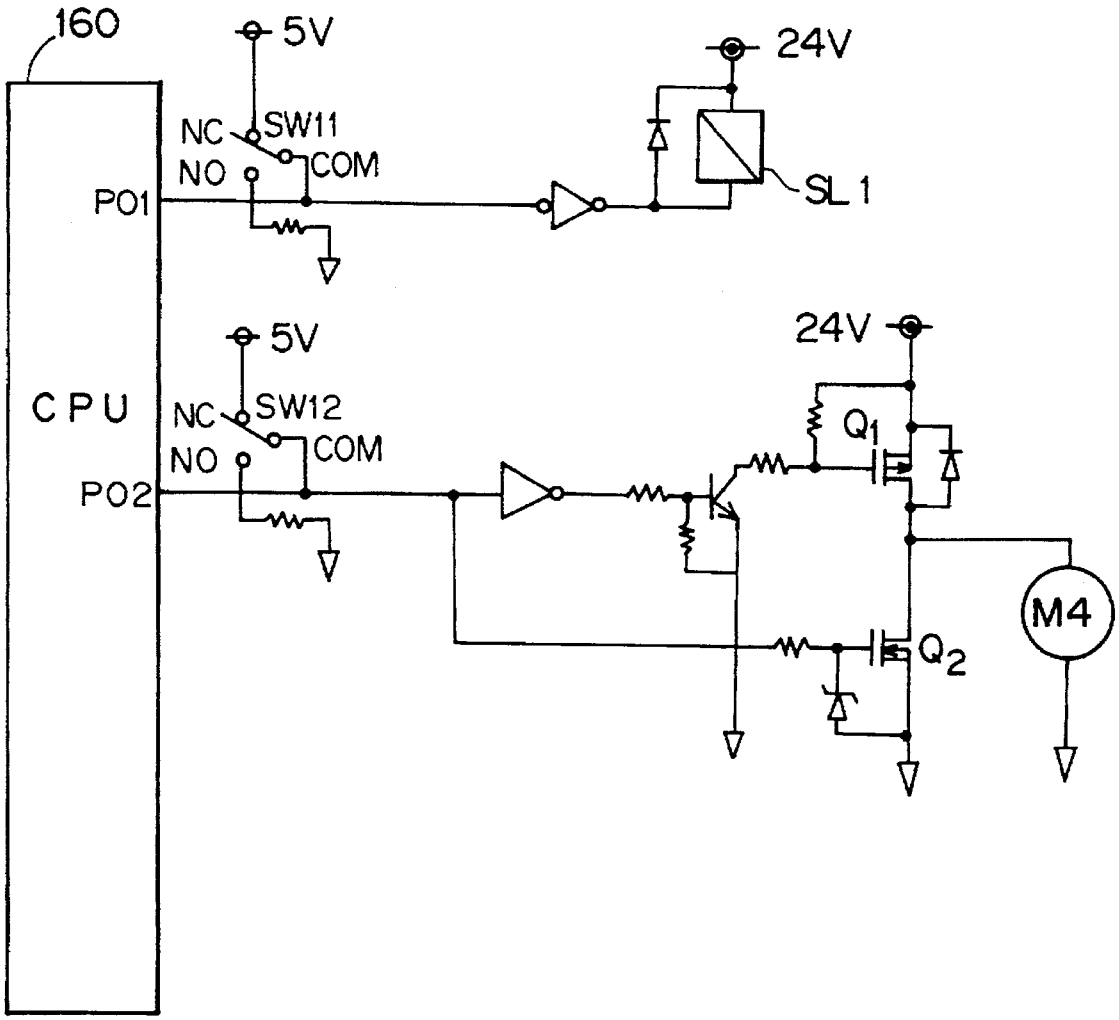
FIG. 15 is a circuit diagram showing the main part of the control circuitry of the sorter.

As shown in FIG. 15, a port PO1 of the CPU 160 is connected to the flapper solenoid SL1 and a selection switch SW11, and a port PO2 thereof is connected to the stapler motor M4 and a selection switch SW12.

The punching function and the stapling function are optional functions of the sorter 4. Therefore, the sorter 4 can be installed as one of the following four types: (1) having both the punching function and the stapling function; (2) having the punching function and not having the stapling function; (3) having the stapling function and not having the punching function; and (4) having neither the punching function nor the stapling function. Conventionally, two selection switches which indicate the selection or non-selection of the respective functions are connected two input ports of the CPU 160, and the functional type of the sorter 4 is recognized from the on/off state of the selection switches. However, in this manner of recognizing the functional type, as the number of optional functions is increasing, the number of input ports must be increased.

In this embodiment, a common contact of the selection switch SW11 is connected to the port PO1, which controls the flapper solenoid SL1, and a common contact of the selection switch SW12 is connected to the port PO2, which controls the stapler motor M4. Closed contact points of the respective common contacts are connected to the power source, and open contact points are connected to the ground. When the sorter 4 takes the punching function, the solenoid SL1 is connected to the port PO1, and the switch SW11 is connected to the closed contact point. When the sorter 4 takes the stapling function, the stapler motor M4 is connected to the port PO2, and the switch SW12 is connected to the closed contact point. On the other hand, when the sorter 4 does not take the punching function and/or the stapling function, the solenoid SL1 and/or the motor M4 are not connected to the ports PO1 and PO2, and the switches SW11 and/or SW12 are connected to the respective open contact points.

When the CPU 160 carries out initialization at a time of turning on the machine 1 and the sorter 4, the ports PO1 and PO2 serve as input ports. In this moment, if the switches SW11 and SW12 are connected to the closed contact points, the ports PO1 and PO2 have a value of "H". If the switches SW11 and SW12 are connected to the open contact points, the ports PO1 and PO2 have a value of "L". From the values of the ports PO1 and PO2, the CPU 160 recognizes what functions the sorter 4 has. After the initialization, the ports PO1 and PO2 serve as output ports to control the solenoid SL1 and the motor M4.

Conventionally, the same number of input ports as the number of optional functions have been necessary to recognize the functional type of the sorter. However, as described above, by using ports for controlling the optional functions as input ports of signals for the recognition, the number of ports can be decreased.

Using a port as an input port and an output port is applicable to the CPU 150 as well as to the CPU 160.

No-load Hitting of the Stapler

Figure 16:
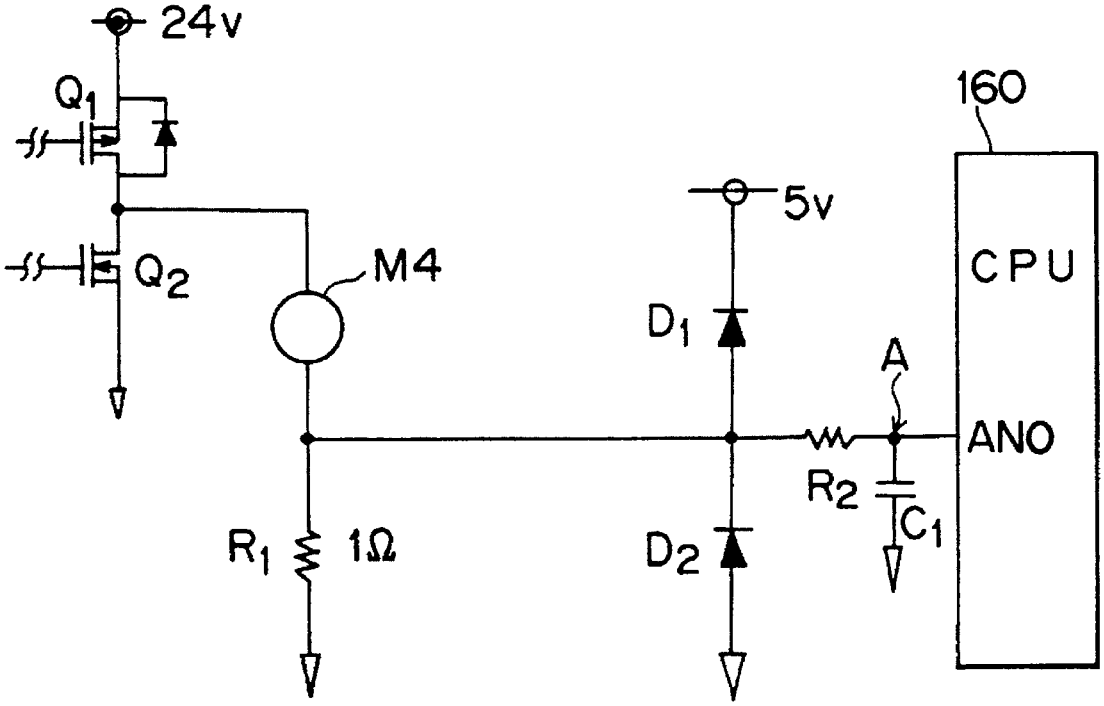
FIG. 16 is a circuit diagram to detect the stapler driving voltage.

FIG. 16 shows a driving circuit of the stapler 100. The motor M4 is connected to a driver $Q_1$ and a brake driver $Q_2$. The drivers $Q_1$and $Q_2$ are in a logical circuit, wherein while one of the drivers $Q_1$ and $Q_2$ is on, the other is off. Diodes $D_1$ and $D_2$, a resistor $R_2$ and a capacitor $C_1$ form an overvoltage prevention circuit of an analog port AN0 of the CPU 160. A resistor $R_1$ is provided to detect the voltage on a point A, and a voltage in proportion to the current flowing in the motor M4 is sent to the analog port AN0.

Figure 17A:
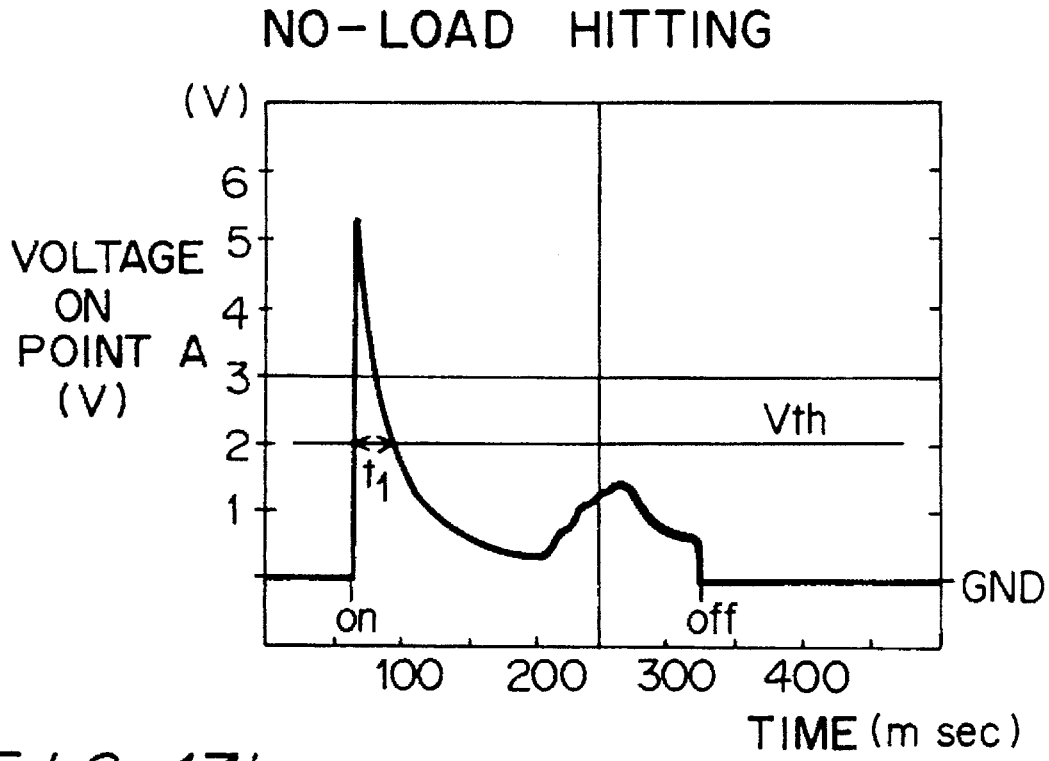
FIGS. 17*a* and 17*b* are graphs showing the characteristics of the stapler driving voltage, FIG. 17*a* being in a case of no-load hitting and FIG. 17*b* being in a case of loaded hitting.
Figure 17B:
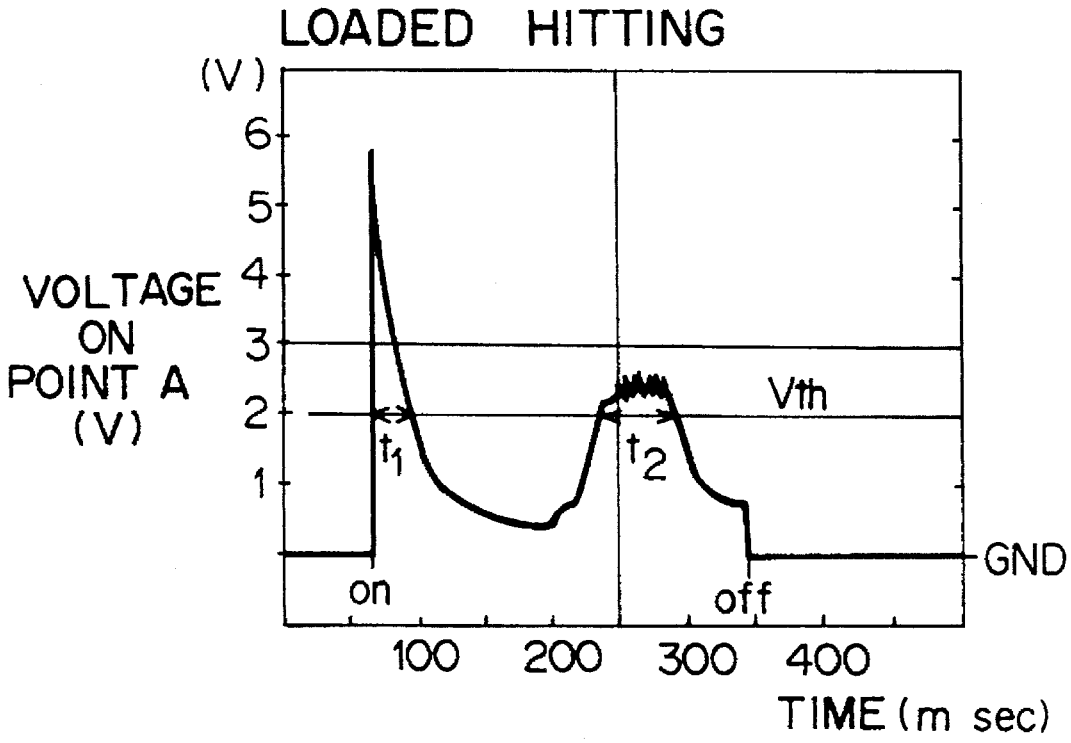

The current flowing in the stapler motor M4 changes in accordance with the load. When the tap acts with no staples (no-load hitting), the voltage changes as shown in FIG. 17*a*. When the tap acts to hit a staple (loaded hitting), the voltage changes as shown in FIG. 17*b*. A threshold voltage $V_{th}$ is set beforehand based on this characteristic, and if the voltage keeps over the threshold value $V_{th}$ for more than a specified period t ($t_1<t<t_2$), the hitting is judged as loaded hitting, and if not, the hitting is judged as no-load hitting. If the hitting is judged no-load hitting, the motor M4 is driven to repeat stapling operation until loaded hitting is detected.

In the electric stapler 100, staples are fed to the tap one by one in synchronization with the action of the tap. The non-load hitting occurs mostly immediately after a change of staple cartridges. The non-loaded hitting needs to be repeated several times (from experience, at most four times) until a staple is fed to the tap from a new cartridge. Therefore, the judgment of non-load hitting or loaded hitting should be carried out only at the time of changing staple cartridges.

It is also possible to drive the stapler 100 continuously four times only immediately after a change of cartridges without detecting the voltage of the motor M4. Such an arrangement prevents failures in stapling sheets.

Control Procedure

Figure 18:
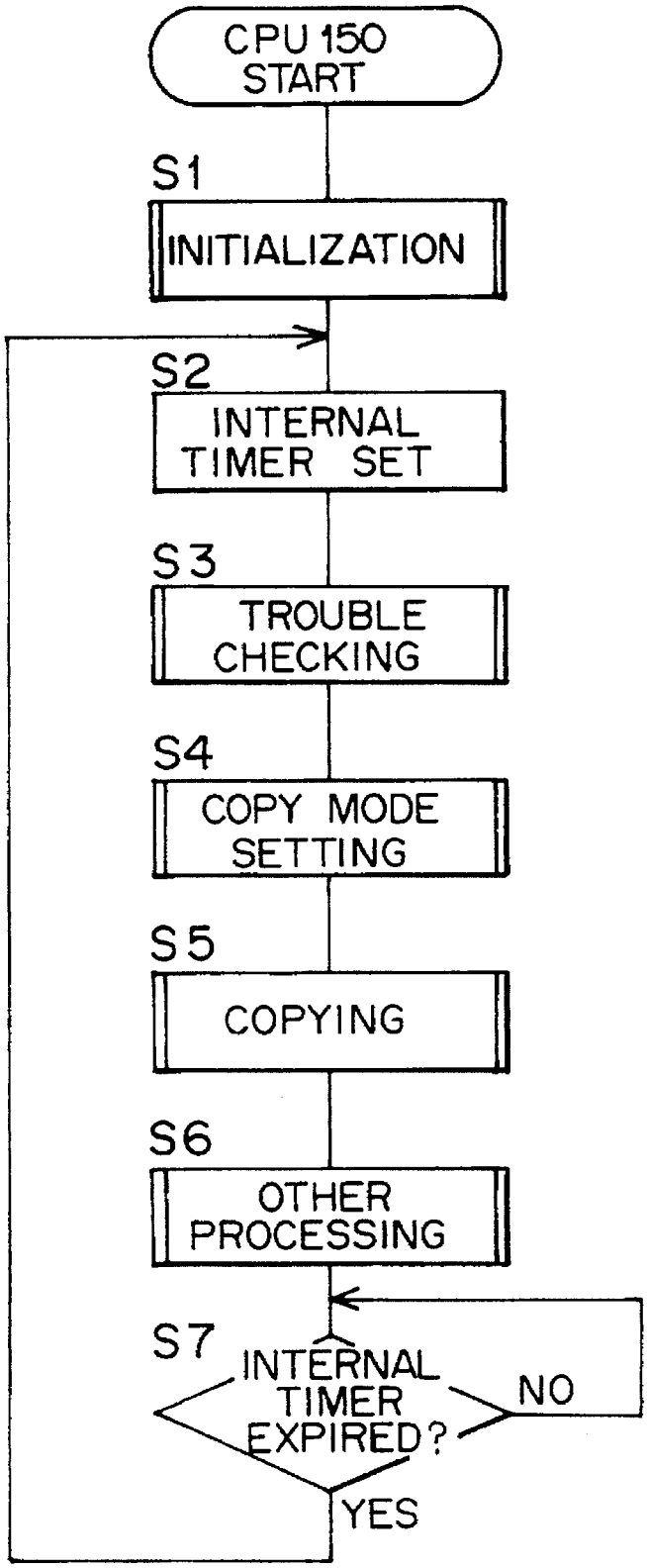
FIG. 18 is a flowchart showing a main routine of a CPU which controls the copying machine.

FIG. 18 shows a main routine of the CPU 150 which controls the copying machine 1.

When the CPU 150 is reset and starts a program, first, initialization, such as clearance of an internal RAM, clearance of registers and initial setting of devices, is carried out at step S1. Next, an internal timer is set at step 2. The internal timer determines a time for one cycle of the main routine, and the value is determined beforehand at step S1.

Subsequently, a subroutine for trouble checking, a subroutine for copying mode setting, a subroutine for copying operation and a subroutine for other processing (temperature control of the fixing device, communication with the CPU 160, designation of the next bin in operation of the sorting mode, etc.) are called in order at steps S3, S4, S5 and S6. The subroutine for trouble checking which is called at step S3 will be described in detail later. However, the other subroutines are well known, and the description thereof is omitted.

On confirmation of the expiration of the internal timer at step S7, the processing returns to step S2. Based on the time for one cycle of main routine, various timers are set in the respective subroutines.

Figure 19:
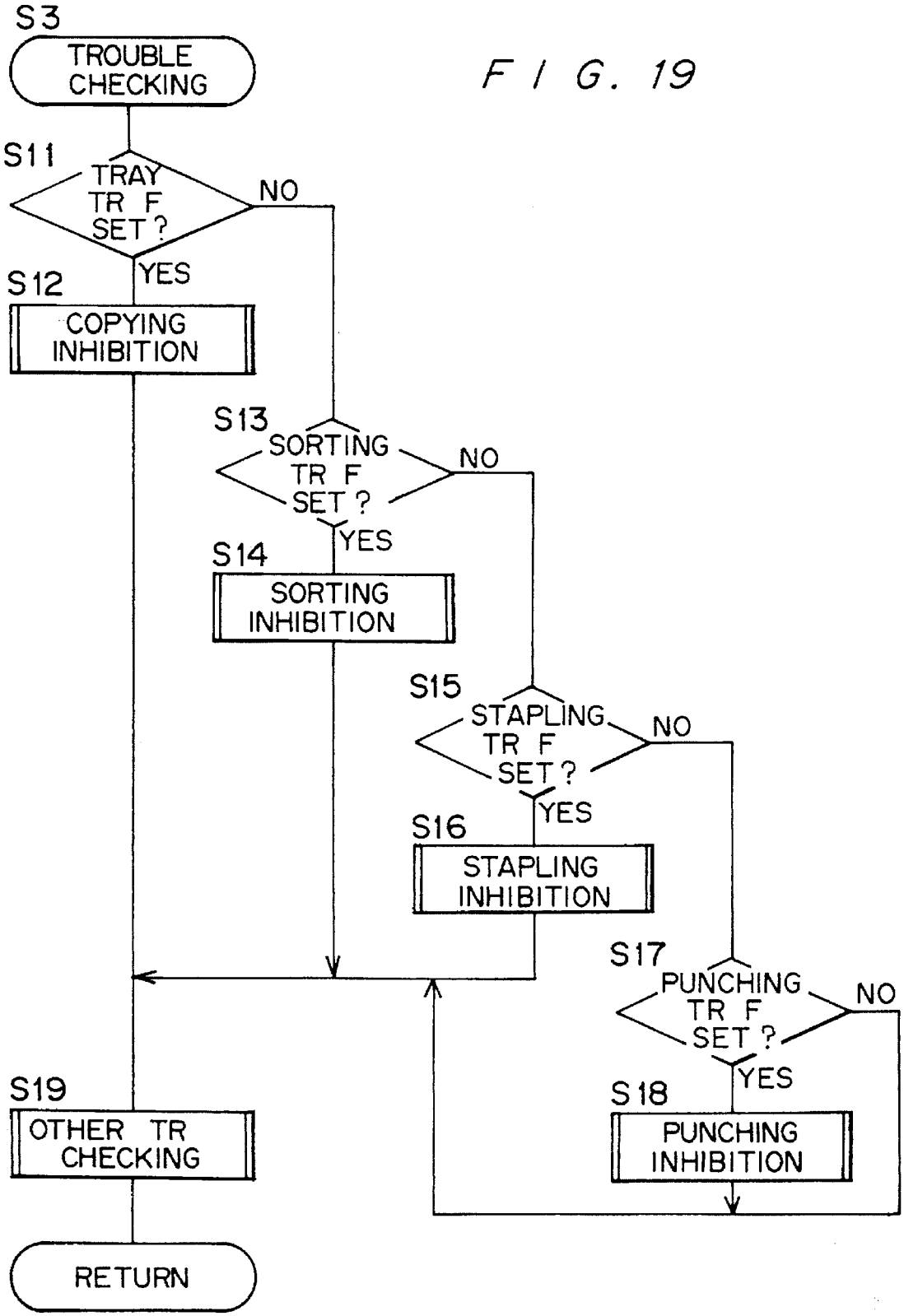
FIG. 19 a flowchart showing a subroutine for trouble checking.

FIG. 19 shows the subroutine for trouble checking which is carried out at step S3.

First, it is checked at step S11 whether a tray trouble flag (see steps S50 and S78) is set. If the tray trouble flag is set, copying inhibition is prosecuted at step S12, thereby inhibiting copying operation of the machine 1. Next, it is checked at step S13 whether a sorting trouble flag (see step S49) is set. If the sorting trouble flag is set, sorting inhibition is prosecuted at step S14, thereby inhibiting sorting operation and stapling operation, whereas allowing non-sorting operation and punching operation.

It is checked at step S15 whether a stapling trouble flag (see steps S128 and S135) is set. If the stapling trouble flag is set, stapling inhibition is prosecuted at step S16, thereby inhibiting stapling operation, whereas allowing non-sorting operation, sorting operation and punching operation. Next, it is checked at step S17 whether a punching trouble flag (see step S198) is set. If the punching trouble flag is set, punching inhibition is prosecuted at step S18, thereby inhibiting punching operation, whereas allowing the other operations.

At step S19, other troubles are checked. For example, sheet jamming in the machine 1 and in the sorter 4 is checked.

Figure 20:
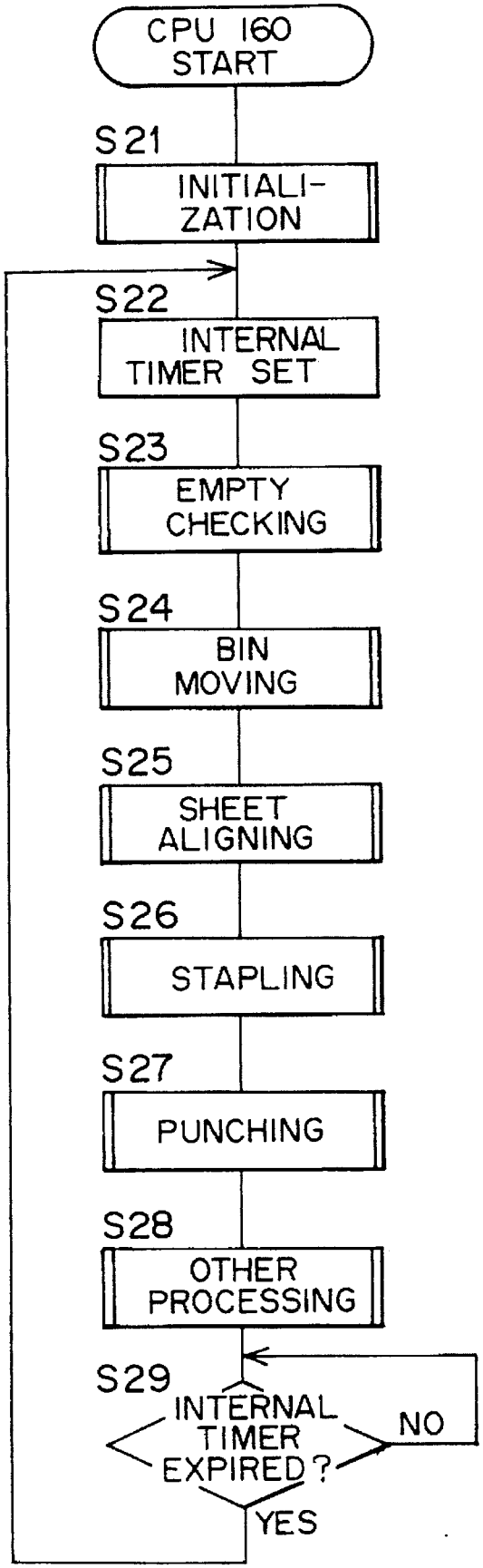
FIG. 20 is a flowchart showing a main routine of a CPU which controls the sorter.

FIG. 20 shows a main routine of the CPU 160 which controls the sorter 4.

When the CPU 160 is reset and starts a program, first, initialization, such as clearance of an internal RAM, clearance of registers and initial setting of devices, is carried out at step S21. Next, an internal timer is set at step S22. The Internal timer determines a time for one cycle of the main routine, and the value is determined beforehand at step S21.

Subsequently, subroutines, which will be described in detail later, are called in order at steps S23 through S28. On confirmation of the expiration of the internal timer at step S29, the processing returns to step S22. Based on the time for one cycle of the main routine, various timers (the respective values are stored in the ROM 161) are set in the respective subroutines.

Figure 21:
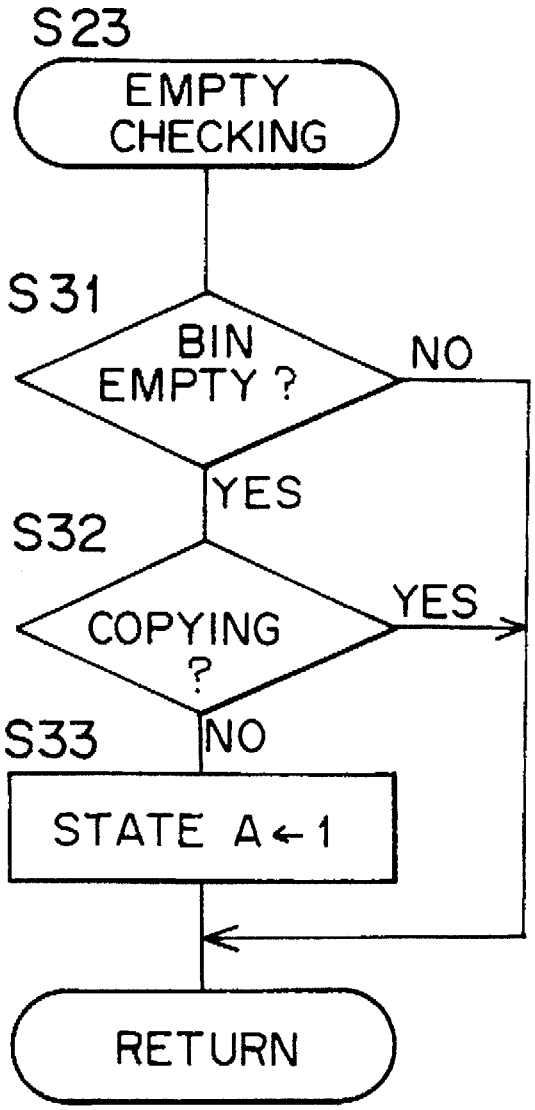
FIG. 21 is a flowchart showing a subroutine for bin emptiness checking.
Figure 22:
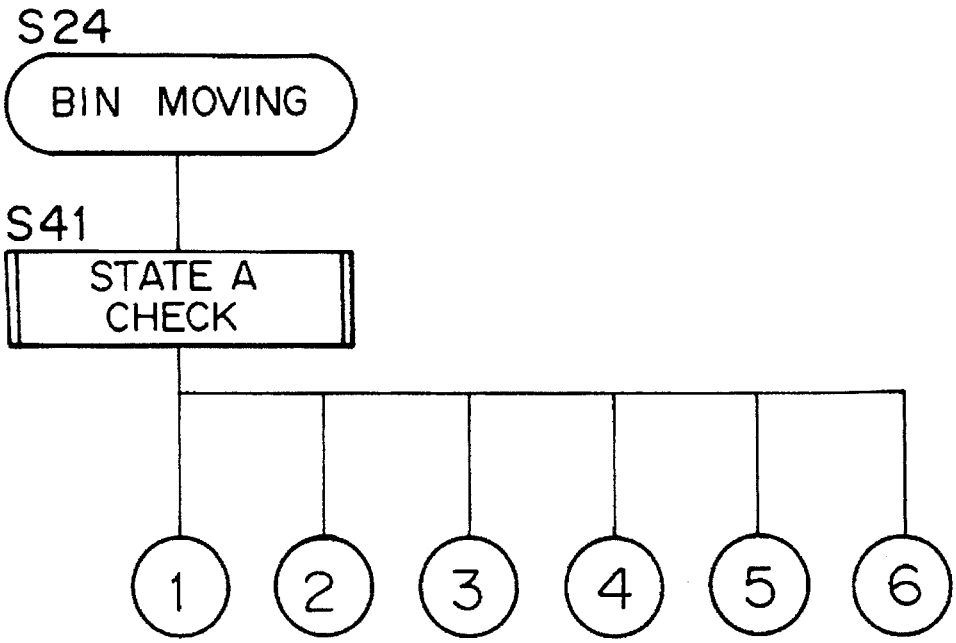
FIGS. 22, 23, 24, 25, 26, 27 and 28 are flowcharts showing a subroutine for bin moving.
Figure 23:
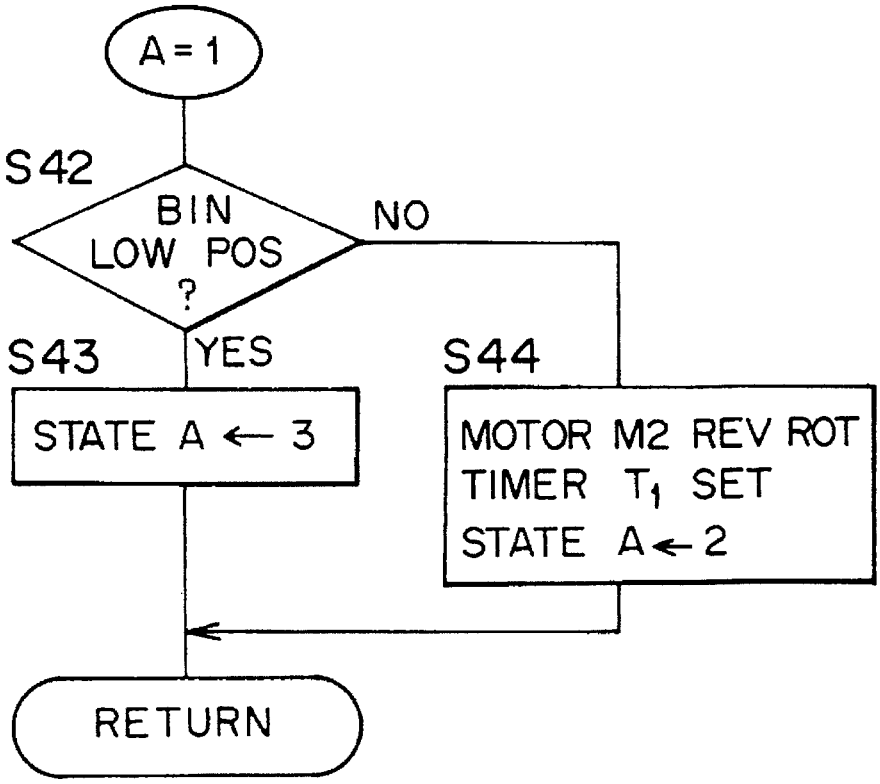
Figure 24:
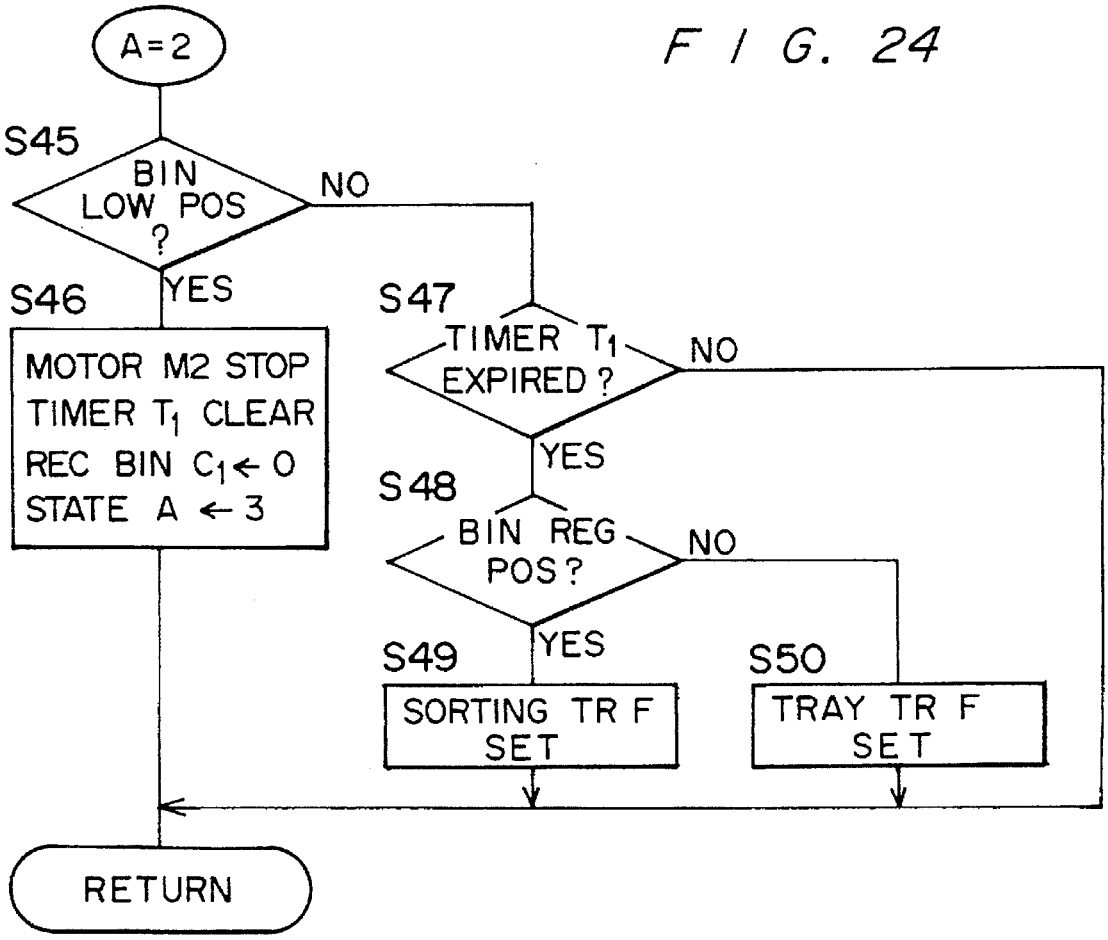
Figure 25:
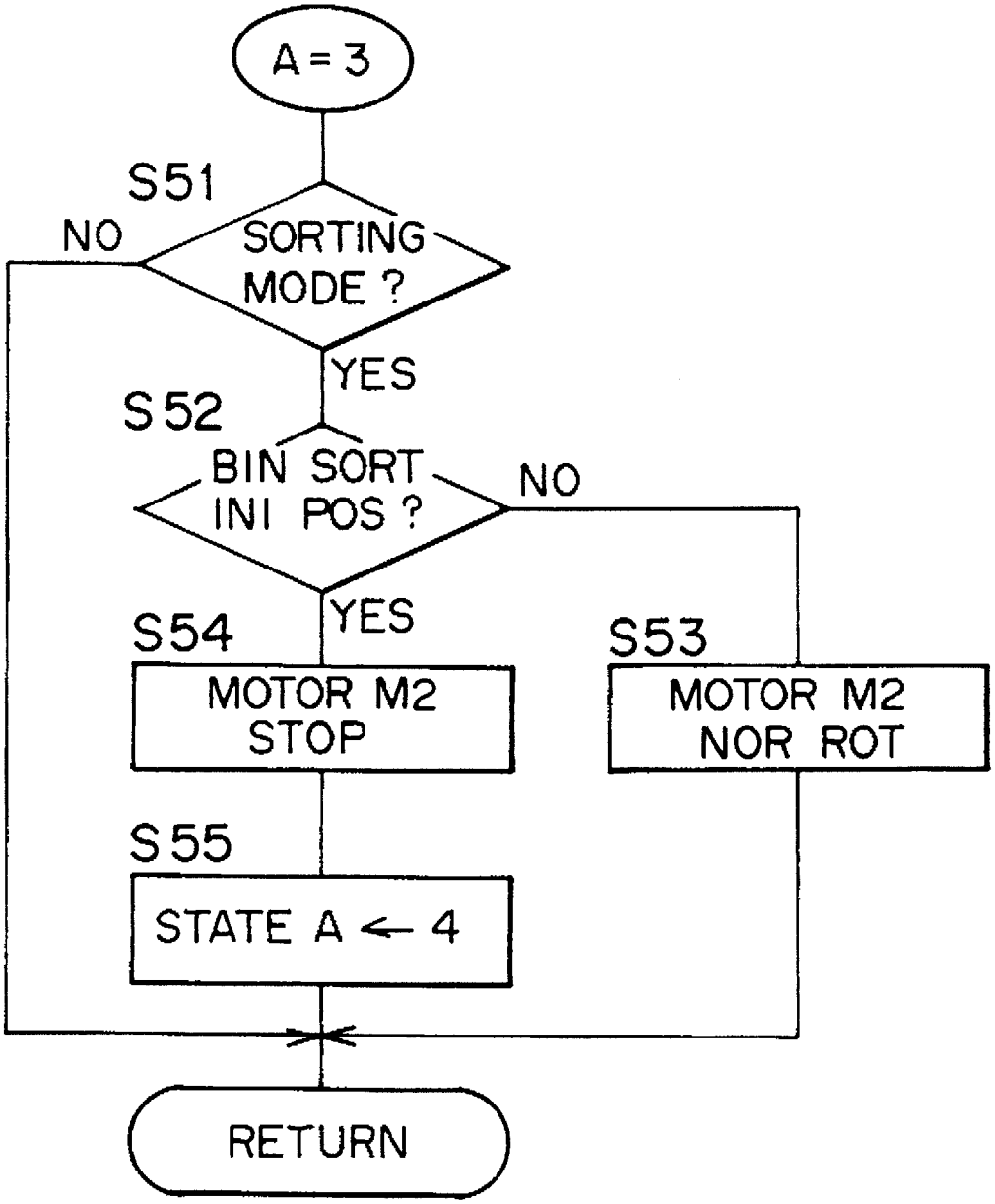
Figure 26:
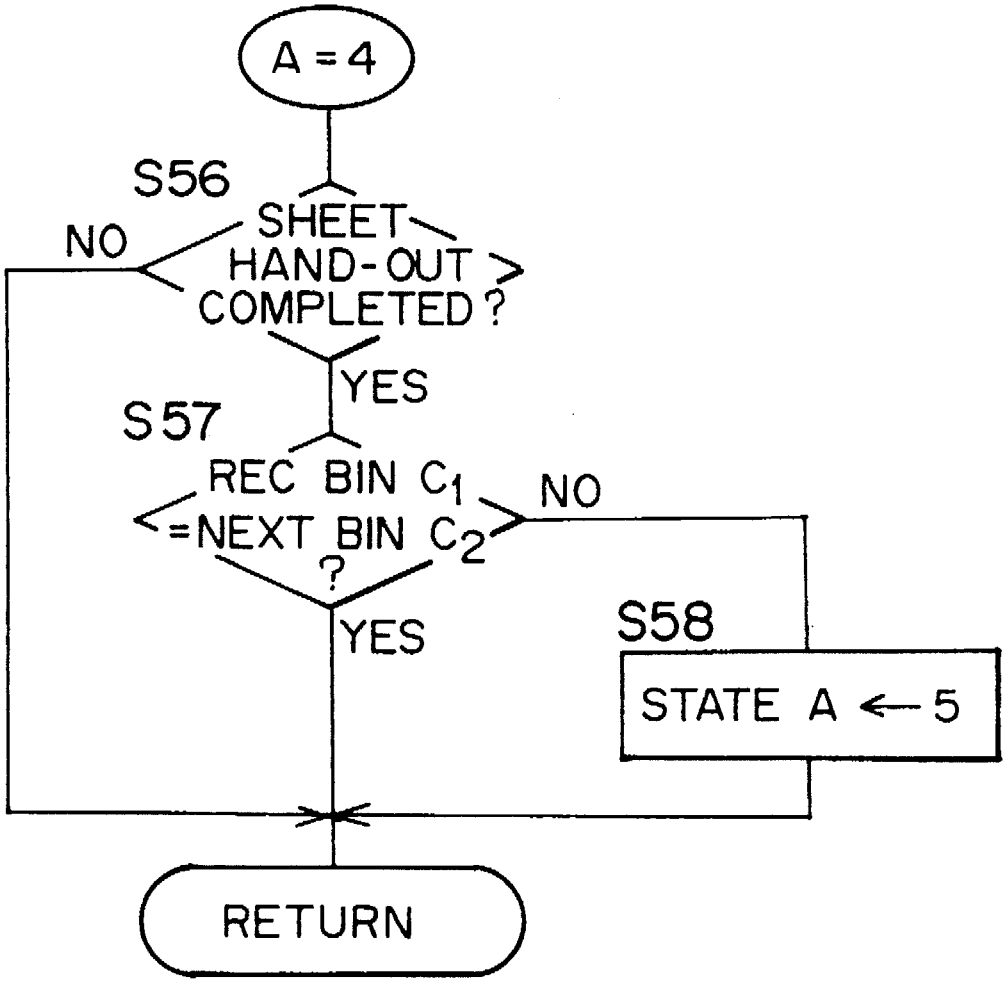
Figure 27:
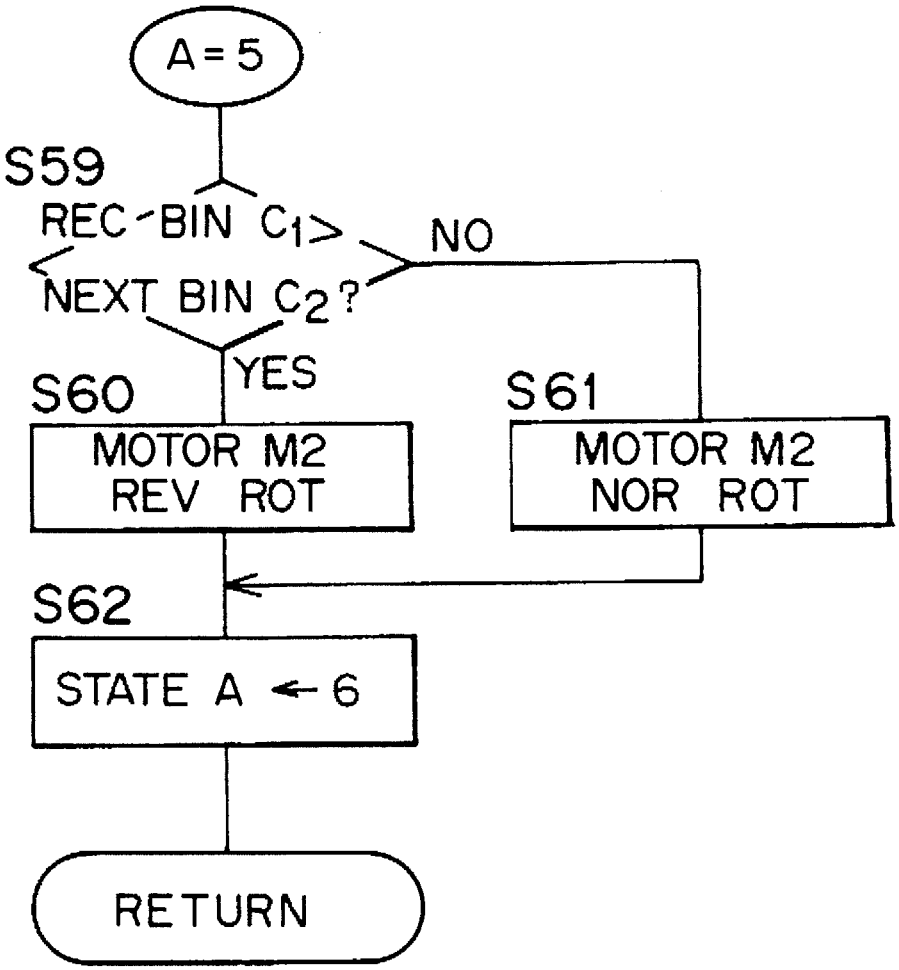
Figure 28:
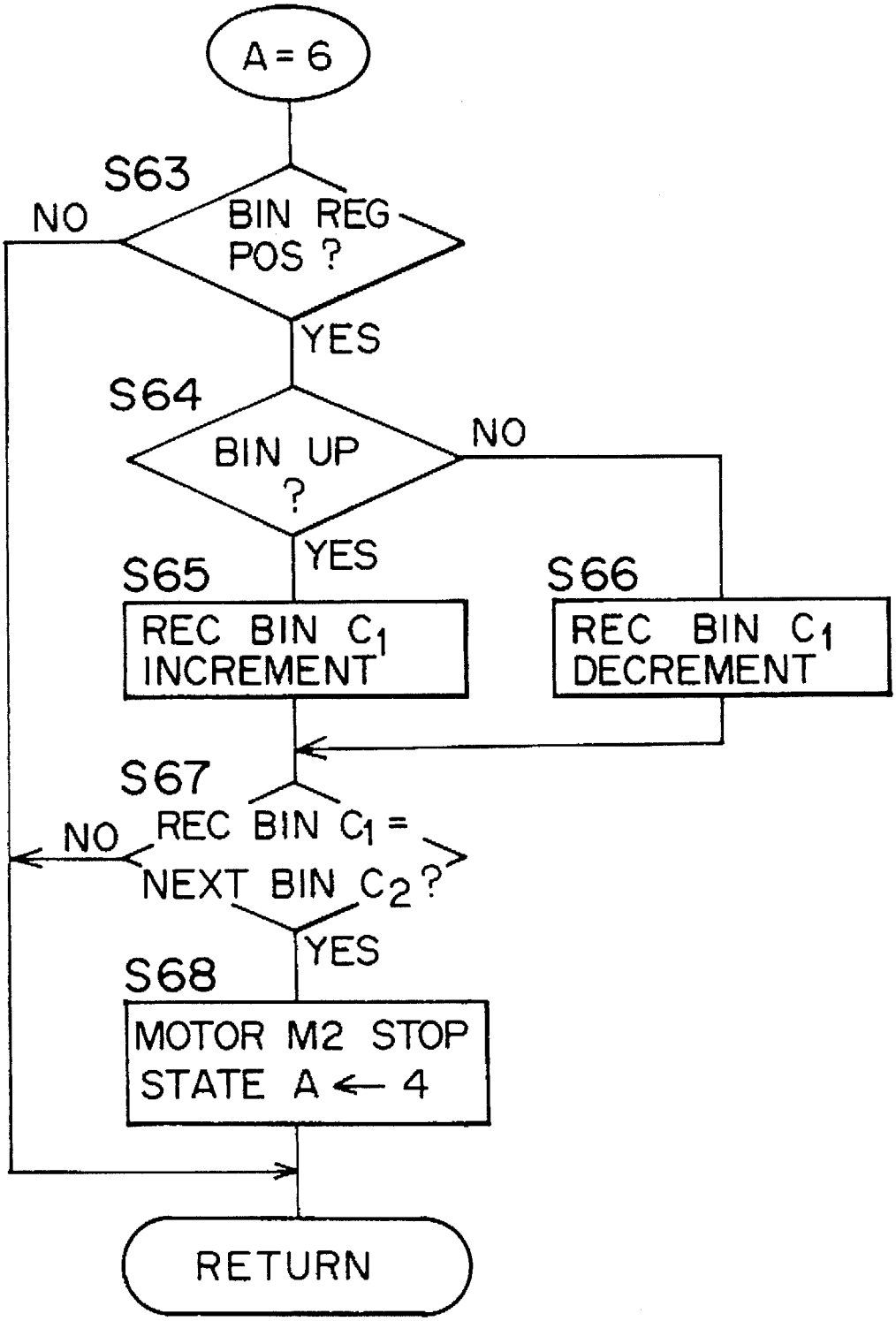
Figure 29:
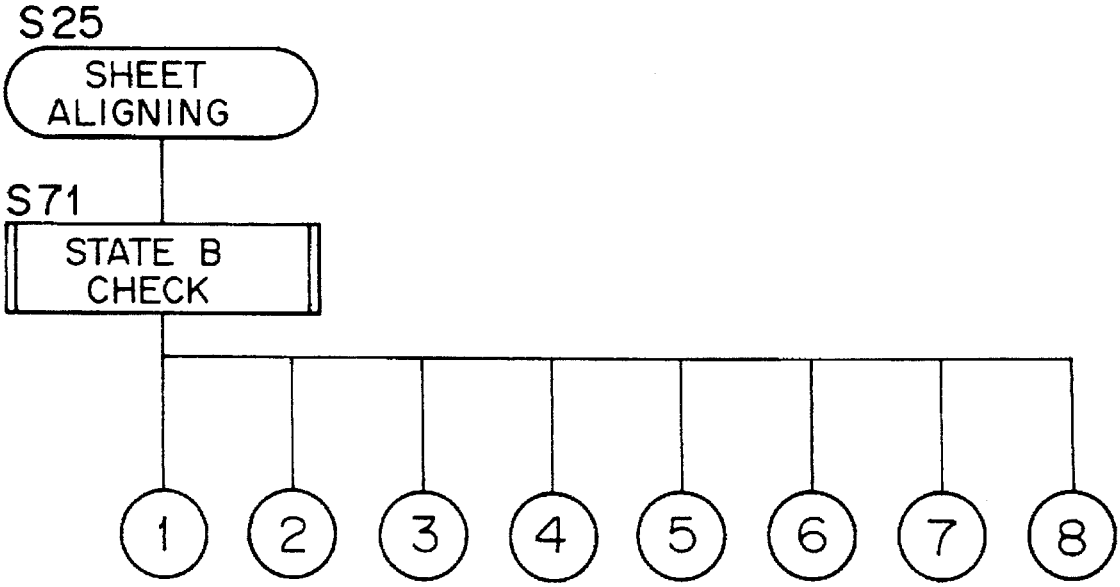
FIGS. 29, 30, 31, 32, 33, 34, 35, 36 and 37 are flowcharts showing a subroutine for sheet aligning.
Figure 30:
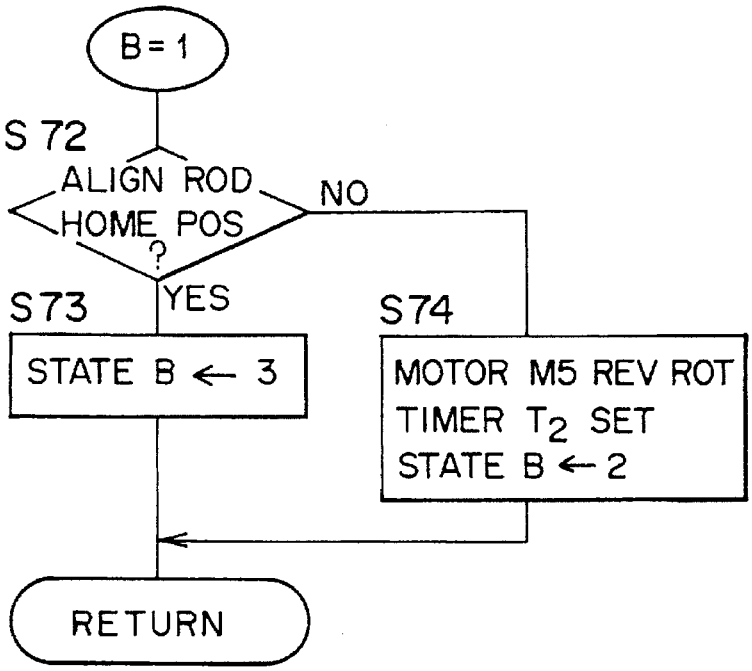
Figure 31:
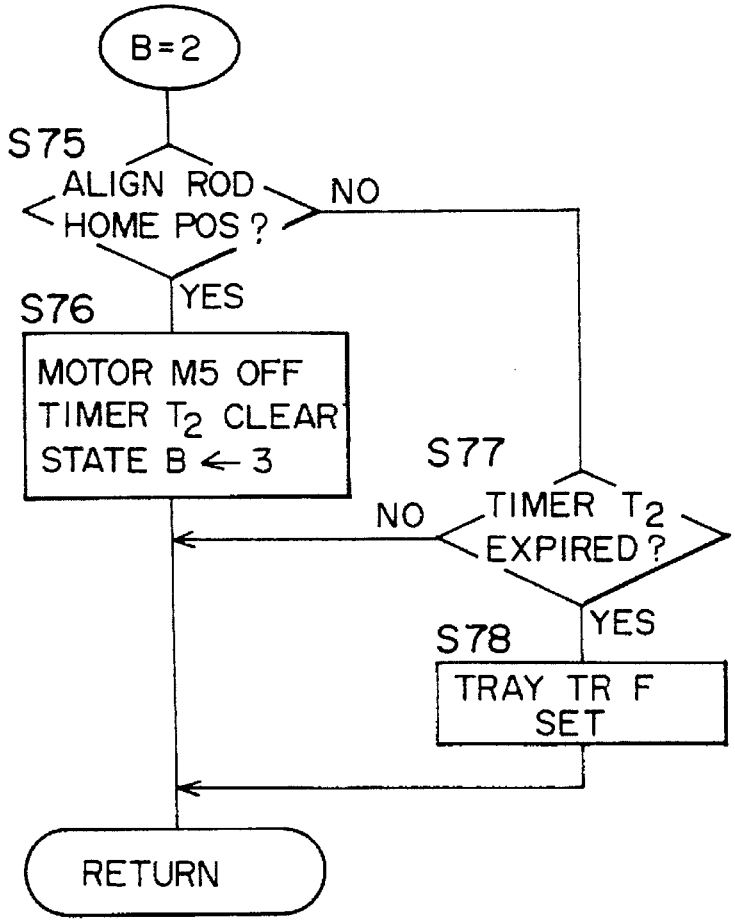
Figure 32:
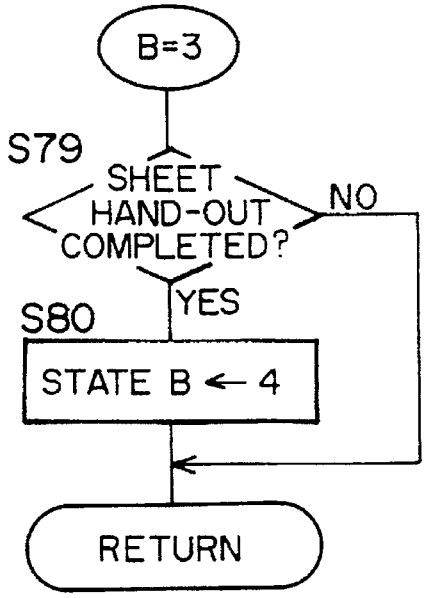
Figure 33:
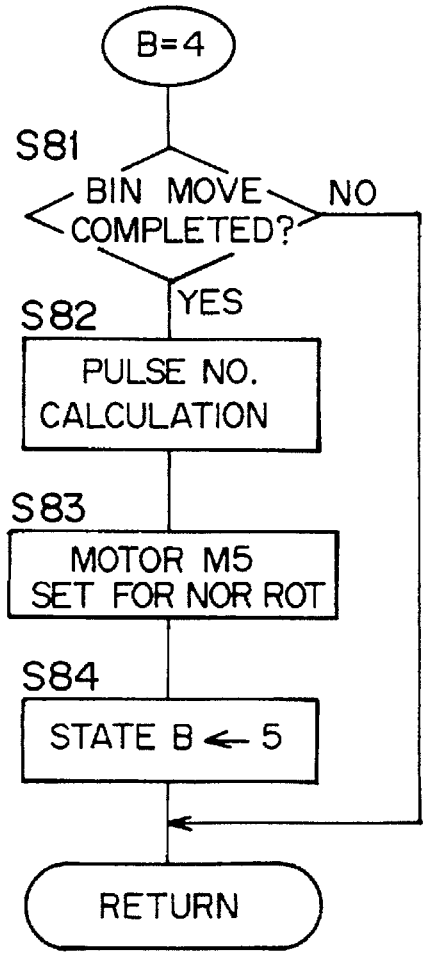
Figure 34:
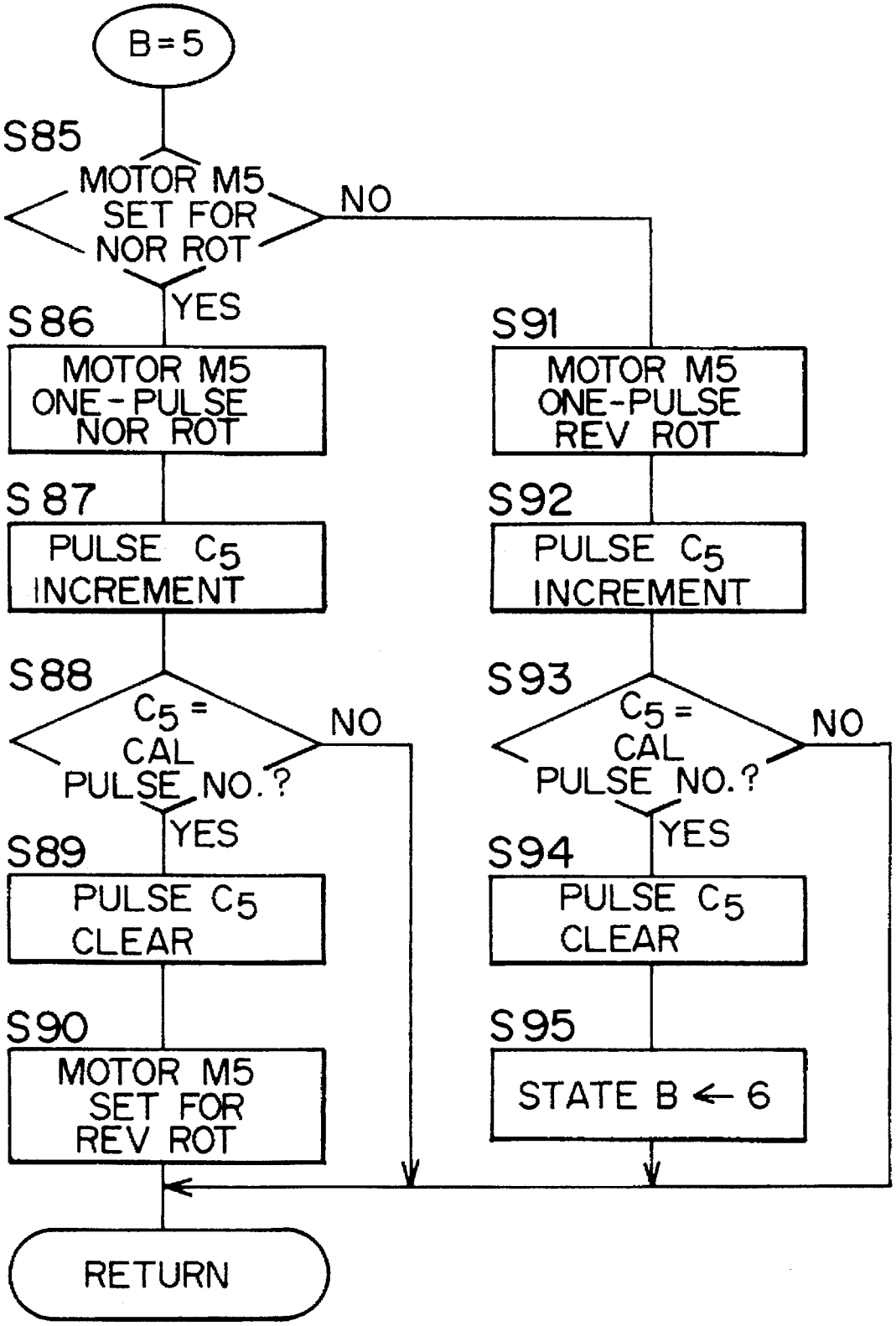
Figure 35:
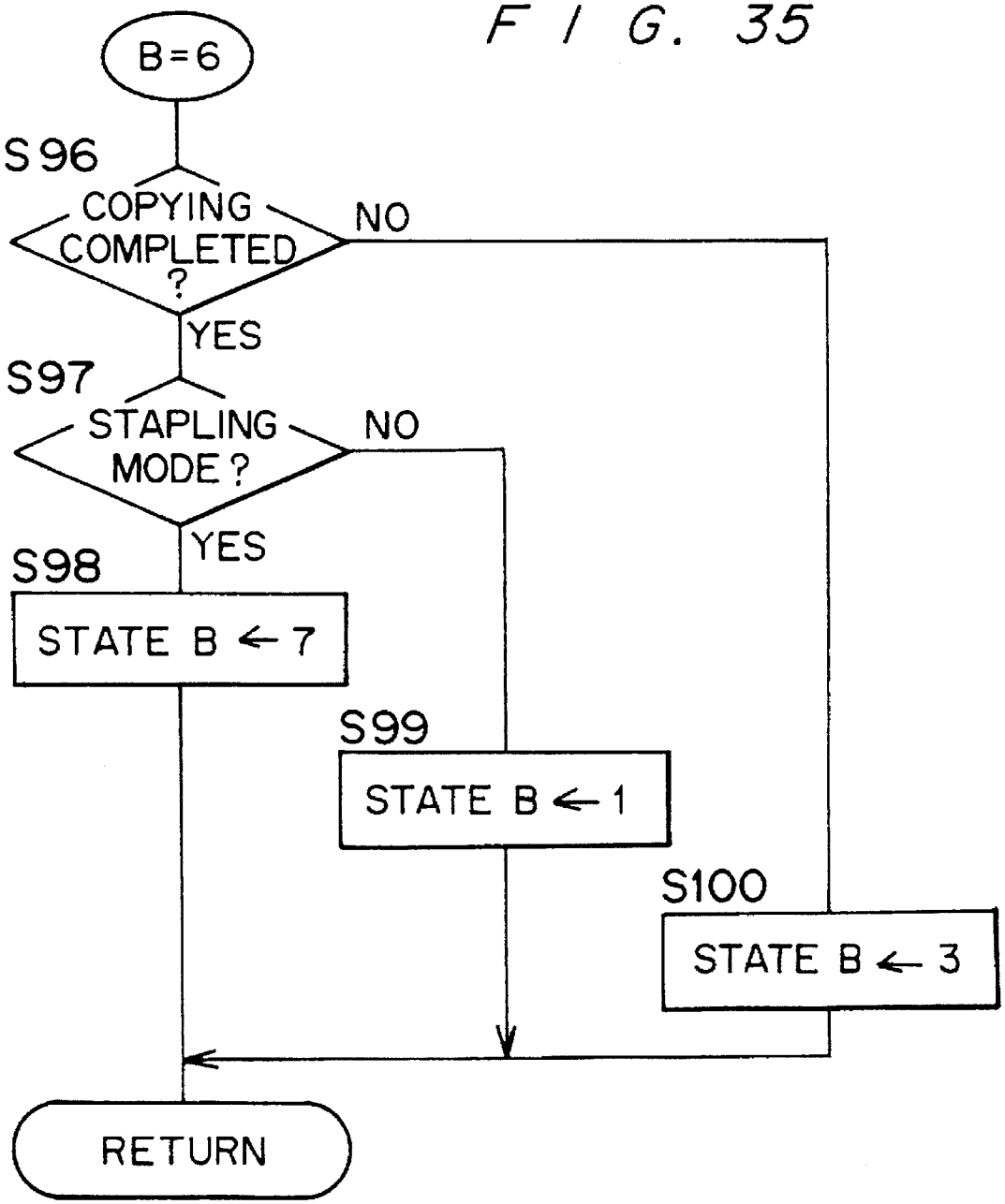
Figure 36:
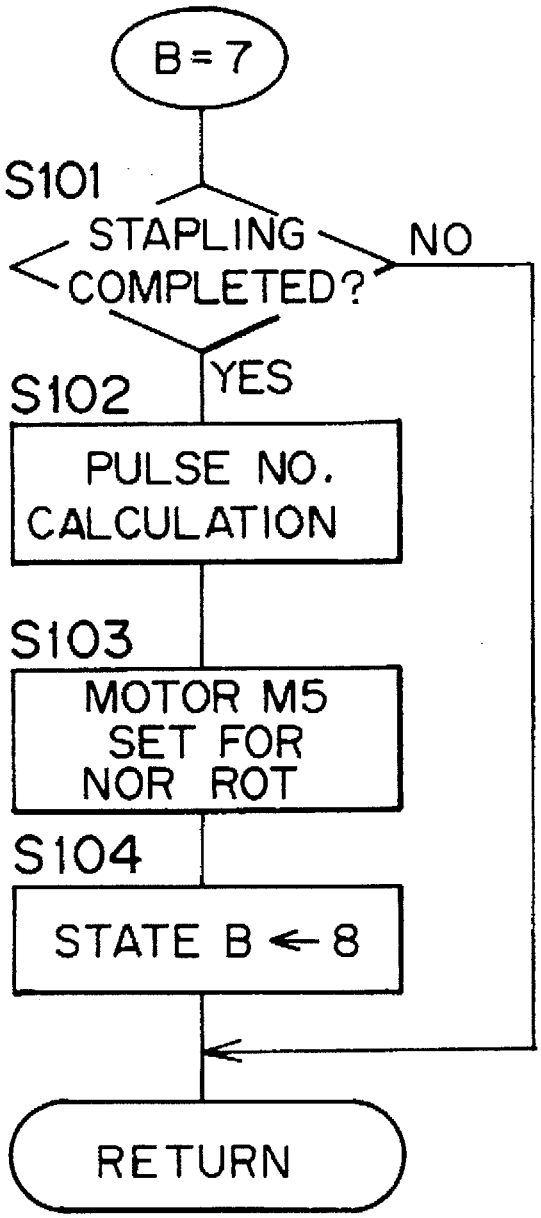
Figure 37:
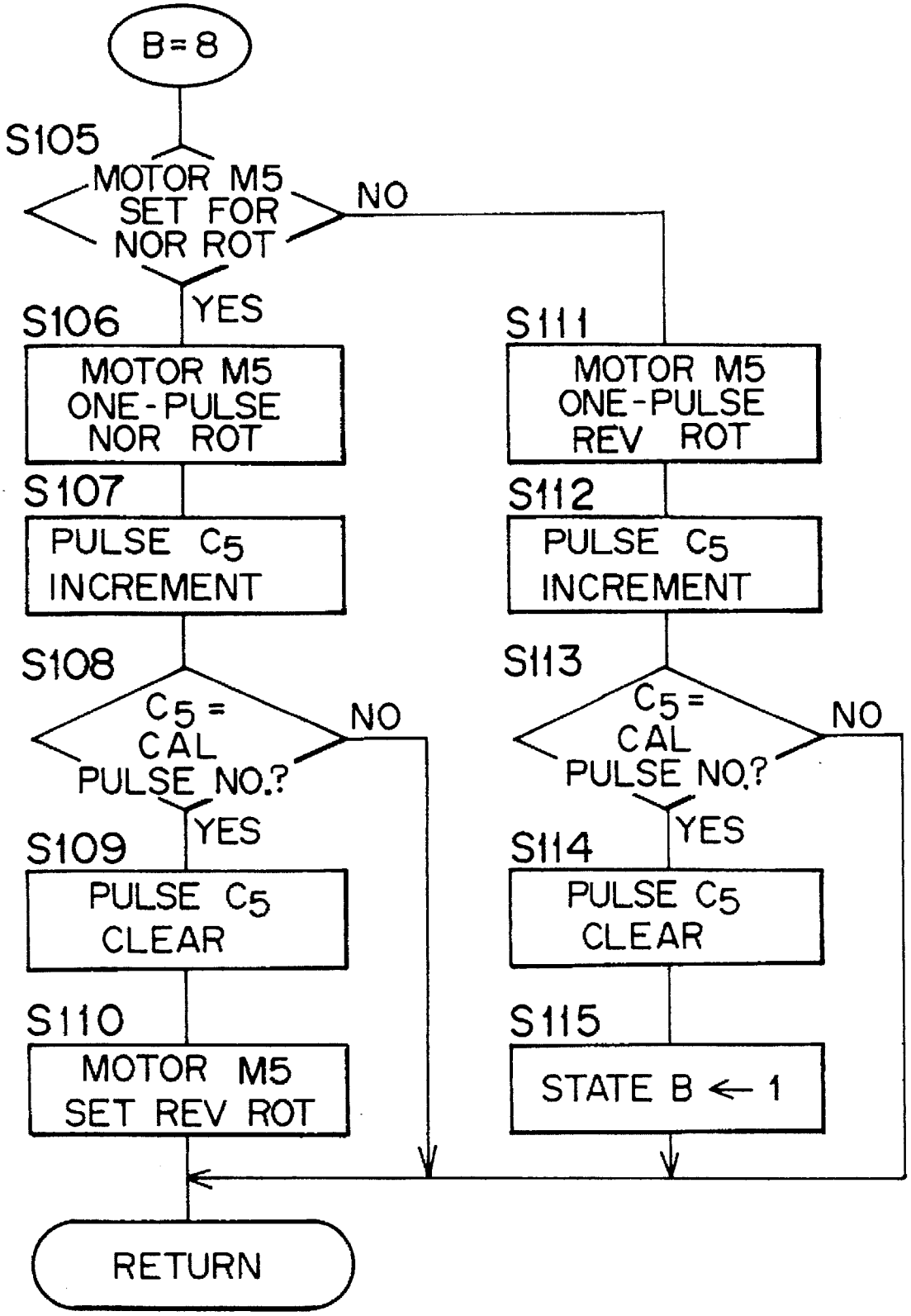
Figure 38:
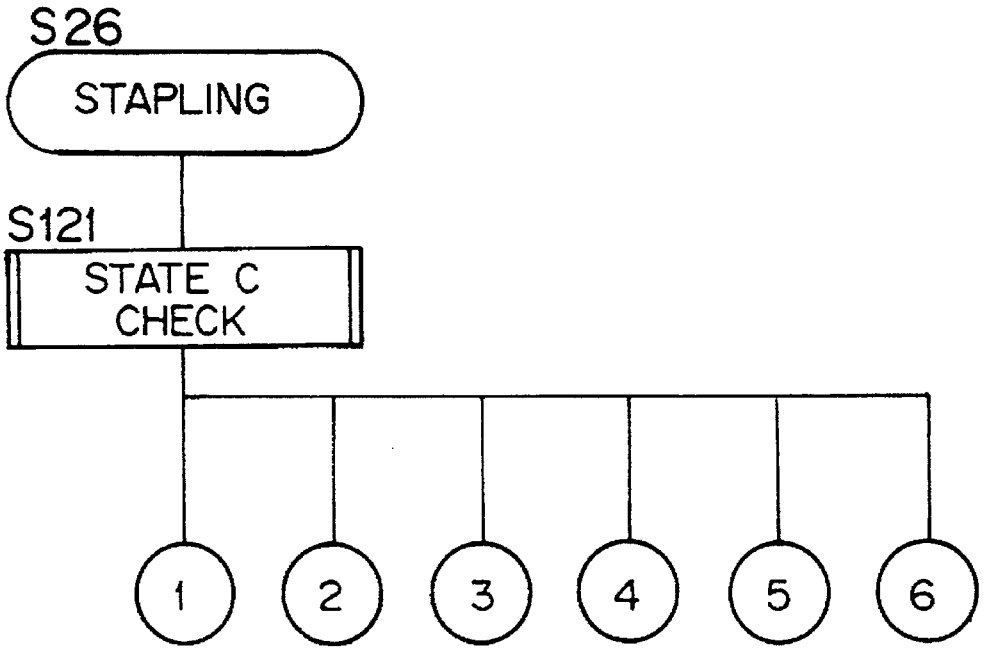
FIGS. 38, 39, 40, 41, 42, 43 and 44 are flowcharts showing a subroutine for stapling.
Figure 39:
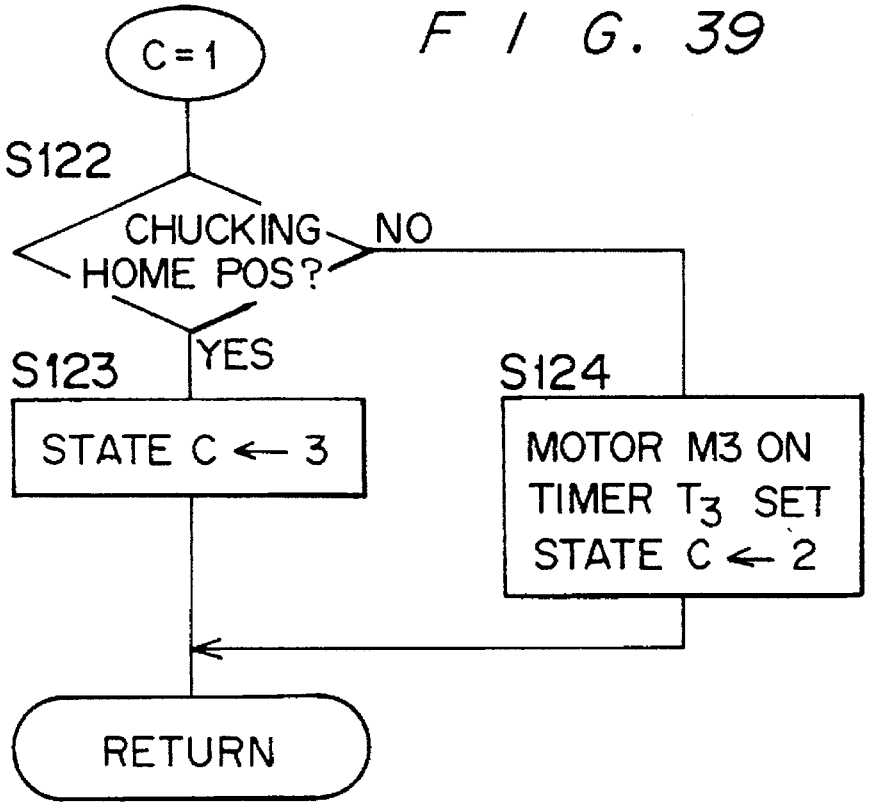
Figure 40:
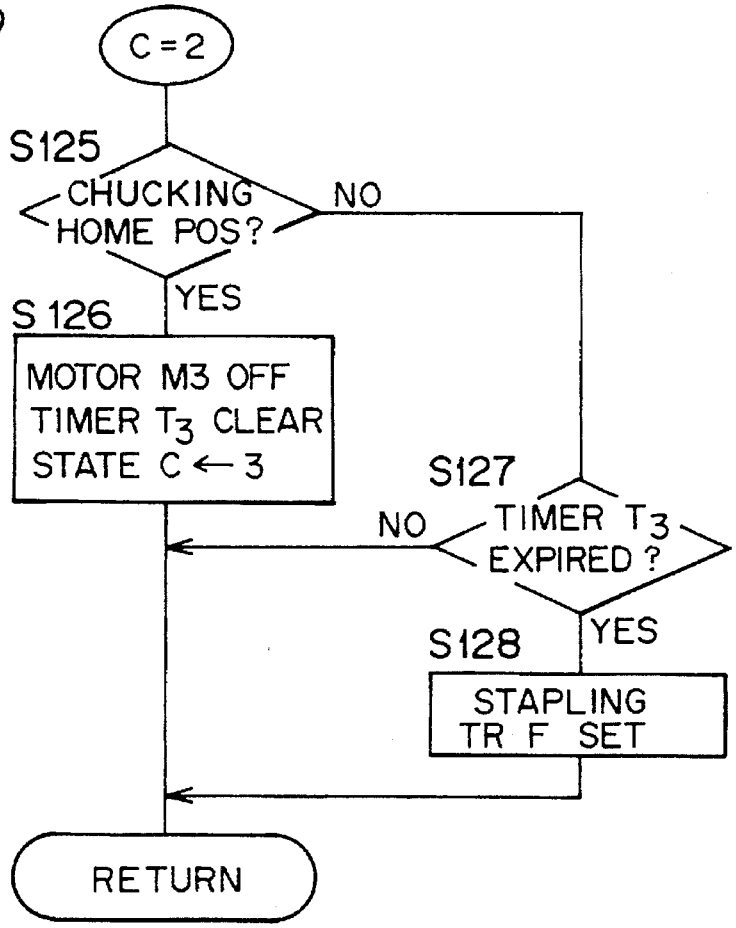
Figure 41:
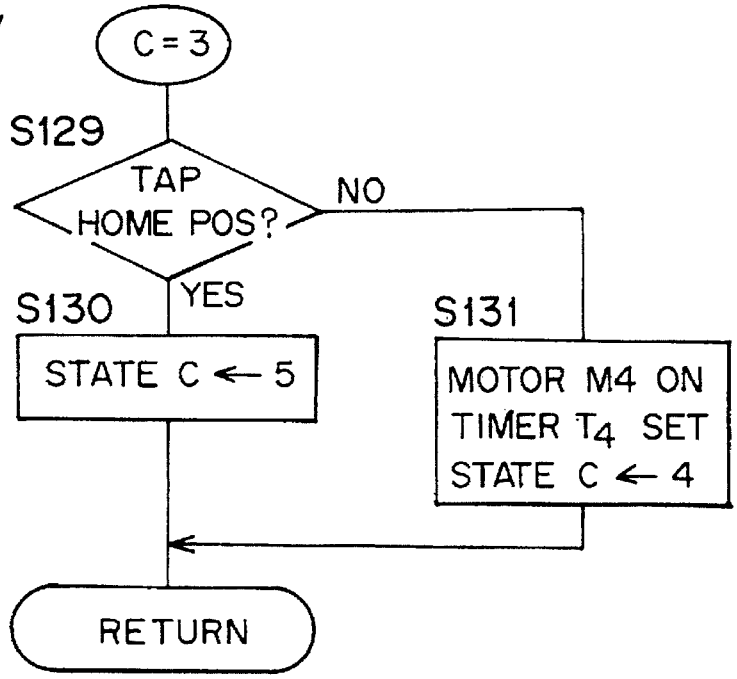
Figure 42:
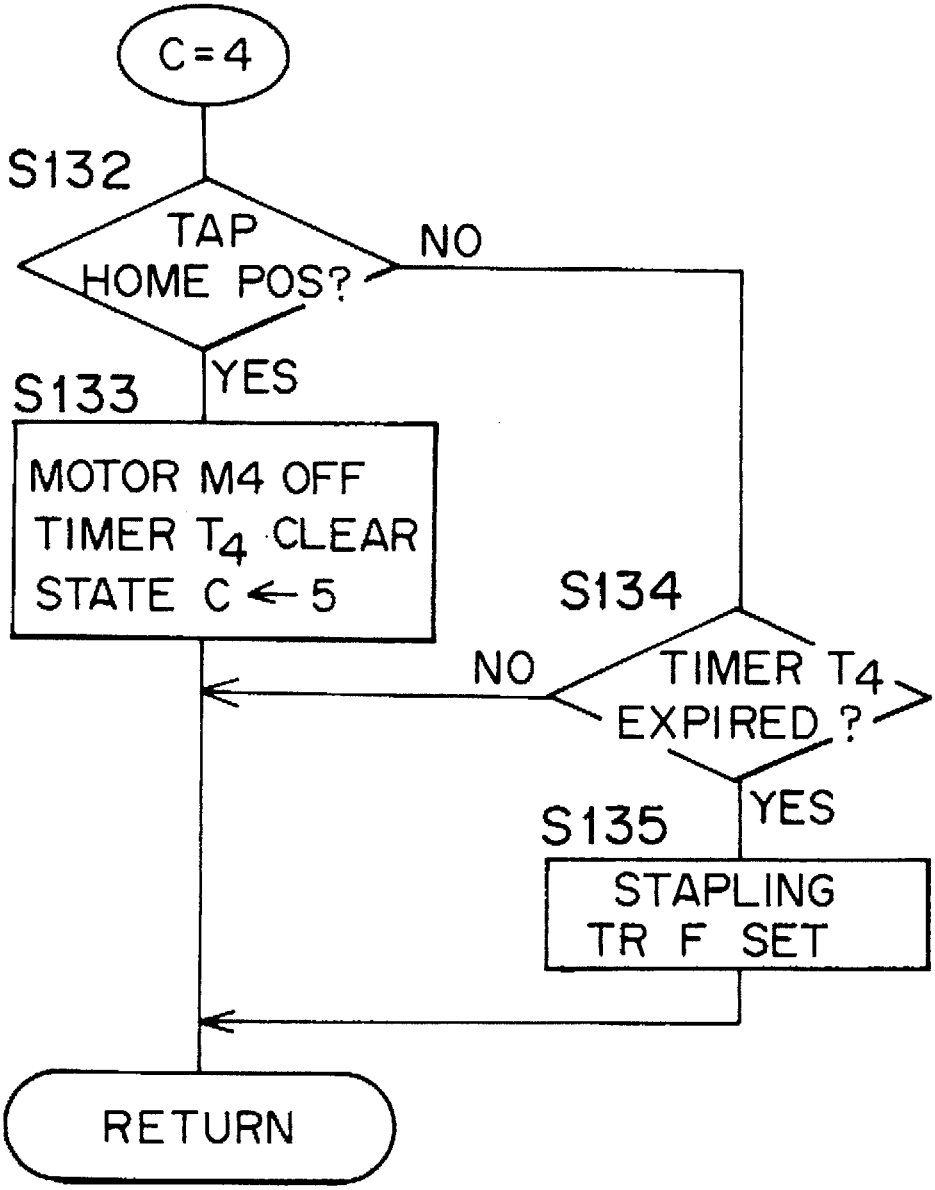
Figure 43:
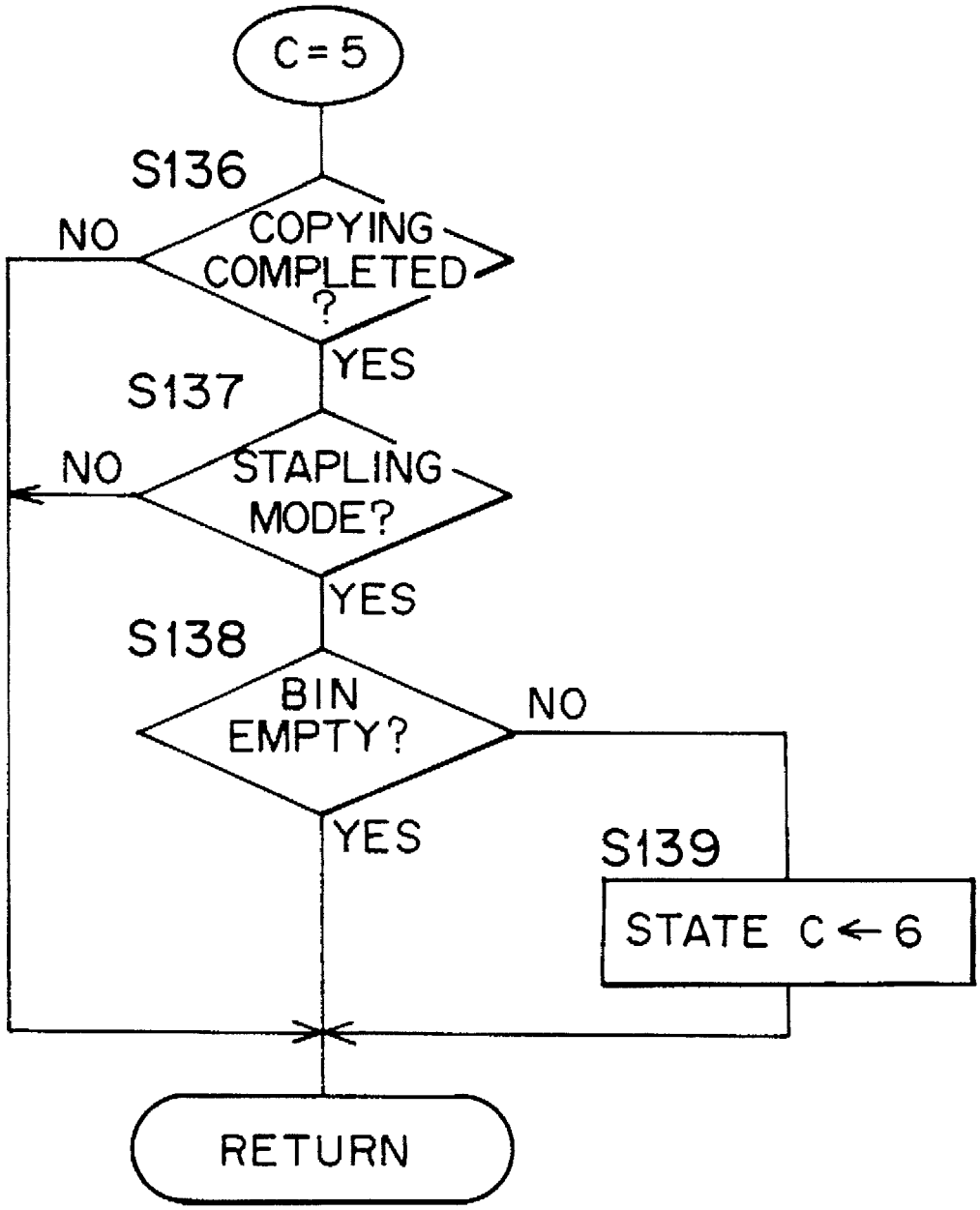
Figure 44:
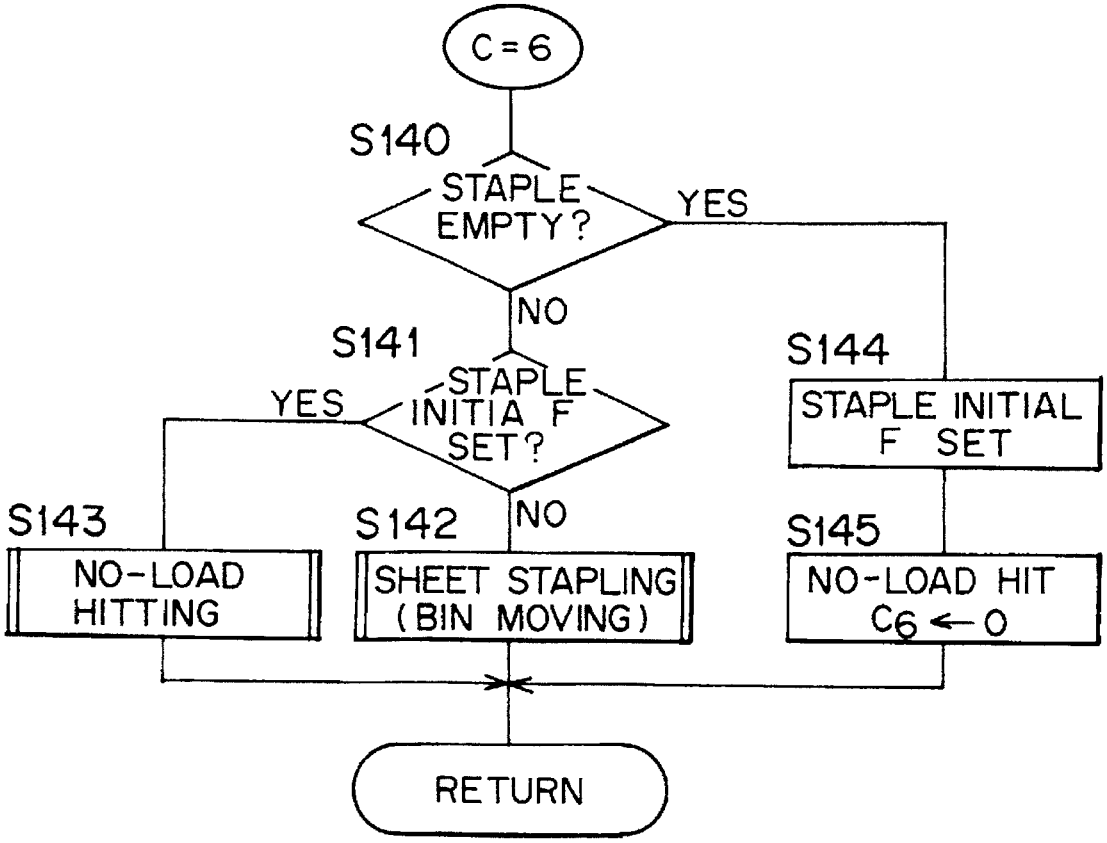

FIG. 21 shows a subroutine for emptiness checking which is carried out at step S23. This subroutine is carried out immediately before sorting operation to check whether there are any sheets in the bins 12.

At step S31, the presence or the non-presence of any sheets in the bins 12 is judged from the on/off state of the sensor SE3. If there are any sheets in the bins 12, this subroutine is immediately completed. If there are no sheets, it is judged at step S32 whether to be in the middle of copying operation. If it is in the middle of copying operation, this subroutine is immediately completed, and if not, a state counter A is set to "1" at step S33. The state counter A is used in bin moving operation which will be described in detail later.

FIGS. 22 through 28 show a subroutine for bin moving which is carried out at step S24. In this subroutine, the bins 12 are first set in the sorting initial position and are moved upward or downward step by step.

First, the state counter A is checked at step S41, and the processing thereafter depends on the counter value.

While the state counter A is "1", it is judged from the on/off state of the sensor SE1 whether the bins 12 are in the lowest position. If the bins 12 are in the lowest position, the state counter A is set to "3" at step 43. If not, at step S44, the bin motor M2 is driven in reverse to move the bins 12 downward, a bin trouble timer $T_1$ is set, and the state counter A is set to "2".

While the state counter A is "2", it is judged from the on/off state of the sensor SE1 whether the bins 12 has reached the lowest position. When the arrival of the bins 12 in the lowest position is judged, at step S46, the bin motor M2 is stopped, and the bin trouble timer $T_1$ is cleared. Simultaneously, a receiving bin counter $C_1$ is reset to "0", and the state counter A is set to "3". The receiving bin counter $C_1$ is to indicate which one of the bins 12(*n*) and $\mathbf{12}_{(1)}$ through $\mathbf{12}_{(20)}$ is set in the sheet hand-out position A. In this case, since the non-sort bin 12(n) is set in the sheet hand-out position A, the value of the counter $C_1$ is "0".

If the expiration of the bin trouble timer $T_1$ is confirmed before the bins 12 are set in the lowest position, at step S48 it is Judged from the state of the sensor SE2 whether the bins 12 are in the regular position, that is, whether any one of the bins 12 is correctly set in the sheet hand-out position A. If the result at step S48 is "YES", the sorting trouble flag is set at step S49 to inhibit sorting operation. In this case, the bin 12 set in the hand-out position A is allowed to receive sheets in the non-sorting mode. If the result at step 48 is "NO", the tray trouble flag is set at step S50 to inhibit copying operation of the machine 1.

While the state counter A is "3", it is checked at step S51 whether the sorting mode is selected. If the sorting mode is selected, it is checked at step S52 whether the bins 12 are in the sorting initial position. The sorting initial position of the bins 12 is the position where the first sort bin $\mathbf{12}_{(1)}$ is in the sheet hand-out position A. If the bins 12 are not in the sorting initial position, the bin motor M2 is rotated in the normal direction at step S53 to move the bins 12 upward. The normal rotation of the bin motor M2 is continued until the arrival of the bins 12 in the sorting initial position is confirmed at step S52. Then, the bin motor M2 is stopped at step S54, and the state counter A is set to "4" at step S55.

While the state counter A is "4", it is judged from the on/off state of the sensor SE5 whether a sheet has been handed into the bin 12 in the sheet hand-out position A. 0n the completion of the sheet handing-out, the value of the receiving bin counter $C_1$ and the value of a next bin counter $C_2$ are compared at step S57. The next bin counter $C_2$ indicates the bin number which is to receive the next sheet, and the value is transmitted from the CPU 150 of the machine 1 to the CPU 160 of the sorter 4. At the start of sorting operation, the receiving bin counter $C_1$ has a value of "0" (see step S46), and the next bin counter $C_2$ has a value of "1". If the counter value $C_1$ is not equal to the counter value $C_2$, the state counter A is set to "5"at step S58.

While the state counter A is "5", the value of the receiving bin counter $C_1$ and the value of the next bin counter $C_2$ are compared at step S59. The counter value $C_1$ is larger than the counter value $C_2$, the bin motor M2 is rotated in the reverse direction at step S60 such that the one step upper bin will come to the sheet hand-out position A. Then, the state counter A is set to "6"at step S62. If the counter value $C_1$ is smaller than the counter value $C_2$, the bin motor M2 is rotated in the normal direction at step S61 such that the one step lower bin will come to the sheet hand-out position A, and then the state counter A is set to "6" at step S62.

While the state counter A is "6", at step S63 it is judged from the on/off state of the sensor SE2 whether the bins 12 are in the regular position. If the result at step S63 is "YES", which means that the bin to receive the next sheet has reached the hand-out position A, at step S64 it is judged from the rotating direction of the bin motor M2 whether the current movement of the bins 12 is an upward motion or a downward motion. If it is an upward motion, an increment is given to the receiving bin counter $C_1$ at step S65, and if it is a downward motion, a decrement is given to the receiving bin counter $C_1$ at step S66. Next, the value of the receiving bin counter $C_1$ is compared with the value of the next bin counter $C_2$ at step S67. If the counter value $C_1$ is equal to the counter value $C_2$, at step S68, the bin motor M2 is stopped, and the state counter A is set to "4".

Thereafter, the next sheet is fed from the machine 1 into the sorter 4, and the sorting operation is continued. During the sorting operation, every time a sheet is ejected from the machine 1, the value of the next bin counter $C_2$ is changed in response to a signal from the CPU 150.

FIGS. 29 through 37 show a subroutine for sheet aligning which is carried out at step S25. This subroutine is to align sheets in each bin by moving the aligning rod 41 every time a sheet is handed into a bin and after stapling operation is completed.

First, a state counter B is checked at step S71, and the processing thereafter depends on the counter value. The state counter B is set to "1" when the sorting mode is selected.

While the state counter B is "1", at step S72 it is judged from the on/off state of the sensor SE6 whether the aligning rod 41 is in the home position. If the aligning rod 1 is in the home position, the state counter B is set to "3" at step S73. If not, at step S74, the aligning motor M5 is rotated in reverse to move the aligning rod 41 to the rear, the aligning trouble timer $T_2$ is set, and the state counter B is set to "2".

While the state counter B is "2", at step S75 it is judged from the on/off state of the sensor SE6 whether the aligning rod 41 has reached the home position. When the arrival of the aligning rod 41 in the home position is judged, at step S76, the aligning motor M5 is stopped, the trouble timer $T_2$ is cleared, and the state counter B is set to "3". However, if it is judged at step S77 that the aligning trouble timer $T_2$ expires before the aligning rod 41 reaches the home position, at step S78, the tray trouble flag is set to inhibit copying operation of the machine 1.

While the state counter B is "3", at step S79 it is judged from the on/off state of the sensor SE5 whether a sheet has been handed into the bin 12 in the sheet hand-out position A. When the completion of the sheet handing-out judged, the state counter B is set to "4" at step S80.

While the state counter B is "4", at step S81 it judged from the on/off state of the sensor SE2 whether the bins 12 have been moved one step up or down. When the completion of the bin movement is judged, at step S82 the number of driving pulses of the aligning motor M5 to move the aligning rod 41 to the aligning position is calculated from the sheet size. The sheet size data have been already transmitted from the CPU 150 to the CPU 160. Then, the motor M5 is set for rotation in the normal direction at step S83, and the state counter B is set to "5".

While the state counter B is "5", the aligning motor M5 is checked at step 85 whether to be set for normal rotation. If the motor M5 is set for normal rotation, the motor M5 is rotated by one pulse at step S86, and a pulse counter C5 gains an increment at step S87. Then, the processing stays at step S88 until the value of the pulse counter $C_5$ becomes equal to the pulse number calculated at step S82. In the meantime, the aligning rod 41 comes to the front from the home position. When the pulse counter value $C_5$ becomes equal to the calculated pulse number, which means that the aligning rod 41 has reached the aligning position, at step S89, the pulse counter $C_5$ is cleared, and the aligning motor M5 is set for reverse rotation.

When the aligning motor M5 is set for reverse rotation ("NO" at step S85), the motor M5 is rotated by one pulse at step 91, and the pulse counter $C_5$ gains an increment at step 92. Then, the processing stays at step S93 until the pulse counter value $C_5$ becomes equal to the calculated pulse number. In the meantime, the aligning rod 41 moves to the rear from the aligning position. When the pulse counter value $C_5$ becomes equal to the calculated pulse number, which means that the aligning rod 41 has returned to the home position, at step S94, the pulse counter $C_5$ is cleared, and the state counter B is set to "6".

While the state counter is "6", it is judged at step S96 whether the copying operation is completed. The judgment of the completion of copying operation is based on data transmitted from the CPU 150 to the CPU 160. If the copying operation is not completed, the state counter B is set to "3" at step S100 to continue the sheet aligning operation. If the copying operation is completed, it is judged at step S97 whether the stapling mode is selected. If the stapling mode is not selected, the state counter B is set to "1" at step S99. If the stapling mode is selected, the state counter B is set to "7" at step S98. The steps thereafter are to align stapled sheets in each bin 12.

While the state counter B is "7", it is judged at step S101 whether stapling operation is completed. On confirmation of the completion of the stapling operation, the number of driving pulses of the aligning motor M5 is calculated from the sheet size at step S102. Then, the motor M5 is set for normal rotation at step S103, and the state counter B is set to "8" at step S104.

While the state counter is "8", the aligning motor M5 is checked at step S105 whether to be set for normal rotation. If the motor M5 is set for normal rotation, the motor M5 is rotated by one pulse at step S106, and the pulse counter $C_5$ gains an increment at step S107. Then, the processing stays at step S108 until the pulse counter value $C_5$ becomes equal to the pulse number calculated at step S102. In the meantime, the aligning rod 41 moves to the front from the home position in order to align the stapled sets of sheets. When the counter value $C_5$ becomes equal to the calculated number, the pulse counter $C_5$ is cleared at step S109, and the aligning motor M5 is set for reverse rotation at step S110.

When the aligning motor is set for reverse rotation ("NO" at step S105), the motor M5 is rotated by one pulse at step S111, and the pulse counter $C_5$ gains an increment at step S112. Then, the processing stays at step S113 until the pulse counter value $C_5$ becomes equal to the calculated pulse number. In the meantime, the aligning rod 41 moves to the rear from the aligning position. When the counter value $C_5$ becomes equal to the calculated pulse number, which means that the aligning rod 41 has returned to the home position, the pulse counter $C_5$ is cleared at step S114, and the state counter B is set to "1" at step S115.

FIGS. 38 through 44 show a subroutine for stapling which is carried out at step 26. In the subroutine, the chucking 90 and the stapler 100 are checked whether to be in the respective home positions, and the presence of staples in the stapler 100 is checked. When all the conditions are met, stapling is carried out.

First, a state counter C is checked at step S121, and the processing thereafter depends on the counter value. The state counter C is set to "1" when the stapling mode is selected.

While the state counter C is "1", at step S122 it is judged from the on/off state of the sensors SE7 and SE8 whether the chucking 90 is in the home position. If the chucking 90 is in the home position, the state counter C is set to "3" at step S123. If not, at step S124, the chucking motor M3 is turned on, a chucking trouble timer $T_3$ is set, and the state counter C is set to "2".

While the state counter C is "2", at step S125 it is judged from the on/off state of the sensors SE7 and SE8 whether the chucking 90 has reached the home position. On confirmation of the arrival of the chucking 90 in the home position, at step S126, the chucking motor M3 is turned off, the chucking trouble timer $T_3$ is cleared, and the state counter C is set to "3". However, if the chucking trouble timer $T_3$ expires before the chucking 90 reaches the home position, the stapling trouble flag is set at step S128 to inhibit stapling operation.

While the state counter C is "3", at step S129 it judged from the on/off state of the sensor SE10 whether the tap of the stapler 100 is in the home position. If the tap of the stapler 100 is in the home position, the state counter C is set to "5" at step S130. If not, at step S131, the stapler motor M4 is turned on, the stapling trouble timer $T_4$ is set, and the state counter C is set to "4".

While the state counter C is "4", at step S132 it is judged from the on/off state of the sensor SE10 whether the tap of the stapler 100 has reached the home position. On confirmation of the arrival of the tap in the home position, at step S133, the stapler motor M4 is turned off, the stapling trouble timer $T_4$ is cleared, and the state counter C is set to "5". However, if the stapling trouble timer $T_4$ expires before the tap reaches the home position, the stapling trouble flag is set at step S135 to inhibit stapling operation.

While the state counter C is "5", the completion of copying operation is checked at step S136, and selection of the stapling mode is checked at step S137. If the completion of copying operation and the selection of the stapling mode are confirmed at the respective steps S136 and S137, at step S138 it is judged from the on/off state of the sensor SE3 whether there are sheets in the bins 12. If there are no sheets, the processing returns to the main routine, and if there are any sheets, the state counter C is set to "6" at step S139.

While the state counter C is "6", at step S140 it is judged from the on/off state of the sensor SE11 whether there are any staples left in the stapler 100. If there are no staples, a staple initial flag is set at step S144, and a no-load hitting counter $C_6$ is reset to "0" at step S145. Although it is not shown in the flowchart of FIG. 44, the setting of the staple initial flag is indicated on the operation panel. Thereby, the operator is informed of the necessity of loading staples and exchanges cartridges through the small door of the sorter 4.

If there are any staples ("NO" at step S140), the staple initial flag is checked at step S141. If the staple initial flag is not set, sheet stapling together with bin moving is carried out at step S142. If the staple initial flag is set, which means that a new staple cartridge has been loaded, no-load hitting is carried out at step S143.

In the present embodiment, no-load hitting is carried out before sheet chucking. In this method, since it never happens that sheets are subjected to no-load hitting while being held by the chucking 90, the sheets will not have damage and unnecessary staple hitting during the no-load hitting. However, it is possible to carry out no-load hitting after sheet chucking. In this case, if a staple is pushed out of the cartridge unnecessarily during the no-load hitting, the staple is hit in the sheets, and a trouble that the staple pushed out of the cartridge is stuck inside the stapler 100 will never occur.

Figure 45:
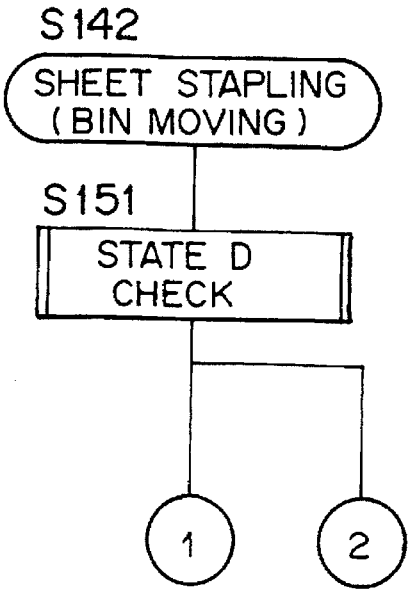
FIGS. 45, 46 and 47 are flowcharts showing a subroutine for sheet stapling together with bin moving.
Figure 46:
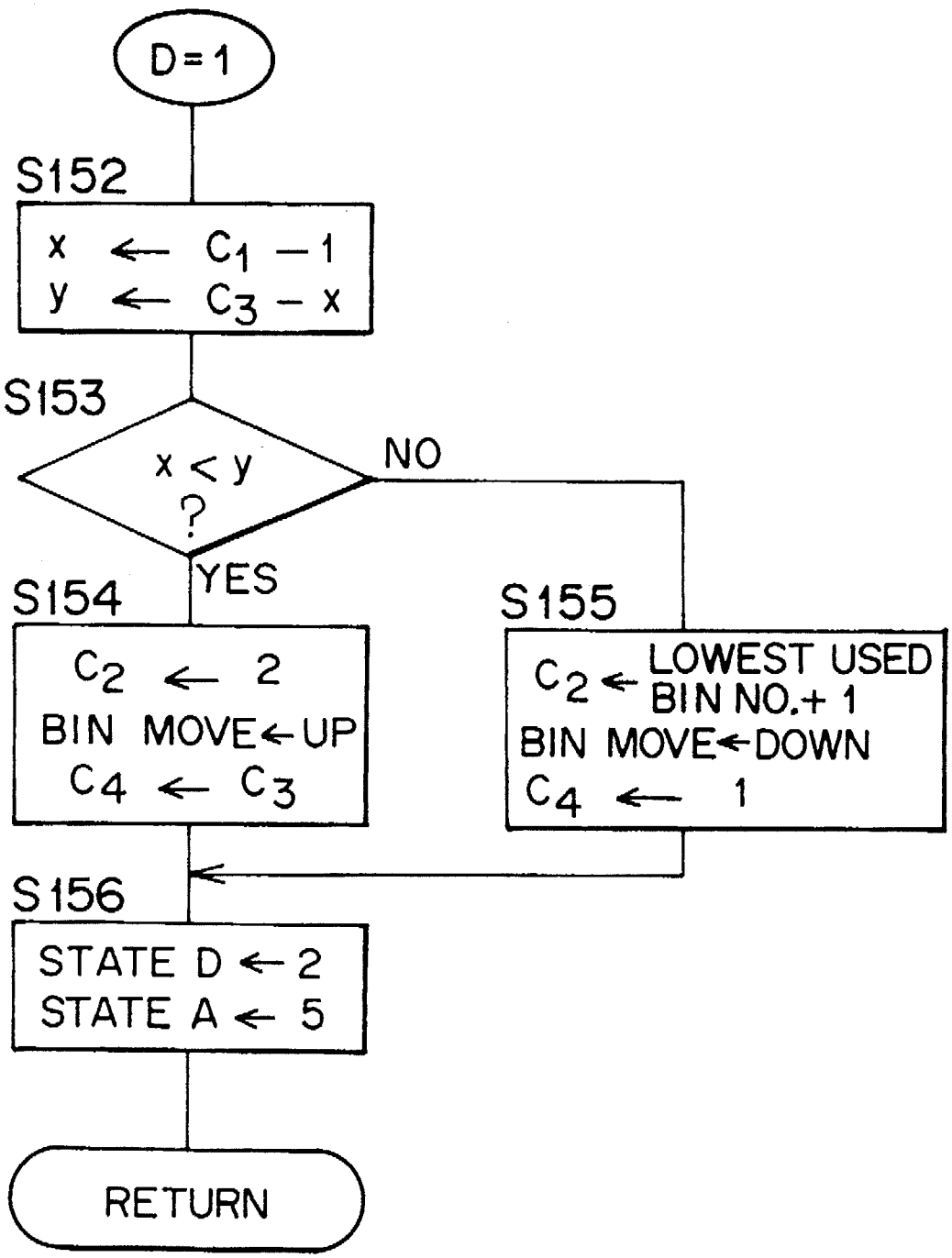
Figure 47:
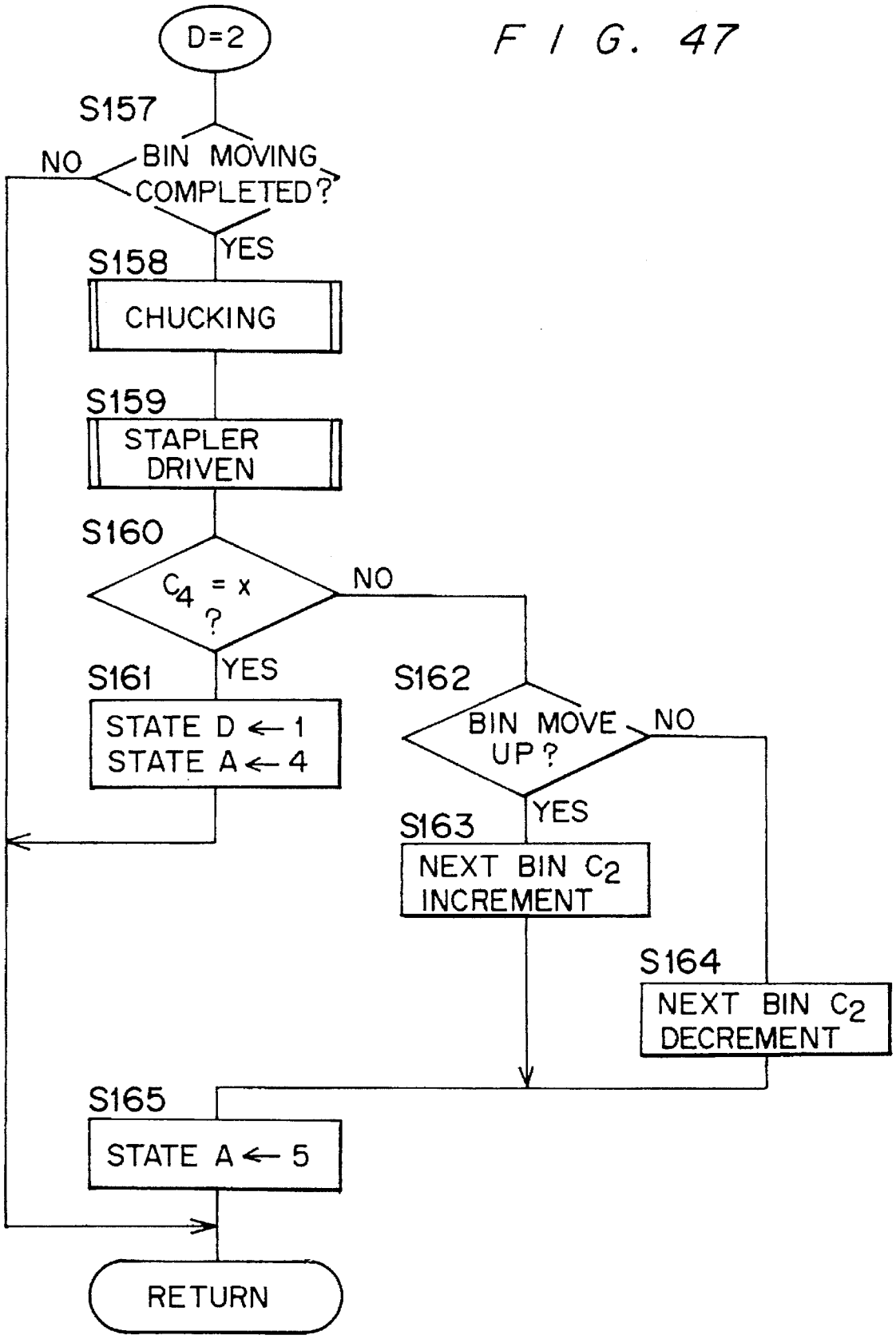

FIGS. 45, 46 and 47 show a subroutine for the sheet stapling (bin moving) which is carried out at step S142. In this subroutine, the bins 12 are moved upward or downward step by step to be set to the stapling level $B_1$ one by one, and sheets in the bin 12 on the stapling level $B_1$ are moved to the stapling position $B_2$ by the chucking 90 to be stapled by the stapler 100.

First, a state counter D is checked at step S151, and the processing thereafter depends on the counter value.

While the state counter D is "1", at step S152, a counter x is set to a value of the receiving bin counter value $C_1$ minus one, and a counter y is set to a value of a used bin counter value $C_3$ minus the counter value x. The used bin counter $C_3$ indicates the number of bins used for the sorting operation, that is, the number of copy sets. The counter x indicates the bin number which is set on the stapling level $B_1$, and the counter y indicates the number of used bins which are below the stapling level $B_1$.

Next, the counter values x and y are compared at step S153. If the value x is smaller than the value y, it means that the first sort bin $12_{(1)}$ is in the sheet hand-out position A. In this case, at step S154, the next bin counter $C_2$ is set to "2", an upward movement of the bins 12 is designated, and a stapling final bin counter $C_4$ is set to the value of the used bin counter $C_3$. If the value x is not smaller than the value y, it means that the lowermost of the used bins is in the sheet hand-out position A. In this case, at step S155, the next bin counter $C_2$ is set to a value of the lowermost used bin number plus one, a downward movement of the bins 12 is designated, and the stapling final bin counter $C_4$ is set to "1".

After the step S154 or S155, at step S156, the state counter D is set to "2", and the state counter A is set to "5" to prosecute the movement of the bins 12.

While the state counter D is "2", it is judged at step S157 whether the movement of the bins 12 is completed. Upon the completion of the bin movement, at step S158, the chucking 90 grabs sheets in the bin 12 set on the stapling level $B_1$ and carries the sheets to the stapling position $B_2$. Subsequently, at step S159 the stapler 100 is driven to staple the sheets.

Next, the counter value x is compared with the stapling final bin counter value $C_4$ at step S160. If the counter value x is equal to the counter value $C_4$, which means that all the sets of sheets stored in the sort bins 12 have been stapled, at step S161, the state counter D is set to "1", and the state counter A which controls movement of the bins 12 is set to "4".

On the other hand, if the counter value x is not equal to the counter value C, which means that any sets of sheets are left unstapled, it is checked at step S162 whether movement of the bins 12 is designated upward or downward. If it is an upward movement, an increment is given to the next bin counter $C_2$ at step S163. If it is a downward movement, a decrement is given to the next bin counter $C_2$ at step S164. Then, the state counter A is set to "5" at step S165.

Figure 48:
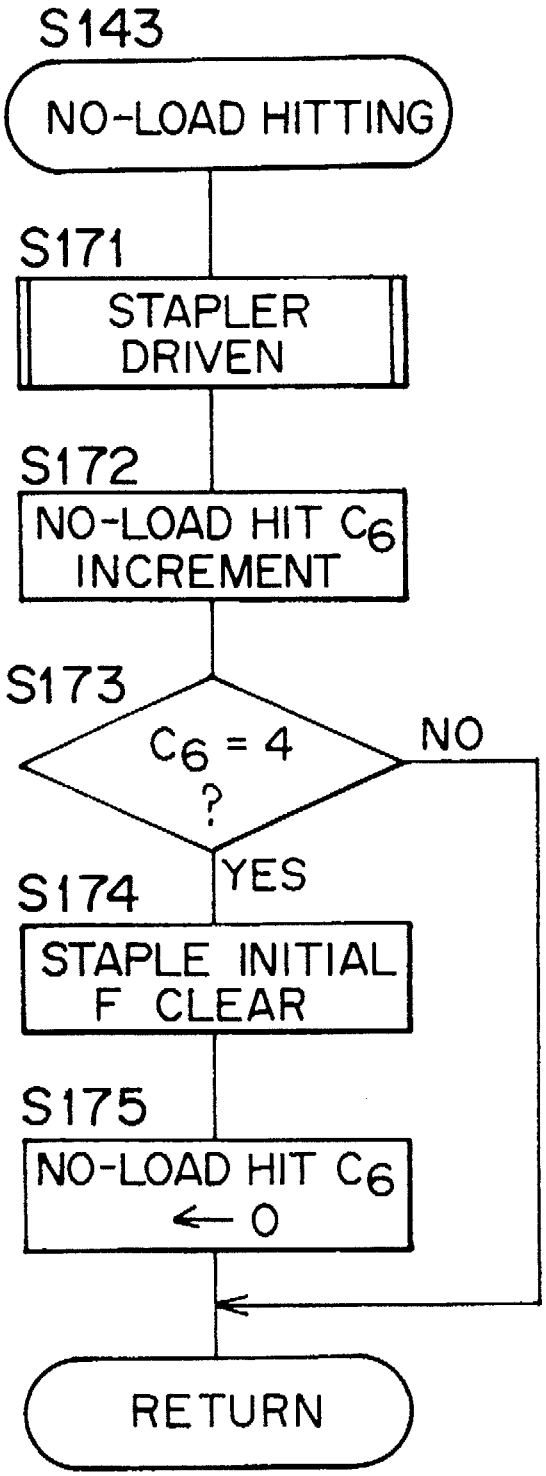
FIGS. 48 and 49 are flowcharts showing subroutines for no-load hitting of the stapler.

FIG. 48 shows a subroutine for the no-load hitting of the stapler 100 which is carried out at step S143. This subroutine is carried out immediately after loading of a new staple cartridge in order to feed a staple from the cartridge to the tap by prosecuting no-load hitting four times.

First, at step S171, the stapler motor M4 is turned on to drive the tap and to feed a staple by one step. Next, a no-load hitting counter $C_6$ gains an increment at step S172. The no-load hitting counter value $C_6$ is checked at step S173, and steps S171 and S172 are repeated until the counter value $C_6$ becomes "4". In the meantime, a staple is certainly fed to the tap from the new cartridge. When the counter value $C_6$ becomes "4", the staple initial flag is cleared at step S174, and the no-load hitting counter $C_6$ is reset to "0" at step S175.

Figure 49:
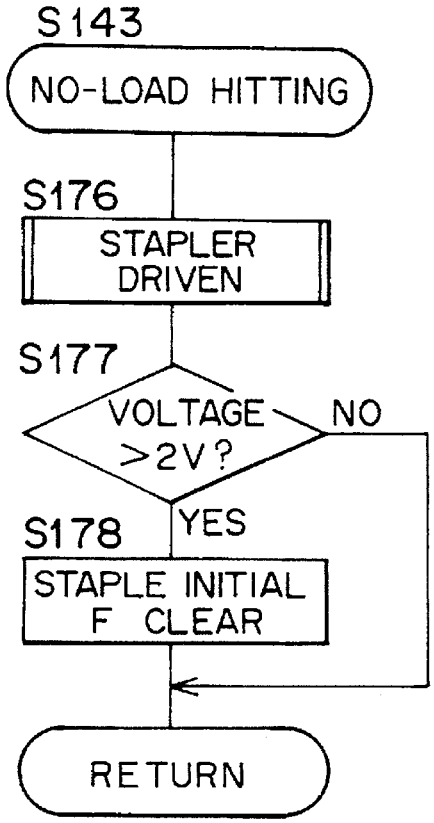
Figure 50:
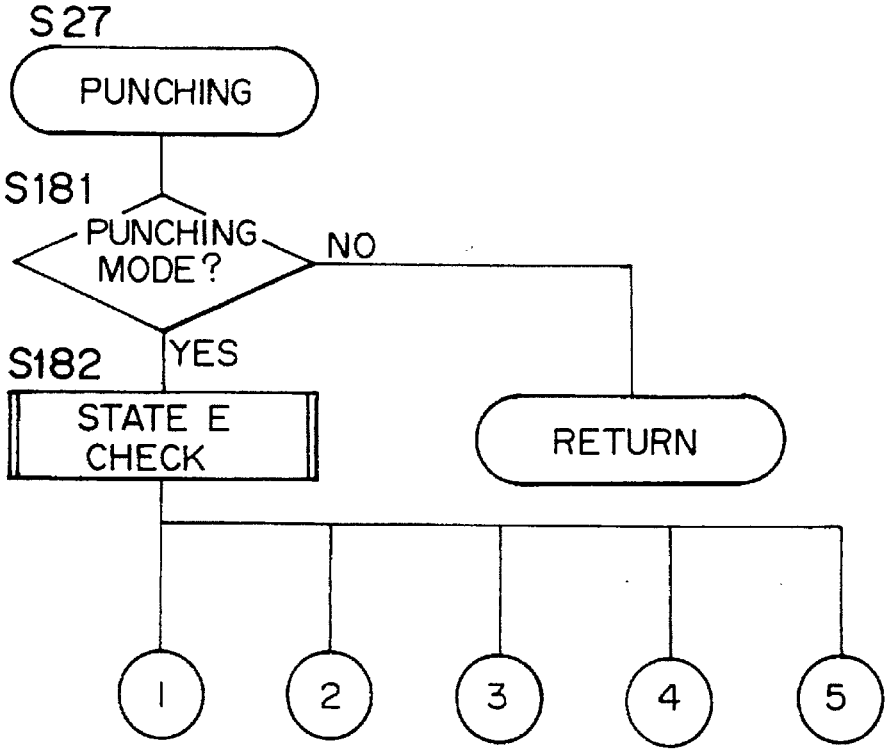
FIGS. 50, 51, 52, 53, 54 and 55 are flowcharts showing a subroutine for punching.
Figure 51:
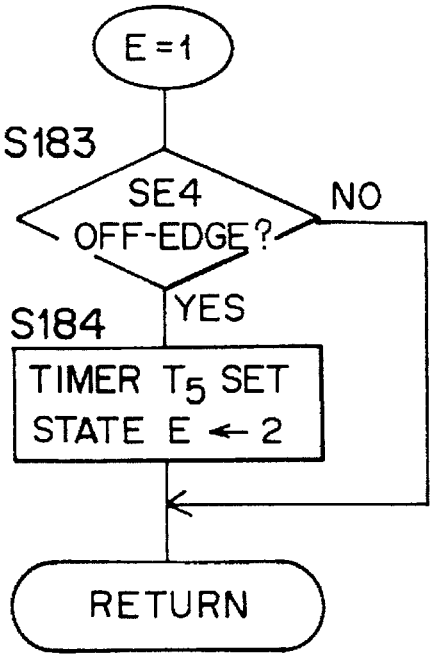
Figure 52:
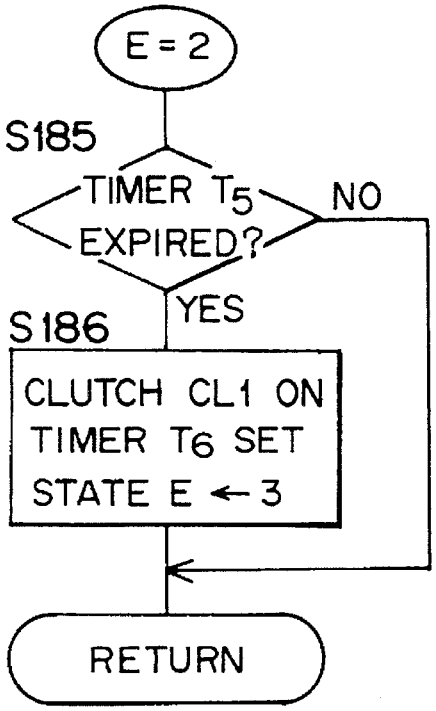
Figure 53:
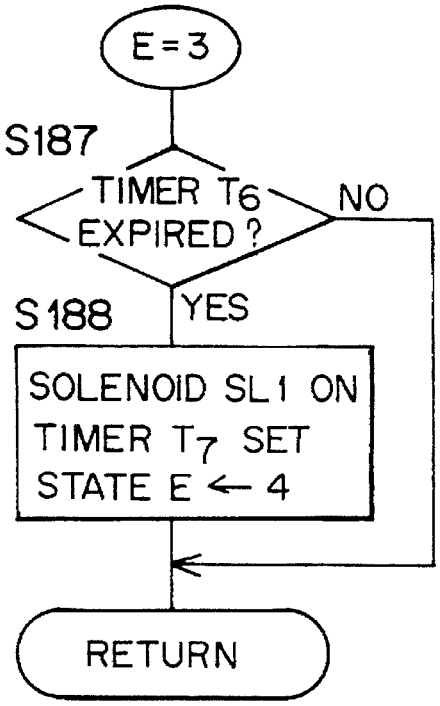
Figure 54:
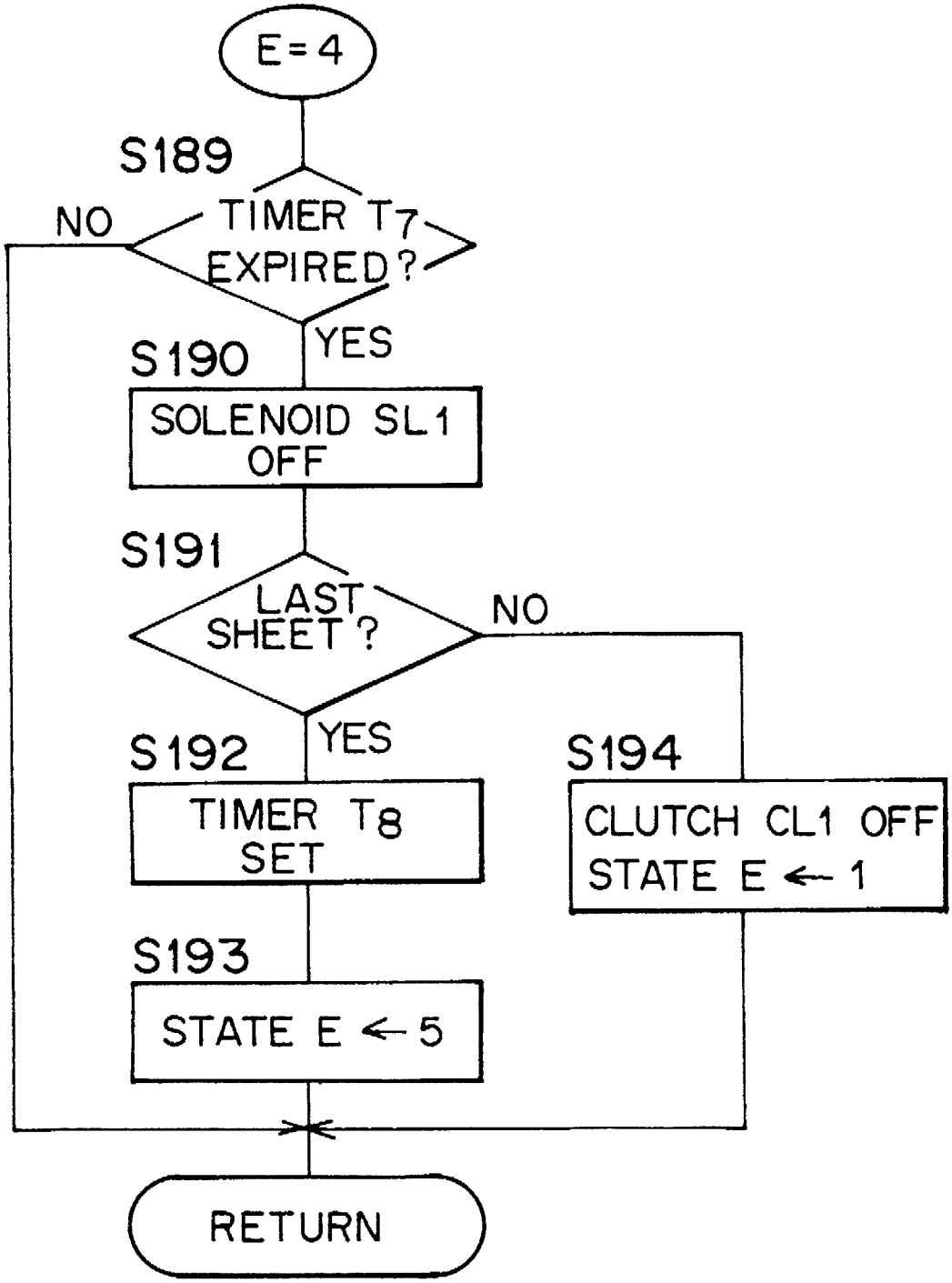
Figure 55:
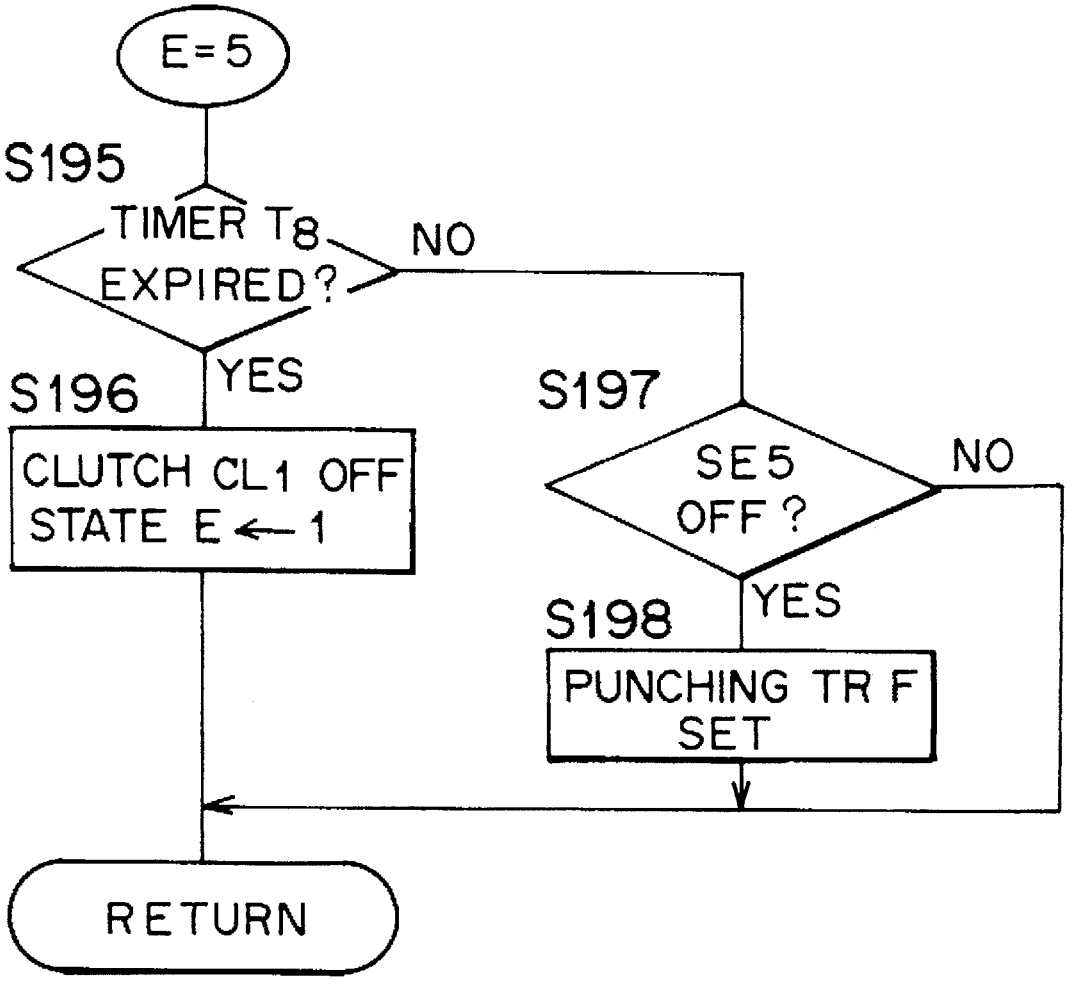

FIG. 49 shows another subroutine for the no-load hitting which is carried out at step S143. In this subroutine, the voltage on the point A (see FIG. 16) is detected 200 milliseconds after the turning-on of the stapler motor M4, and the hitting of the tap is judged from the voltage whether to be no-load hitting or loaded hitting (see FIGS. 17*a* and 17*b*).

First, the stapler motor M4 is turned on at step S176 to drive the tap and to feed a staple by one step. Next, the voltage on the point A is checked at step S177 whether to be over 2 V. Step S176 is repeated until the voltage on the point A becomes over 2 V. When the voltage on the point A becomes over 2 V, the staple initial flag is cleared at step S178.

FIGS. 50 through 55 show a subroutine for the punching which is carried out at step 27. In this subroutine, a sheet is punched at the trailing portion while traveling in the sheet transporting mechanism 50.

First, it is confirmed at step S181 that the punching mode is selected, and a state counter E is checked at step S182. The processing thereafter depends on the counter value. The state counter E is set to "1" when the punching mode is selected.

While the state counter E is "1", the sensor SE4 is checked at step S183 whether to be off-edge. When the sensor SE4 is off-edge, which means that the trailing edge of a sheet has passed the detection point of the sensor SE4, at step S184, a clutch delay timer $T_5$ is set, and the state counter E is set to "2". The time set in the clutch delay timer $T_5$ corresponds to a movement of the trailing edge of the sheet from the detection point of the sensor SE4 to a point 10 mm upstream of the register roller pair 52.

While the state counter E is "2", the clutch delay timer $T_5$ is checked at step S185. On confirmation of the expiration of the timer $T_5$, at step S186, the electromagnetic clutch CL1 is turned on, a solenoid delay timer $T_6$ is set, and the state counter E is set to "3". By the turning-on of the clutch CL1, the roller pairs 53 and 54 are stopped, and the sheet forms a curved portion $S_1$ (see FIG. 4). The solenoid delay timer $T_6$ is to time a drive of the punching mechanism 60. The punching mechanism 60 should be driven when the trailing edge of the sheet is regulated by the nipping portion of the register roller pair 52.

While the state counter E is "3", the solenoid delay timer $T_6$ is checked at step S187. On confirmation of the expiration of the timer $T_6$, at step S188, the flapper solenoid SL1 is turned on, a solenoid timer $T_7$ is set, and the state counter E is set to "4". By the turning-on of the flapper solenoid SL1, the one-rotation clutch 66 is connected, and the punching sticks 63 are driven to make holes in the sheet at the trailing portion. The solenoid timer $T_7$ determines a time of turning off the flapper solenoid SL1.

While the state counter is "4", the solenoid timer $T_7$ is checked at step S189. On confirmation of the expiration of the timer $T_7$, at step S190, the flapper solenoid SL1 is turned off to disconnect the one-rotation clutch 66. Next, it is judged at step S191 whether the sheet in the transporting mechanism 60 is the last sheet (the last copy of the last document). If it is not the last sheet, at step S194, the electromagnetic clutch CL1 is turned off, and the state counter E is set to "1". Thereby, the roller pairs 53 and 54 start rotating again, and the punched sheet is handed into the bin 12. Thereafter, the punching operation is continuously prosecuted toward the succeeding sheets.

On the other hand, if it is the last sheet, a clutch timer $T_8$ is set at step S192, and the state counter is set to "5"at step S193. The clutch timer $T_8$ is to determine a time of turning off the electromagnetic clutch CL1 and to detect any trouble in the punching mechanism 60.

While the state counter E is "5", the clutch timer $T_8$ is checked at step S195. On confirmation of the expiration of the timer $T_8$, at step S196, the electromagnetic clutch CL1 is turned off, and the state counter E is set to "1". At step S197, if the sensor SE5 is judged off before the expiration of the timer $T_8$, the punching trouble flag is set at step S198 to inhibit punching operation.

Although the present invention has been described in connection with the preferred embodiment, it is to be noted that various changes and modifications are possible to those who are skilled in the art. Such changes and modifications are to be understood as being within the scope of the present invention.

What is claimed is:

1. A finisher for handling sheets ejected from an image forming machine, the finisher comprising:

a plurality of bins which are arranged one upon another at intervals of a specified distance;

bin moving means for moving the bins wholly upward and downward step by step, one step corresponding to the specified distance of the intervals among the bins, the bin moving means changes the movement of the bins from an upward movement to a downward movement and vice versa every time a group of sheets have been distributed to the bins;

sheet transporting means for transporting sheets from the image forming machine to the bins, the sheet transporting means handing out each sheet into each bin on a specified sheet hand-out level;

stapling means for carrying out a stapling operation to staple sheets stored in the bins, the stapling means being disposed on a level near the sheet hand-out level; and control means for, after a last sheet is handed out from the transporting means into a bin, starting the stapling operation with sheets stored in the bin which has received the last sheet;

wherein the plurality of bins stand by at a low position;

while sheets of an odd page are transported to the bins, the bins are moved upward step by step; and while sheets of an even page are transported to the bins, the bins are moved downward step by step.

2. A finisher as claimed in claim 1, wherein:

the stapling means is disposed on a level one step higher than the sheet hand-out level; and after a last sheet is handed into a bin, the control means controls the bin moving means to move the bins wholly upward by one step to start the stapling operation.

3. A finisher for handling sheets ejected from a copying machine, the finisher comprising:

a plurality of bins which are arranged one upon another at intervals of a specified distance, sheets ejected from the copying machine being transported to the bins one by one;

a reference plate for regulating a side of a sheet received by a bin;

an aligning rod for pushing the sheet received by the bin toward the reference plate;

a controller which drives the aligning rod to push the sheet after a trailing edge of the sheet comes into the bin and before a leading edge of a next sheet comes into a next bin;

a stapler for stapling sheets received and aligned on the bins; and a bin moving mechanism for, every time a sheet is received by a bin, moving the bins upward or downward so as to set a next bin in a sheet receiving position, wherein the controller controls the bin moving mechanism to move the bins after a trailing edge of a sheet comes into one of the bins, and drives the aligning rod at a first timing after the movement of the bins is completed and before a leading edge of a next sheet comes into a next bin, the bin moving mechanism changing the movement of the bins from an upward movement to a downward movement and vice versa every time a group of sheets have been transported to the bins; and the controller, after a sheet is transported to an uppermost or a lowermost of used bins, drives the aligning rod at a second timing earlier than the first timing without driving the bin moving mechanism.

4. A method of containing sheets in bins of a sorter and stapling the sheets contained in the bins, the method comprising the steps of:

moving a plurality of bins, which are arranged one upon another at intervals of a specified distance, upward and downward step by step, one step corresponding to the specified distance of the intervals among the bins, to hand out each sheet ejected from an image forming machine into each bin on a specified sheet hand-out level; and stapling sheets contained in the bins by a stapler set in a specified place, starting with sheets in a bin which received a last sheet, moving the bins upward or downward step by step;

wherein the plurality of bins stand by at a low position;

while sheets of an odd page are handing out from the image forming machine, the bins are moved upward step by step; and while sheets of an even page are handing out from the image forming machine, the bins are moved downward step by step.

5. A method as claimed in claim 4,wherein:

the stapler is set on a level one step higher than the sheet hand-out level; and immediately after a last sheet is received by a bin, the bins are wholly moved upward by one step to start stapling sheets.

6. A method of aligning and stapling sheets, the method comprising the steps of:

transporting sheets ejected from a copying machine to a plurality of bins, which are arranged one upon another at intervals of a specified distance, one by one;

pushing a side of each sheet transported to each of the bins toward a reference plate by an aligning rod after a trailing edge of the sheet comes into the bin before a leading edge of a next sheet comes into a next bin; and stapling sheets stored and aligned in the bins;

wherein when a sheet has been transported into one of the bins, the bins are moved upward or downward such that a next bin is set in a sheet receiving position; and immediately after a trailing edge of sheet comes into a bin, the bins are moved upward or downward, and after completion of the movement of the bins and before a leading edge of a next sheet comes into a next bin, the aligning rod is driven at a first timing to push the sheet; and wherein after a group of sheets have been transported to the bins, the movement of the bins is changed from an upward movement to a downward movement and vice versa; and after a sheet is transported into an uppermost or a lowermost bin of used bins, the bins are not moved, and the aligning rod is driven at a second timing earlier than the first timing to push the sheet.

* * * * *